US012655780B2

(12) United States Patent
McGraw

(10) Patent No.: US 12,655,780 B2
(45) Date of Patent: Jun. 16, 2026

(54) SYSTEM FOR COOLING CATALYZED COMBUSTION EXHAUST GAS OF HYDROCARBON FUELED INTERNAL COMBUSTION ENGINES USED IN SMALL POWER EQUIPMENT AND POWER TOOLS

(71) Applicant: Harbor Freight Tools USA, Inc., Calabasas, CA (US)

(72) Inventor: Andrew Frances McGraw, Newbury Park, CA (US)

(73) Assignee: Harbor Freight Tools USA, Inc., Calabasas, CA (US)

( * ) Notice: Subject to any disclaimer, the term of this patent is extended or adjusted under 35 U.S.C. 154(b) by 0 days.

(21) Appl. No.: 18/749,223

(22) Filed: Jun. 20, 2024

(65) Prior Publication Data

US 2024/0426231 A1 Dec. 26, 2024

Related U.S. Application Data

(60) Provisional application No. 63/524,098, filed on Jun. 29, 2023, provisional application No. 63/521,945, filed on Jun. 20, 2023.

(51) Int. Cl.
*F01N 3/05* (2006.01)
*F01N 3/28* (2006.01)

(52) U.S. Cl.
CPC ..... *F01N 3/05* (2013.01); *F01N 3/2892* (2013.01)

(58) Field of Classification Search
CPC ..... F01N 3/05; F01N 3/2892; F01N 3/0205; F01N 3/04; F01N 3/30; F01N 3/34; F01N 13/002; F01N 2590/06; F01N 2610/00; F01N 2240/02
USPC ..... 60/274
See application file for complete search history.

(56) References Cited

U.S. PATENT DOCUMENTS 5,736,690 A * 4/1998 Karlsson ..... F01N 13/1855 60/299
2005/0217931 A1* 10/2005 Assad ..... F01N 1/081 181/258
2008/0245604 A1* 10/2008 Saunders ..... F01N 1/083 181/227
2019/0032531 A1* 1/2019 Hagawa ..... F01N 3/24

FOREIGN PATENT DOCUMENTS

CN 203769906 U * 8/2014
WO WO-2005040568 A1 * 5/2005 ..... B23Q 11/0046

* cited by examiner

*Primary Examiner* — Mark A Laurenzi
*Assistant Examiner* — Kelsey L Stanek
(74) *Attorney, Agent, or Firm* — MCANDREWS HELD & MALLOY, LTD

(57) ABSTRACT

An exhaust gas cooling system for cooling catalyzed combustion exhaust gas in small power equipment is disclosed. The system includes a cooling air guide and a mixing chamber. The mixing chamber includes an intake end, an exhaust end, and at least one cooling inlet. A short length exhaust, including a catalytic converter, is operably connected to the intake end of the mixing chamber, and is operable to direct catalyzed combustion exhaust gas through the intake end into the mixing chamber. The cooling air guide is operably connected to the at least one cooling inlet, and is operable to direct cooling air through the at least one cooling inlet into the mixing chamber. The mixing chamber is operable to facilitate mixing the catalyzed combustion exhaust gas and cooling air to reduce a peak temperature of a combined exhaust gas.

17 Claims, 41 Drawing Sheets

SYSTEM FOR COOLING CATALYZED COMBUSTION EXHAUST GAS OF HYDROCARBON FUELED INTERNAL COMBUSTION ENGINES USED IN SMALL POWER EQUIPMENT AND POWER TOOLS

CROSS REFERENCE TO RELATED APPLICATIONS

This application claims priority to U.S. Patent Application Ser. Nos. 63/521,945, filed on Jun. 20, 2023, and 63/524,098, filed on Jun. 29, 2023, which are herein incorporated by reference in their entirety.

BACKGROUND

The present disclosure relates to a system for reducing the peak temperatures of catalyzed combustion exhaust gases emitted by hydrocarbon fueled internal combustion engines having a short length exhaust system typically used on small power equipment and power tools. Such a system is desirable to reduce the risk of fire, damage to the equipment, injury to an operator, and individuals within the vicinity of the system.

An internal combustion engine utilizes combustion, which is the chemical process of releasing energy from a fuel and air mixture. At its core, the internal combustion engine converts energy from the combustion of fuel and air to work, which is defined as force x distance. In a typical spark ignition internal combustion engine for example, fuel is mixed with air and forced into a cylinder, which is then compressed by a piston and ignited by a spark—the combustion. The resulting expansion of the combustion gases pushes the piston, which in turn rotates a crankshaft connected to a system of gears in a powertrain. The powertrain in turn applies the power and torque generated by the engine to whatever application is being used in (e.g., the wheels of a car, alternator of a generator, cutting blade of a lawnmower, etc.). There are two primary byproducts of the combustion, heat and exhaust gases. Both the heat and exhaust gases have to be carefully controlled to prevent engine failure, injury to an operator, and damage to the nearby environment and individuals.

As mentioned, an internal combustion engine combusts a mixture of fuel and air. The fuel for an internal combustion engine is typically a hydrocarbon fuel, which is composed exclusively of hydrogen and carbon atoms. Air is composed primarily of nitrogen (approximately 78%) and oxygen (approximately 21%). During the combustion of the fuel-air mixture, a chemical reaction takes place in which hydrocarbon reacts with oxygen to create carbon dioxide, water, and heat. Specifically, the carbon in the hydrocarbon fuel bonds with the oxygen in the air creating carbon dioxide ($CO_2$), and the hydrogen in the hydrocarbon fuel bonds with the oxygen in the air creating water vapor ($H_2O$). Most of the nitrogen ($N_2$) contained in the air passes through the internal combustion engine. Thus, in a perfect combustion, the only emissions would be nitrogen gas ($N_2$), carbon dioxide ($CO_2$), and water vapor ($H_2O$).

Unfortunately, however, the combustion in an internal combustion engine is never perfect, and some smaller amounts of harmful byproducts are also produced. The most common harmful byproducts are carbon monoxide (CO), hydrocarbons or volatile organic compounds (VOCs, which are primarily, evaporated, unburned fuel); and nitrogen oxides (NO and $NO_2$, together called NOx). These harmful byproducts present serious health and environmental risk.

Thus, since approximately the 1980s, governmental agencies (e.g., the EPA in the US) have legislated that larger internal combustion engines used in most new automobiles, trucks, and boats include a catalytic converter to eliminate or reduce the amount of harmful byproducts resulting from the combustion process.

A catalytic converter utilizes a catalytic event (i.e., a chemical reaction) to burn up harmful byproducts of combustion exhaust gases at very high temperatures. Catalytic converters typically include two types of catalysts: a reduction catalyst and an oxidation catalyst. These converters consist of a ceramic structure coated with a metal catalyst, usually comprising platinum, rhodium and/or palladium. The reduction catalyst uses platinum and rhodium to help reduce the NOx emissions by separating the molecules into nitrogen and oxygen. The nitrogen is trapped within the catalytic converter, while the oxygen passes through. The oxidation catalyst reduces the unburned hydrocarbons and carbon monoxide by burning (i.e., oxidizing) them over a platinum and palladium catalyst resulting in carbon dioxide.

The chemical reactions in a catalytic converter create significant heat. This significant heat can be more difficult to manage in small internal combustion engine applications having short exhaust systems. Due to the short flow length between the catalytic converter and muffler outlet in such small engine applications, catalyzed combustion exhaust gas temperature at the muffler outlet can reach 700-1200° F. By comparison, a non-catalyzed exhaust system of the same length will have significantly lower muffler outlet temperature, in the range of 400-600° F.

In contrast, for larger scale internal combustion engine applications used in various machines and vehicles, such as cars, trucks, or boats, there are a variety of ways to cool the catalyzed combustion exhaust gases prior to being released to the environment. For example, in many vehicles having long length exhaust systems, the exhaust system design itself may contribute to the cooling of the exhaust gas before it exits the tailpipe. These exhaust systems typically consist of pipes, mufflers, and resonators that guide the combustion exhaust gases from the internal combustion engine to the tailpipe. The length, diameter, and routing of the exhaust pipes can help dissipate heat from the gases as they flow through the system and its various components, allowing the catalyzed combustion exhaust gases to cool before being released into the atmosphere.

Some vehicles also utilize exhaust gas recirculation systems (EGR) to control combustion temperatures. EGR involves redirecting a portion of the combustion exhaust gases back into the internal combustion engine's intake system. This process lowers the oxygen concentration in the combustion chamber, reducing peak combustion temperatures and thus lowering the temperature of the combustion exhaust gases. EGR systems typically employ heat exchangers to further cool the recirculated combustion exhaust gases before they are reintroduced into the engine.

Likewise, internal combustion engine used in maritime applications on a boat or ship, have additional cooling options due to abundant availability of cool water. For example, with many water-cooled internal combustion engines found on boats, cooling water is injected into the exhaust pipe, which drastically cools the exhaust gasses and also significantly muffles engine noise.

Thus, despite the required use of catalytic converters in larger scale internal combustion engine applications, powering automobiles, trucks, and boats, manufacturers have developed ways to cool the catalyzed combustion exhaust gases exiting prior to those gases being released to the atmosphere, thereby reducing the risk of fire, component failure, and injury.

Contrary to automobiles, trucks, and boats, which have had stringent emission requirements set by the EPA for many years, regulations for small power equipment and power tools utilizing hydrocarbon-fueled internal combustion engines have until recently been much less restrictive. Such power equipment may include, but is not limited to, gasoline or gas-powered generators (conventional and inverters), lawnmowers, leaf blowers, chainsaws, and weed whackers. In the past, these smaller internal combustion engine applications used on small power equipment and power tools did not require the use of a catalytic converter to reduce harmful byproducts and therefore did not require exhaust heat management systems to reduce the risk of fire and damage to the equipment itself as the non-catalyzed combustion exhaust gases have a significantly lower temperature than exhaust gases having passed through a catalytic converter.

Potential regulatory changes may require the use of catalytic converters on many smaller hydrocarbon fueled internal combustion engines, which present new problems for manufacturers. Many of these smaller internal combustion engine applications used in small power equipment and power tools are tightly packaged and have short length exhaust systems which do not have the same heat dissipation properties as larger exhaust systems found in many vehicles as described above. Therefore, the use of a catalytic converter, which creates catalyzed combustion exhaust gases exiting at higher temperatures, poses significant safety concerns to both the operators of those power tools and power equipment, risk of failure to the equipment itself, and risk of fire to anything or any individual in close proximity to the equipment.

For example, certain internal combustion engine powered equipment which is stationary while in use (e.g., portable generators (conventional and inverters), air compressors, or pumps) is often positioned near a structure or dwelling. Additionally, the fact that the equipment is stationary while in use provides additional complications as there is not constant moving air that helps to dissipate the combustion exhaust gases. Therefore, not only is there increased risk of the equipment itself melting or catching on fire, but anything in proximity of the equipment subject to the catalyzed combustion exhaust gases is at risk of catching fire. Likewise, internal combustion engine powered tools (e.g., chain saw, blower, weed whacker) and movable equipment (e.g., a lawnmower, snow blower, etc.) also carry increased risk once combustion exhaust gases are catalyzed. While these pieces of equipment are often in motion and therefore have some passive airflow dissipating the combustion exhaust gases, due to the fact that these pieces of equipment and tools are being held or operated in close proximity to a person, there is an increased risk of burns or injury to the operator.

The present disclosure provides a variety of systems to cool the catalyzed combustion exhaust gases in a short length exhaust system found in small power equipment and power tools to drastically reduce the temperature of those exhaust gases prior to being released into the atmosphere. The systems described in the present disclosure significantly reduce the risk of fire, equipment failure, or injury to an operator and those individuals in close proximity to the equipment.

SUMMARY

According to embodiments, an exhaust gas cooling system for cooling catalyzed combustion exhaust gas in small power equipment includes: a cooling air guide; and a mixing chamber including an intake end, an exhaust end, and at least one cooling inlet, wherein: a short length exhaust, including a catalytic converter, is operably connected to the intake end of the mixing chamber, and is operable to direct catalyzed combustion exhaust gas through the intake end into the mixing chamber; the cooling air guide is operably connected to the at least one cooling inlet, and is operable to direct cooling air through the at least one cooling inlet into the mixing chamber; and the mixing chamber is operable to facilitate mixing the catalyzed combustion exhaust gas and cooling air to reduce a peak temperature of a combined exhaust gas. The short length exhaust further may include a muffler outlet tube; the mixing chamber further may include a swirl mixer; and the cooling air guide further may include an air guide panel, wherein: the swirl mixer may include a swirl vane assembly positioned around a cylindrical sleeve, wherein the swirl vane assembly may be operable to induce the cooling air and catalyzed combustion exhaust into the mixing chamber to facilitate mixing of the catalyzed combustion exhaust with the cooling air, the cylindrical sleeve may be operably connected to the muffler outlet tube, and the air guide panel may include at least one radial rib, wherein the at least one radial rib is operable to direct cooling air into the at least one cooling inlet. The air guide panel may include an aperture sized to accommodate the mixing chamber. The at least one cooling inlet may include a plurality of cooling inlets and the at least one radial rib may include a plurality of radial ribs. The mixing chamber further may include a diffuser operable to diffuse the combined exhaust gas before the combined exhaust gas exits the exhaust end of the mixing chamber. The diffuser may include a cone diffuser. The diffuser may include a vane diffuser. The diffuser may include a perforated tube diffuser. The mixing chamber further may include a venturi section and the at least one cooling inlet may include at least one venturi inlet, wherein the venturi section may include a reduced diameter section and the at least one venturi inlet is disposed in the reduced diameter section; and the venturi section may be operable to facilitate mixing of the catalyzed combustion exhaust gas with the cooling air. The mixing chamber further may include a swirl mixer including a plurality of swirl vanes positioned around the venturi section, wherein the plurality of swirl vanes may be operable to induce the cooling air and catalyzed combustion exhaust into the mixing chamber. The mixing chamber further may include a coaxial mixer, wherein: the at least one cooling inlet may include an outer cooling air duct, an inner muffler outlet tube may be positioned at least partially within the outer cooling air duct, and the coaxial mixer may be operable to coaxially mix the catalyzed combustion exhaust gas with the cooling air to facilitate mixing of the catalyzed combustion exhaust gas with the cooling air. The mixing chamber further may include a tangential swirl mixer and the at least one cooling inlet further may include at least one tangential intake duct; wherein: the tangential intake duct may be operable to tangentially direct cooling air into the mixing chamber to induce the cooling air and catalyzed combustion exhaust into the mixing chamber to facilitate mixing of the catalyzed combustion exhaust with the cooling air.

According to embodiments small power equipment includes: an internal combustion engine, a short length exhaust including a catalytic converter operably connected to the internal combustion engine, the short length exhaust being operable to receive combustion exhaust gas from the internal combustion engine, an exhaust cooling system operably connected to the short length exhaust, the exhaust cooling system being operable to received catalyzed combustion exhaust gas from the short length exhaust; wherein the exhaust cooling system comprises: a cooling air guide; and a mixing chamber including an intake end, an exhaust end, and at least one cooling inlet, wherein: the short length exhaust is operably connected to the intake end of the mixing chamber; the cooling air guide is operably connected to the at least one cooling inlet, and is operable to direct cooling air through the at least one cooling inlet into the mixing chamber; and the mixing chamber is operable to facilitate mixing of the catalyzed combustion exhaust gas and cooling air to reduce a peak temperature of a combined exhaust gas. The short length exhaust further may include a muffler outlet tube; the mixing chamber further may include a swirl mixer; and the cooling air guide further may include an air guide panel, wherein: the swirl mixer may include a swirl vane assembly positioned around a cylindrical sleeve, wherein the swirl vane assembly may be operable to induce the cooling air and catalyzed combustion exhaust into a vortex within the mixing chamber to facilitate the mixing of the catalyzed combustion exhaust with the cooling air, the cylindrical sleeve may be operably connected to the muffler outlet tube, and the air guide panel may include at least one radial rib, wherein the at least one radial rib is operable to direct cooling air into the at least one cooling inlet. The mixing chamber further may include a venturi section and the at least one cooling inlet may include at least one venturi inlet, wherein the venturi section may include a reduced diameter section and the at least one venturi inlet is disposed in the reduced diameter section; and the venturi section may be operable to facilitate mixing of the catalyzed combustion exhaust gas with the cooling air. The mixing chamber further may include a swirl mixer including a plurality of swirl vanes positioned around the venturi section, wherein the plurality of swirl vanes may be operable to induce the cooling air and catalyzed combustion exhaust into the mixing chamber. The mixing chamber further may include a coaxial mixer, wherein: the at least one cooling inlet may include an outer cooling air duct, an inner muffler outlet tube may be positioned at least partially within the outer cooling air duct, and the coaxial mixer may be operable to coaxially mix the catalyzed combustion exhaust gas with the cooling air to facilitate mixing of the catalyzed combustion exhaust gas with the cooling air. The mixing chamber further may include a tangential swirl mixer and the at least one cooling inlet further may include at least one tangential intake duct; wherein: the tangential intake duct may be operable to tangentially direct cooling air into the mixing chamber to induce the cooling air and catalyzed combustion exhaust into the mixing chamber to facilitate mixing of the catalyzed combustion exhaust with the cooling air. The small power equipment further may include a powered fan operable to force a flow of cooling air into the cooling air guide.

According to embodiments, a method for cooling catalyzed combustion exhaust in small power equipment including a short length exhaust includes: providing an exhaust cooling system, the exhaust cooling system including a cooling air guide and a mixing chamber; directing the catalyzed combustion exhaust gas into the mixing chamber; directing cooling air via the cooling air guide into the mixing chamber; mixing the catalyzed combustion exhaust gas with the cooling air within the mixing chamber to reduce a peak temperature of a combined exhaust gas.

BRIEF DESCRIPTION OF THE FIGURES

The following is a brief description of the drawings pertaining to the present disclosure, which will be discussed in more detail in the detailed description section below.

Figure 1:
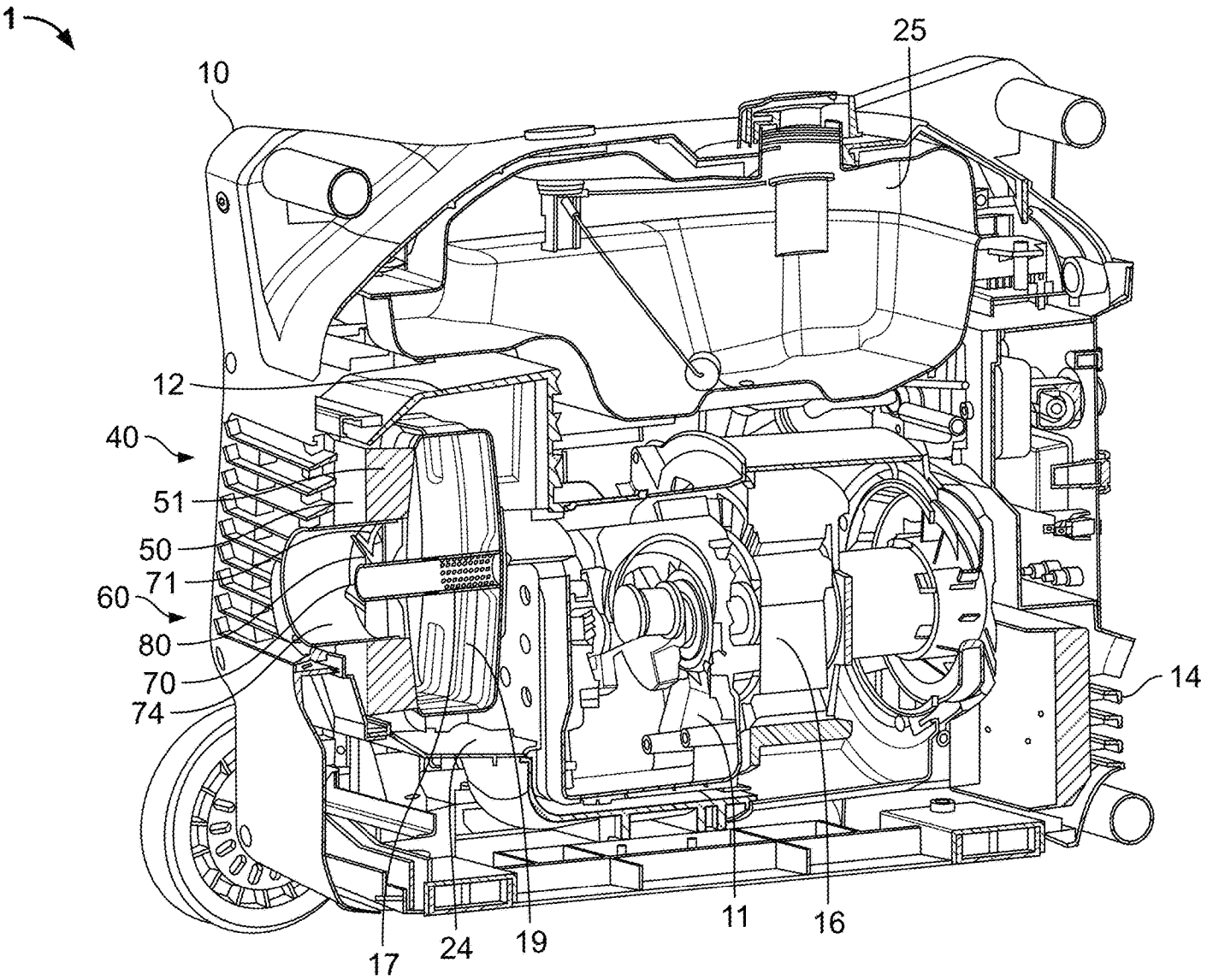
FIG. 1 illustrates a perspective cutaway view of a portable generator including an exhaust cooling system for cooling catalyzed combustion exhaust gases.

The foregoing summary, as well as the following detailed description of certain features of the present application, are better understood when read in conjunction with the appended drawings. For the purposes of illustration, certain features are shown in the drawings. It should be understood, however, that the disclosure are not limited to the arrangements shown in the attached drawings. Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of applications comprising one or more embodiments of the disclosure. As such, the drawings are not meant to include all conventional features known by those of ordinary skill in the art to be required for the practice of the embodiments disclosed herein.

DETAILED DESCRIPTION

The present disclosure provides exemplary embodiments of a system and method for cooling exhaust air of hydrocarbon fueled internal combustion engines having a short length exhaust system used in small power equipment and power tools. Specifically, the cooling systems described herein provide a solution for cooling catalyzed combustion exhaust gases resulting from the chemical reactions that take place within a catalytic converter to remove harmful byproducts resulting from the combustion. Fundamentally, the systems described in the present disclosure are gas-gas mixers, which combine catalyzed combustion exhaust gases with cooling air to lower peak temperatures of the combined exhaust gases. It is understood that the term cooling air can include ambient air, engine cooling air, and/or or forced cooling air.

Specifically, the systems described herein utilize the principles of adiabatic mixing-when two gases with initial temperatures are brought in contact with each other, the peak temperature of the combined gas will be lowered, and the overall temperature will begin to equalize. Eventually, the temperatures of the two gases reach thermodynamic equilibrium and are completely equalized, establishing a final mixing temperature. The systems discussed in the present disclosure seek to effectively mix catalyzed combustion exhaust gases with cooling air (e.g., ambient air, engine cooling air, or forced cooling air), such that the temperature of combined gases is as close as possible to a final mixing temperature (i.e., also having a significantly reduced peak temperature) prior to being released into the atmosphere. In a preferred application, the temperatures of the combined exhaust gas exiting the equipment or tool would be similar to non-catalyzed combustion exhaust gas: between 400° F. and 600° F.

The figures and corresponding description below are an exemplary configuration of the system on a closed-frame portable generator 10. It is however understood that the present disclosure can apply to any small power equipment or power tool powered by a hydrocarbon fueled internal combustion engine. The fundamental components of an exhaust cooling system 1 include a cooling assembly 40 attached to a short length exhaust 24. The cooling assembly 40 includes a mixing chamber 60 and an air guide 50. The mixing chamber 60 generally includes an intake end 72, an exhaust end 73, and at least one cooling inlet. The air guide 50 directs cooling air (which can include ambient air, engine cooling air, or forced cooling air) through the cooling inlet into the mixing chamber 60, which mixes the cooling air with the catalyzed combustion exhaust gas to facilitate adiabatic mixing of the two gases. It is understood that the air guide 50 could include any number of air guide panels 51, channels, and/or ducts to direct cooling air into the mixing chamber 60. It is further understood that the term air guide could mean that the mixing chamber 60 is exposed to the ambient atmosphere such that ambient air may be introduced into the mixing chamber 60.

FIG. 1 shows a small power equipment tool powered by an internal combustion engine 11. Specifically shown is a closed frame portable generator 10. The generator uses hydrocarbon fuel (i.e., gasoline) stored in the fuel tank 25 to create electricity by running an internal combustion engine 11 spinning an alternator 16. As shown, the generator 10 includes an air inlet 14 and filter (not shown) for pulling cooling air (and air used in the combustion process) into a heat shielding and muffler enclosure 12 enclosure and engine 11. Also shown, and which will be discussed in more detail below, is a system for cooling catalyzed combustion exhaust gases, which includes the heat shielding and a muffler enclosure 12, a muffler 19, and the cooling assembly 40. The cooling assembly 40 may further include an air guide panel 51 and a swirl mixer 70.

Figure 2:
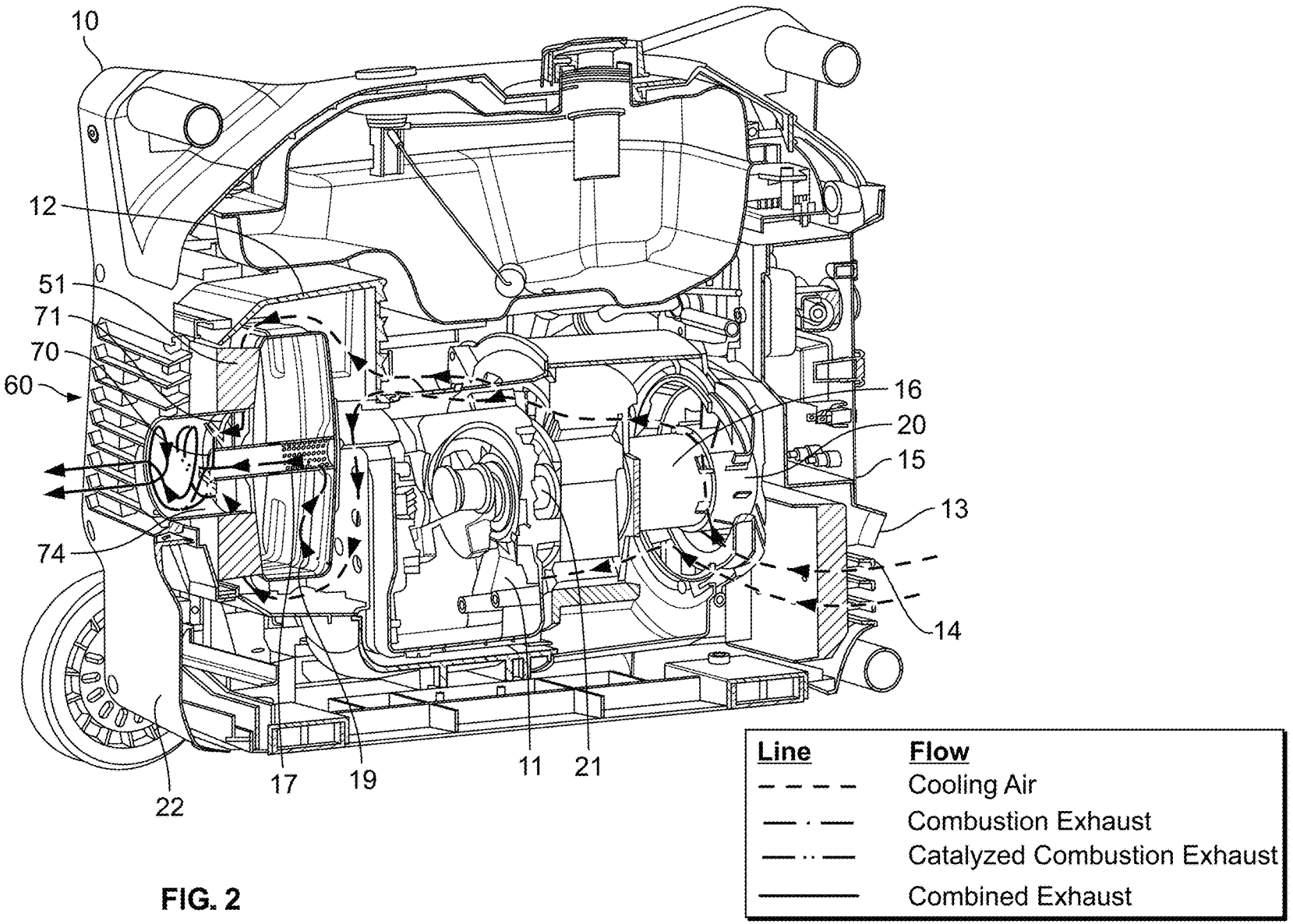
FIG. 2 illustrates a perspective cutaway view of a cooling assembly for a portable generator including a mixing chamber and an air guide panel and depicting a flow diagram showing the path of engine cooling air, catalyzed combustion exhaust gases, and the mixture of the combined exhaust gases.

As illustrated in FIGS. 1 and 2, one configuration of the system includes the mixing chamber 60 comprising the swirl mixer 70, a plurality of radial air inlet ports 71, and a swirl vane assembly 80. As shown, the mixing chamber 60 comprises a round tube 74 positioned around the muffler outlet tube 17. The air guide panel 51 positioned perpendicularly to the axis of the swirl mixer 70 guides at least a portion of the engine cooling air, which passes into the muffler enclosure 12, into the swirl mixer 70. The swirl in the airflow helps facilitate improved mixing of the catalyzed combustion exhaust gas and engine cooling air, thereby reducing the peak temperature of the combined exhaust gases.

Figure 3:
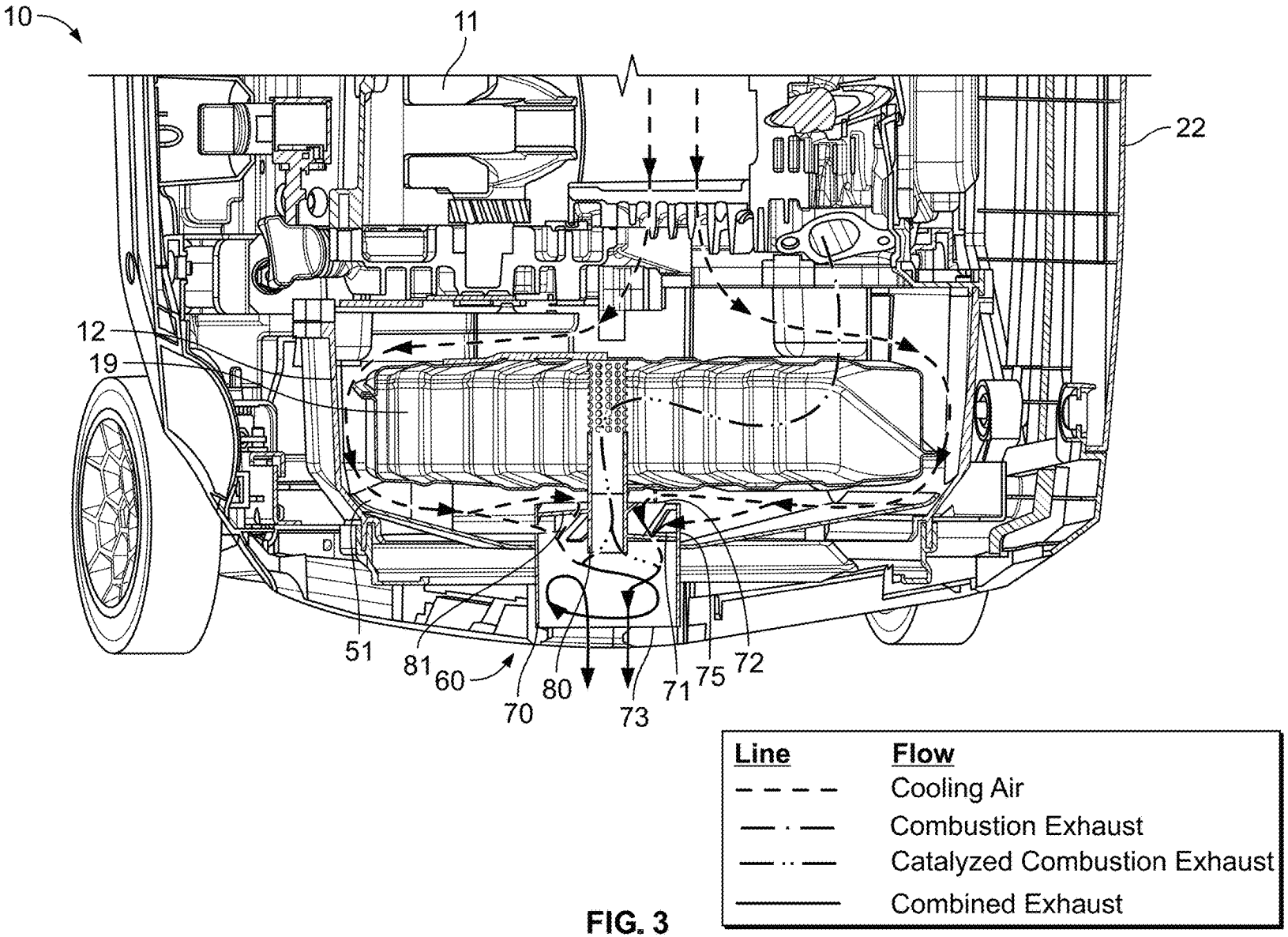
FIG. 3 is a partial cutaway top plan view of a cooling assembly for a portable generator including a mixing chamber and an air guide panel and depicting a flow diagram showing the path of engine cooling air, catalyzed combustion exhaust gases, and the mixture of the combined exhaust gases.

FIGS. 2 and 3 and the corresponding legends show the flow paths of the cooling air (dashed lines), combustion exhaust gas (dot dash line), catalyzed combustion exhaust gases (dot-dot dash lines), and the mixture of the combined exhaust gases (solid lines). Specifically, as shown in the illustrated examples, the internal combustion engine 11 powering the small equipment (in this case, a closed frame portable generator 10) is air cooled and requires a continuous stream of cooling air passing over heat dissipation fins or hot areas of the engine 11 to prevent the engine 11 from overheating. Providing cooling air to an engine 11 can be achieved in two ways: passively and/or forced. Passive cooling can be achieved for example by exposing the engine 11 directly to air or by porting airflow to the engine 11. Forced cooling can be achieved for example by the use of an auxiliary fan or a fan 20 directly attached to a driveshaft 21 of the engine 11, which forces cooling air over the engine 11.

The closed frame portable generator 10 shown in the illustrated embodiment utilizes the fan 20 directly attached to the driveshaft 21 of the engine 11 which pulls cooling air (dashed lines) through the air inlets 14 from an intake side 15 of the engine 11 and into a closed housing 22 of the generator 10. As shown, a portion of the cooling air is directed into an air intake 13 of the engine 11 while the remainder is forced over the engine 11 and alternator 16. The engine cooling air that has been forced over the engine has a higher temperature-approximately 150-200° F. under normal operation—than the ambient air or cooling air, having absorbed some of the heat from the engine 11 and alternator 16.

Figure 4:
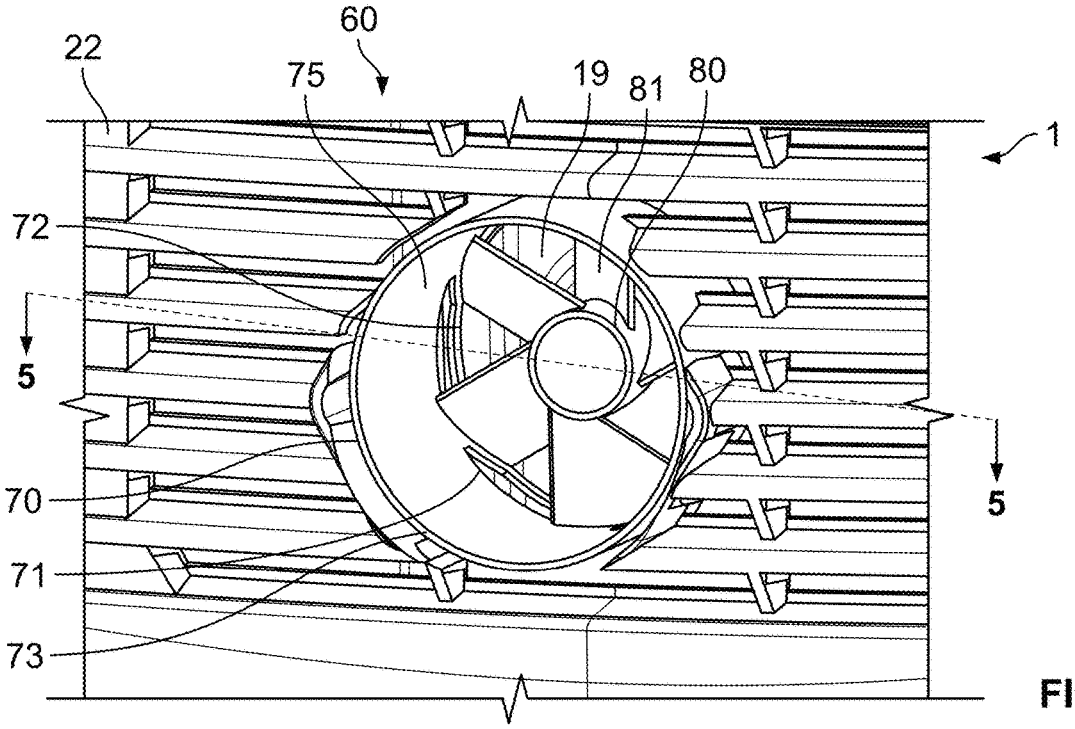
FIG. 4 illustrates a detailed perspective view of a cooling assembly for a portable generator including a mixing chamber and a swirl mixer.
Figure 5:
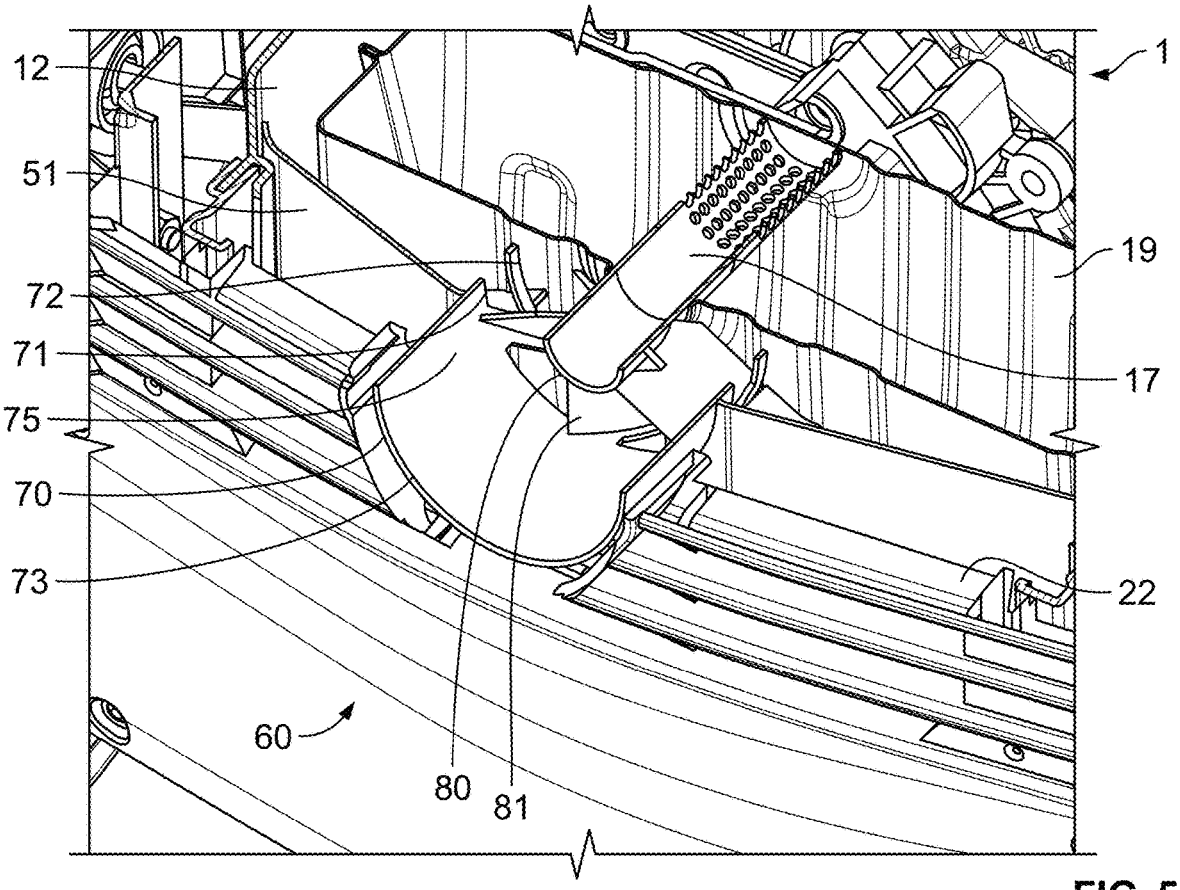
FIG. 5 illustrates a partial cutaway perspective view showing the cooling assembly including the mixing chamber, swirl mixer, and a portion of an air guide panel.

As best seen in FIGS. 3-5, before exiting the closed housing 22, the engine cooling air is guided into the heat shield and muffler enclosure 12, channeled over the muffler 19, and into the swirl mixer 70 via the air guide 50 and specifically, the air guide panel 51. Specifically, as shown, the engine cooling air gases are channeled through the swirl vane assembly 80, specifically, a plurality of swirl vanes 81, and into the mixing chamber 60 either at the intake end 72 of the mixing chamber 60 or through radial air inlet ports 71 that are disposed on walls 75 of the mixing chamber 60, near the intake end 72. The swirl vanes 81 are positioned slightly downstream of the intake end 72 of the mixing chamber 60 and proximate the radial air inlet ports 71. Therefore, the engine cooling air is forced into a vortex as it passes into the mixing chamber 60 prior to exiting at an exhaust end 73 of the mixing chamber 60.

Once the engine cooling air is forced into a swirl by the swirl vanes 81, it mixes with the catalyzed combustion exhaust gases (dot-dot dash lines) in the mixing chamber 60, creating a vortex of combined exhaust gas (solid lines) prior to being released into the atmosphere at the exhaust end 73 of the mixing chamber 60. The mixing of the engine cooling air (having an ambient temperature or approximately 150-200° F. if it has been forced over the engine) with the catalyzed combustion exhaust (approximately 700-1200° F.) causes a significant reduction in the peak temperature of the combined exhaust gas (approximately 400-600° F. but may be higher or lower depending on operating conditions). Because the gases are forced into a vortex, the overall flow length of the combined exhaust gases prior to being released in the atmosphere is lengthened. This increased flow length assists in the adiabatic mixing as there is prolonged contact of the two gases prior to exiting the system. It is noted that the flow diagrams shown in FIGS. 2 and 3 depict an exemplary embodiment and should not be viewed as limiting the disclosure. Alternative embodiments are discussed below.

FIGS. 4-5 show detailed views of one embodiment of the mixing chamber 60 and swirl mixer 70 affixed to the portable generator 10. As shown, the swirl mixer 70 is positioned adjacent the muffler 19 and surrounds the muffler outlet tube 17. The housing 22 of the generator 10 (or other equipment) is designed to surround the mixing chamber 60 such that the risk of accidental contact with the mixing chamber 60 is reduced. The housing 22 additionally prevents accidental contact with the air guide panel 51 and muffler 19. FIG. 5 illustrates a partial cutaway perspective view of the configuration depicted in FIG. 4 showing the swirl mixer 70 and a portion of air guide panel 51 positioned between the muffler 19 and housing 22. In an alternative embodiment, the swirl mixer 70 is integrated into the housing 22 of the equipment. Such an embodiment provides a cost-effective way to achieve a vortex of combined exhaust gases without the need for additional components.

Figure 6:
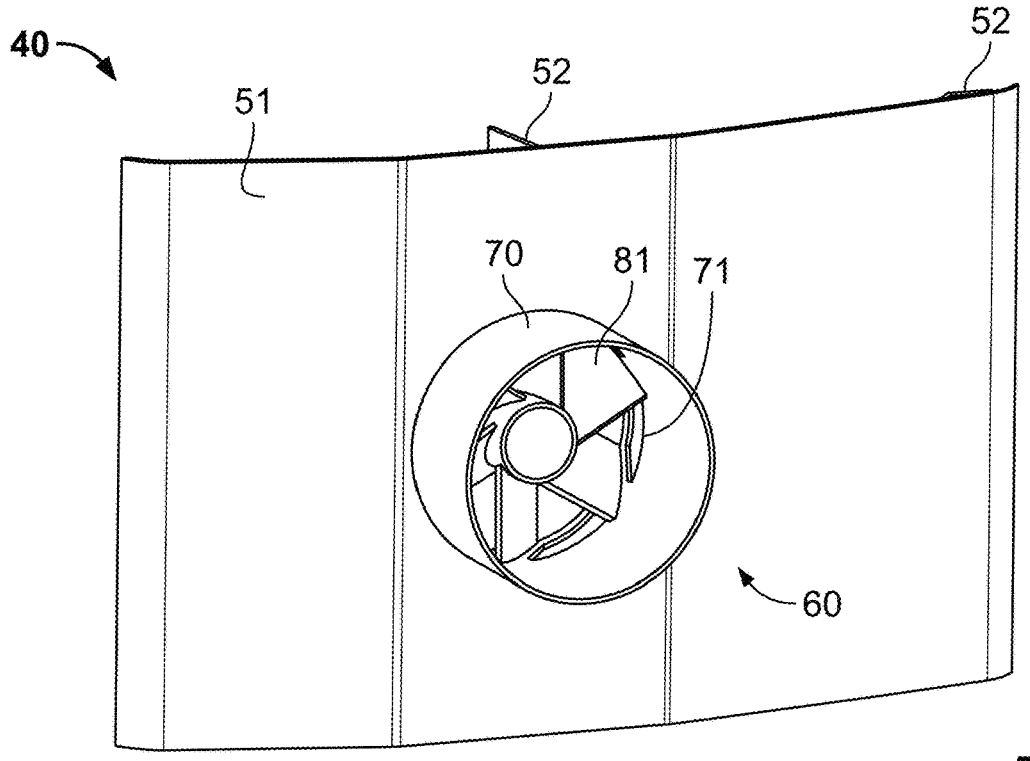
FIG. 6 illustrates a front perspective view of a cooling assembly for a portable generator including a mixing chamber, a swirl mixer, and an air guide panel.
Figure 7:
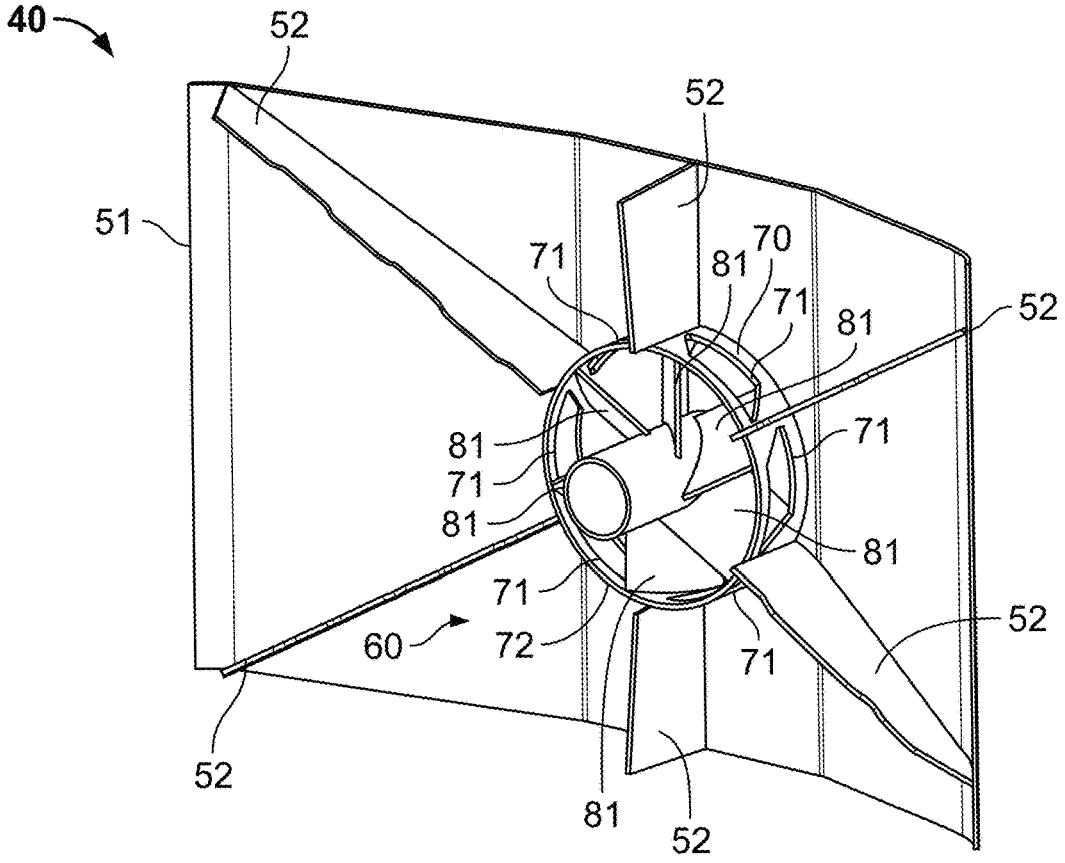
FIG. 7 illustrates a rear perspective view thereof.
Figure 8:
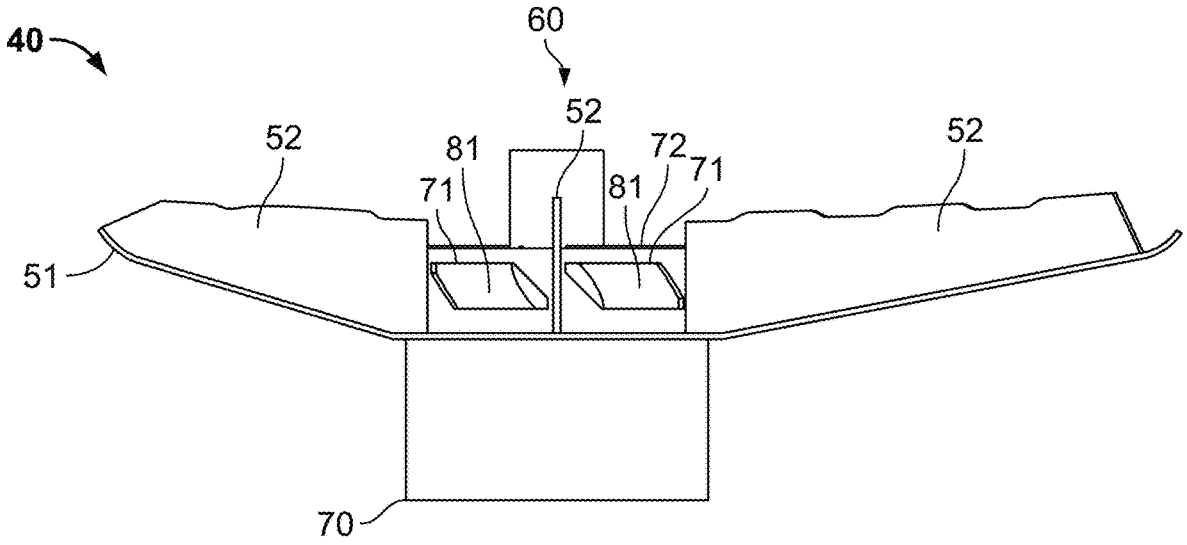
FIG. 8 illustrates a top plan view thereof.

FIGS. 6-8 show detailed views of one embodiment of the cooling assembly 40 including the mixing chamber 60, swirl mixer 70 and air guide panel 51. As shown in the illustrated embodiment in FIG. 7, the air guide panel 51 includes six radial ribs 52, which direct engine cooling air to corresponding six radial air inlet ports 71 positioned proximate the intake end 72 of the mixing chamber 60. Likewise, six swirl vanes 81 force the engine cooling air passing into the mixing chamber 60 into a swirl. It is understood that the illustrated embodiment is representative and that more or less radial ribs 52, inlet ports 71, and swirl vanes 81 could be used.

Figure 9:
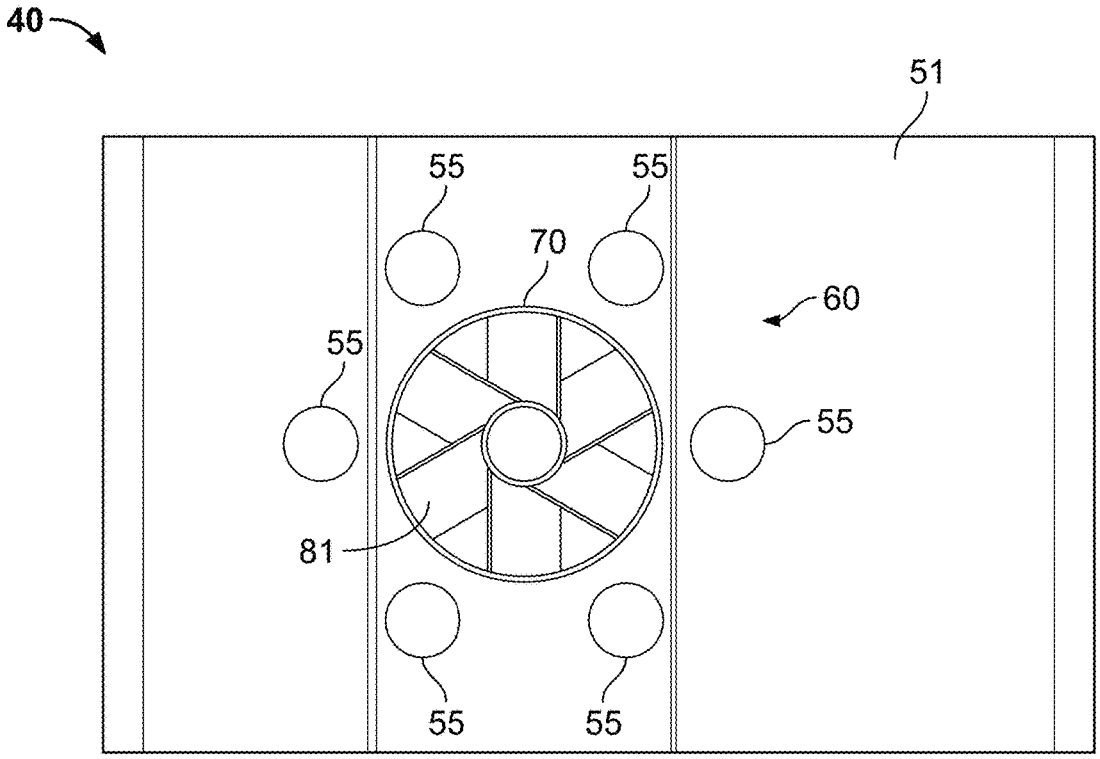
FIG. 9 illustrates a front elevation view of an alternative configuration of an exhaust cooling assembly including a plurality bypass holes permitting some of the engine exhaust air to escape, such that only a portion of the engine cooling air is channeled into a swirl mixer.
Figure 10:
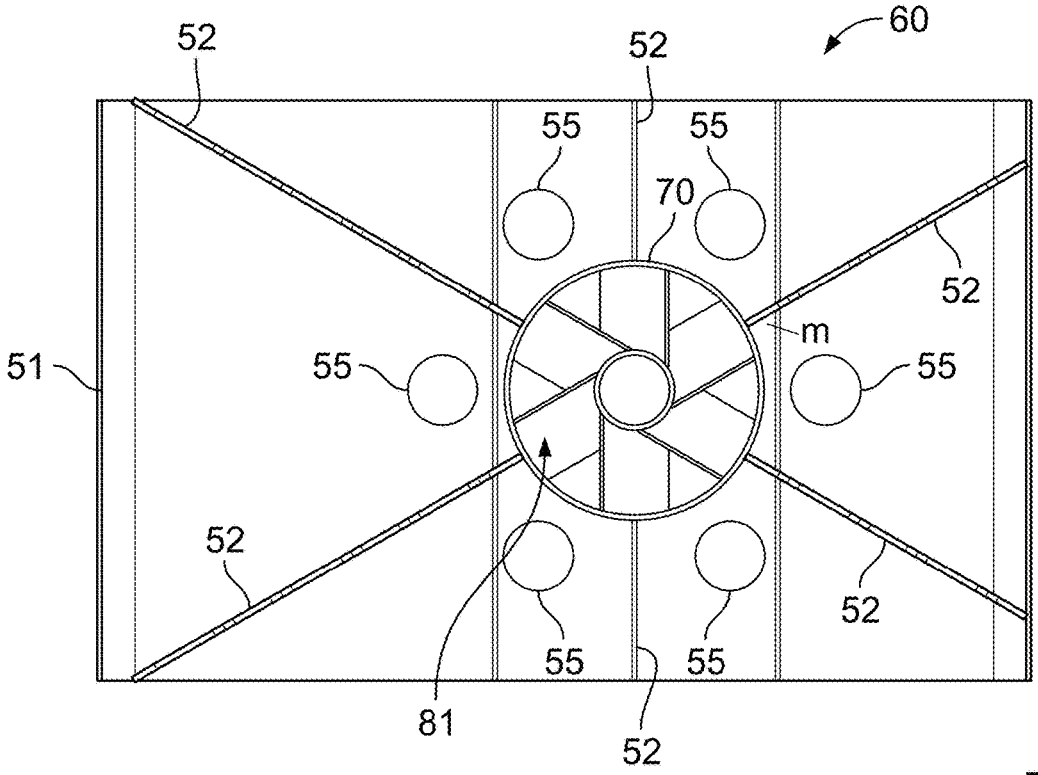
FIG. 10 illustrates a rear perspective view thereof.
Figure 11:
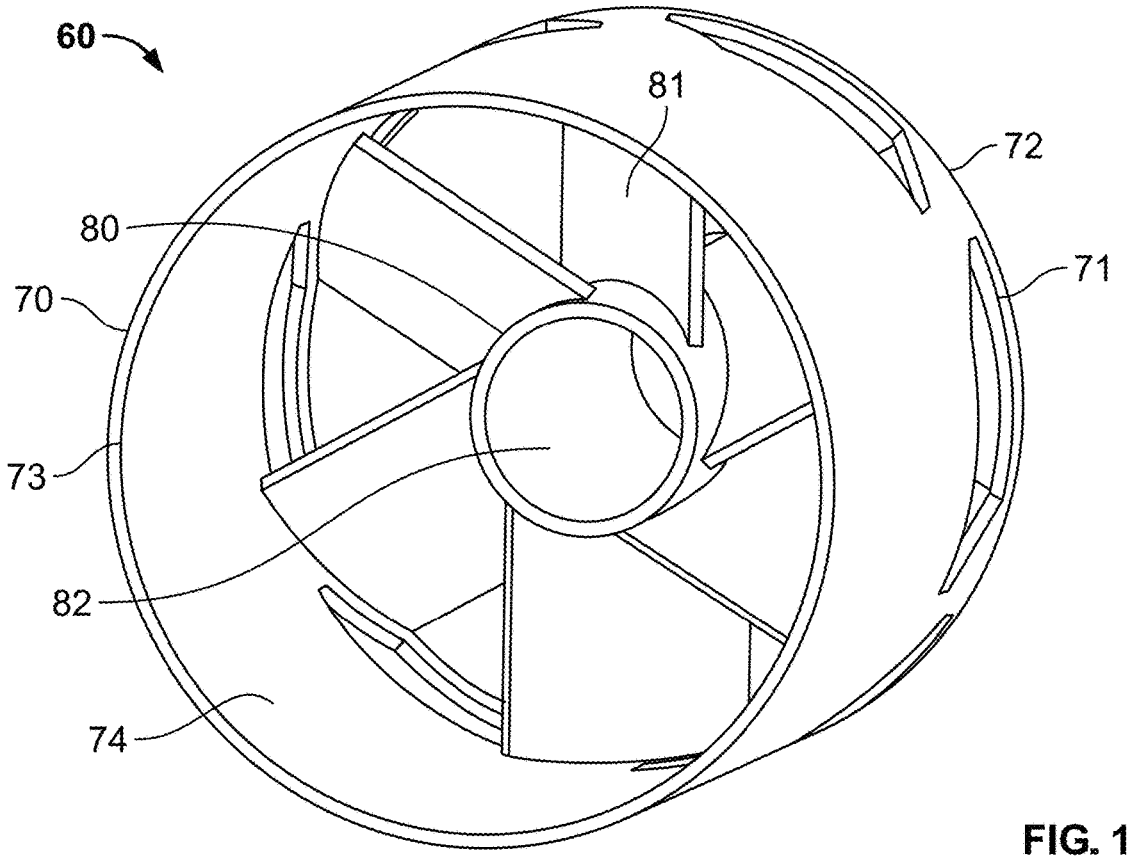
FIG. 11 illustrates a front perspective view of a swirl mixer.
Figure 12:
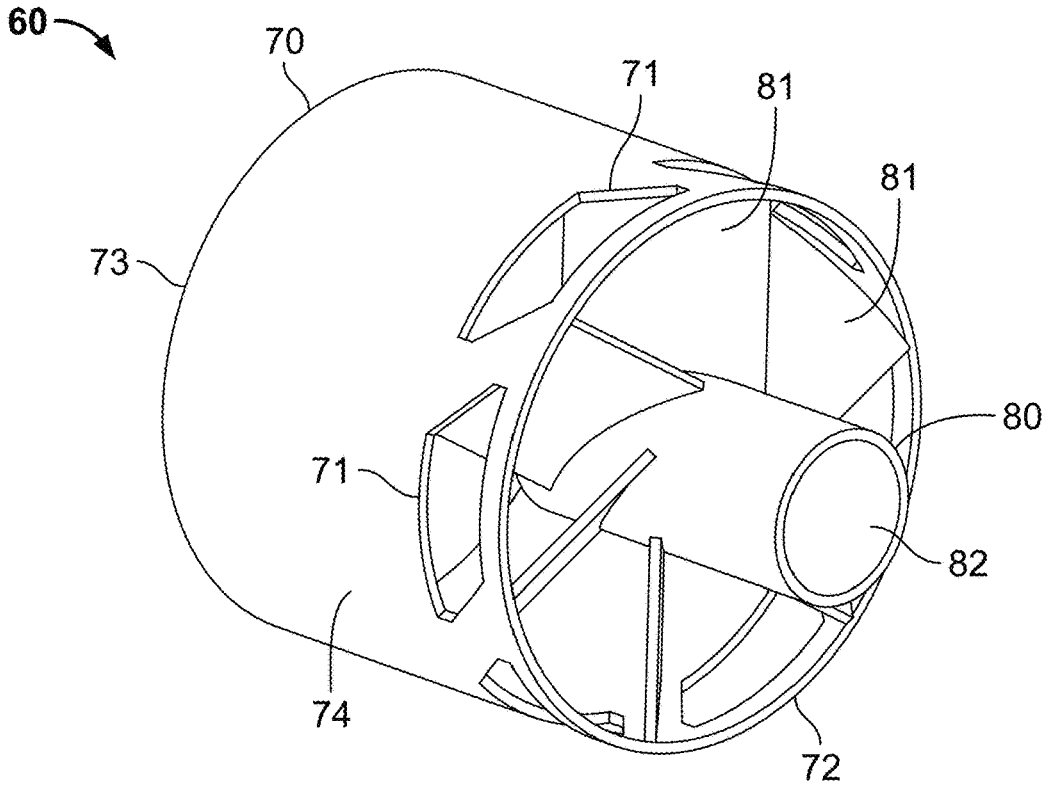
FIG. 12 illustrates a rear perspective view thereof.
Figure 13:
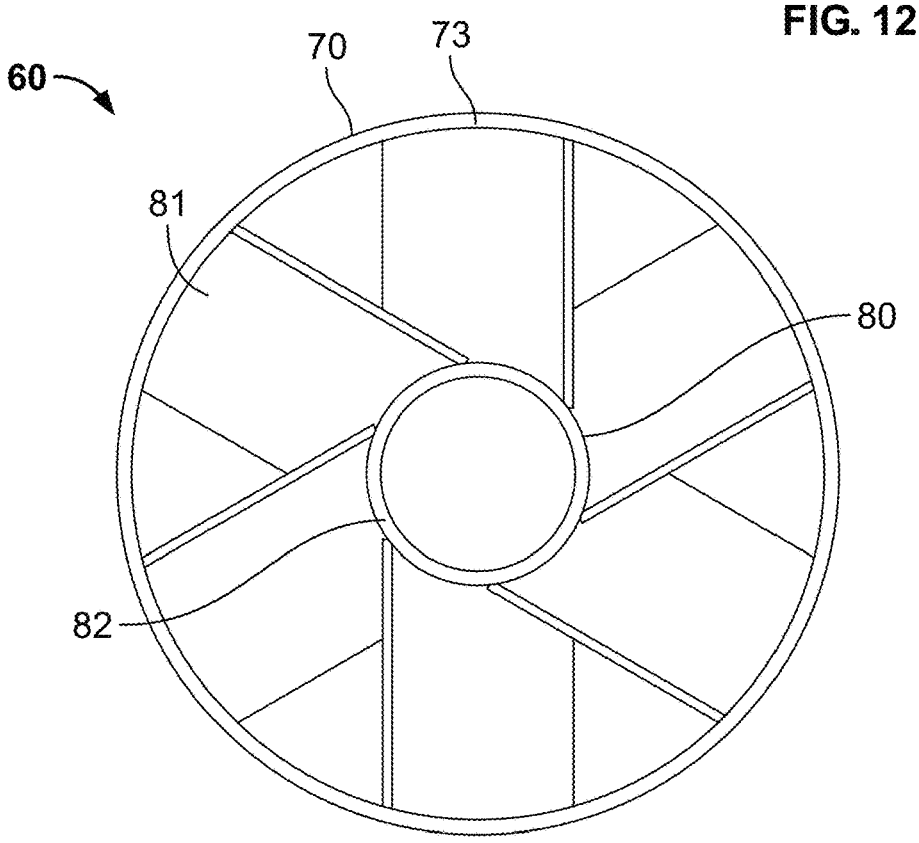
FIG. 13 illustrates a front elevation view thereof.
Figure 14:
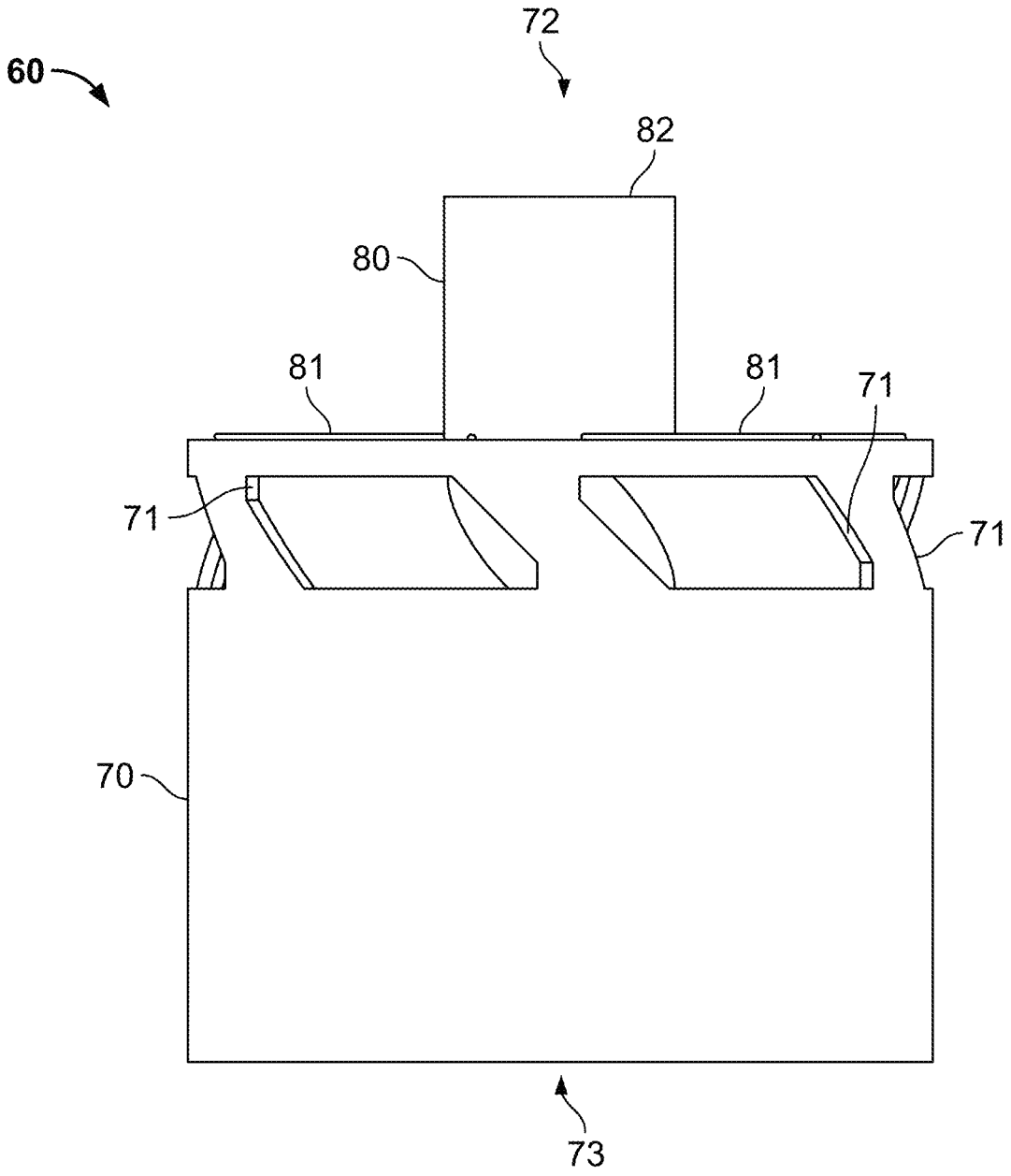
FIG. 14 illustrates a top plan view thereof.
Figure 15:
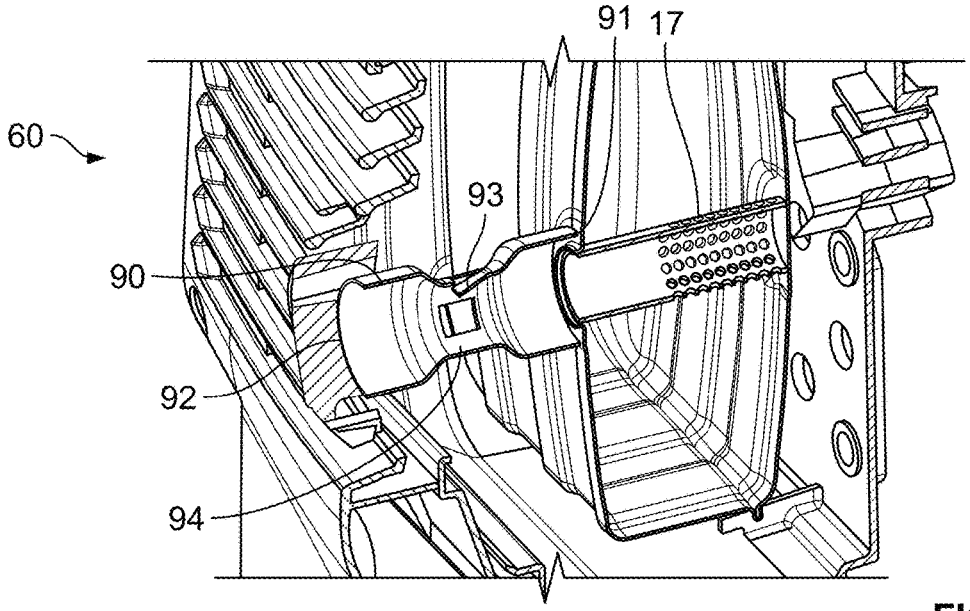
FIG. 15 illustrates a partial cutaway perspective view of an alternative configuration of a mixing chamber including a muffler outlet having a venturi section and suction ports for pulling cooling air into the exhaust gas stream.

FIGS. 9 and 10 show an alternative configuration of cooling assembly 40, including a plurality of bypass holes 55 in the muffler heat shield and enclosure 12. Specifically, as illustrated, the air guide panel 51 includes the plurality of bypass holes 55 which allow some of the engine cooling air to exit the muffler enclosure 12 prior to passing through the mixing chamber 60 and swirl mixer 70 and being mixed with the catalyzed combustion exhaust gases. Such a configuration may be advantageous to control the volume of flow of the engine cooling air into the swirl mixer 70 to ensure optimal adiabatic mixing of the gases in the swirl mixer 70.

FIGS. 11-14 show detailed views of one embodiment of the mixing chamber 60 and the swirl mixer 70 including the swirl vane assembly 80. The swirl mixer 70 comprises a round, hollow tube 74 and includes the intake end 72 and the exhaust end 73. Positioned proximate the intake end 72 are the plurality of radial air inlet ports 71 which port engine cooling air into the mixing chamber 60. It is understood that the size, shape, length, and diameter of the mixing chamber 60 may vary depending on application. Thus, the proportions depicted in the figures should not be limiting as the present disclosure contemplates any sized mixing chamber 60 sufficient to creating a vortex of combined exhaust gas thereby effectively lowering the peak temperature of the mixed gases. Additionally, the present disclosure should not be limited to the specific shape and size of radial air inlet ports 71 depicted in the figures. The shape and size of the radial air inlet ports 71 may vary depending on application and required airflow. Finally, the present disclosure contemplates alternative embodiments of a mixing chamber 60 not including any inlet ports (not shown). In such an embodiment, all of the engine cooling air enters the mixing chamber 60 via the intake end 72 of the mixing chamber 60.

FIGS. 11-14 also show detailed views of one embodiment of the swirl vane assembly 80. In the illustrated embodiment the swirl mixer 70 comprises the plurality of swirl vanes 81 positioned around a cylindrical sleeve 82. The sleeve 82 sheaths the muffler outlet tube 17 (see FIGS. 4 and 5). It is understood that any shape or size of swirl vanes 81 may be used which effectively force the engine cooling air into a swirl. The present disclosure also contemplates alternative arrangements of swirl vanes 81. For example, both clockwise and counterclockwise swirl vanes 81 are contemplated. Additionally, the present disclosure contemplates different ways to mount the swirl vanes as discussed in more detail below.

FIGS. 15-18 show alternative configurations of the system that includes the mixing chamber 60 comprising a venturi section 90 positioned downstream of the muffler outlet tube 17. The venturi section 90 includes an inlet 91, an outlet 92, and one or more suction ports 93 positioned in a reduced diameter section 94. The venturi section 90 effectively sucks in engine cooling gas exhaust via the principle of differential pressure. Specifically, the hourglass shape of the venturi section 90 creates a pressure drop in the flow of the combustion exhaust gases. In other words, combustion exhaust gas entering the venturi section 90 has a higher pressure than when it exits. This pressure differential creates a vacuum at the suction port 93 positioned at the reduced diameter section 94, which pulls into the suction port 93 the engine cooling air.

Figure 16:
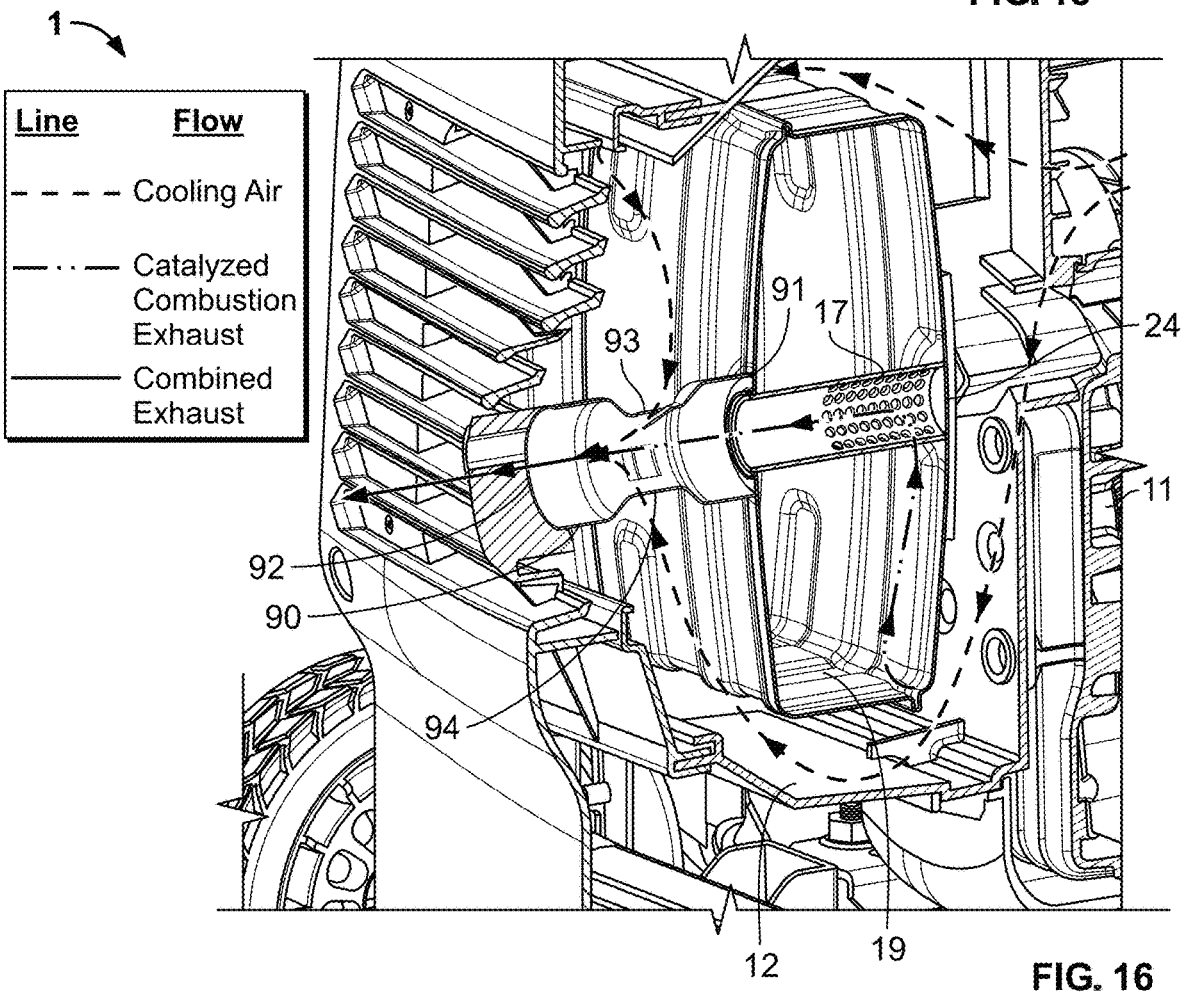
FIG. 16 is a flow diagram of the configuration shown in FIG. 15 showing the path of engine cooling air, catalyzed combustion exhaust gases, and the mixture of the combined exhaust gases.
Figure 17:
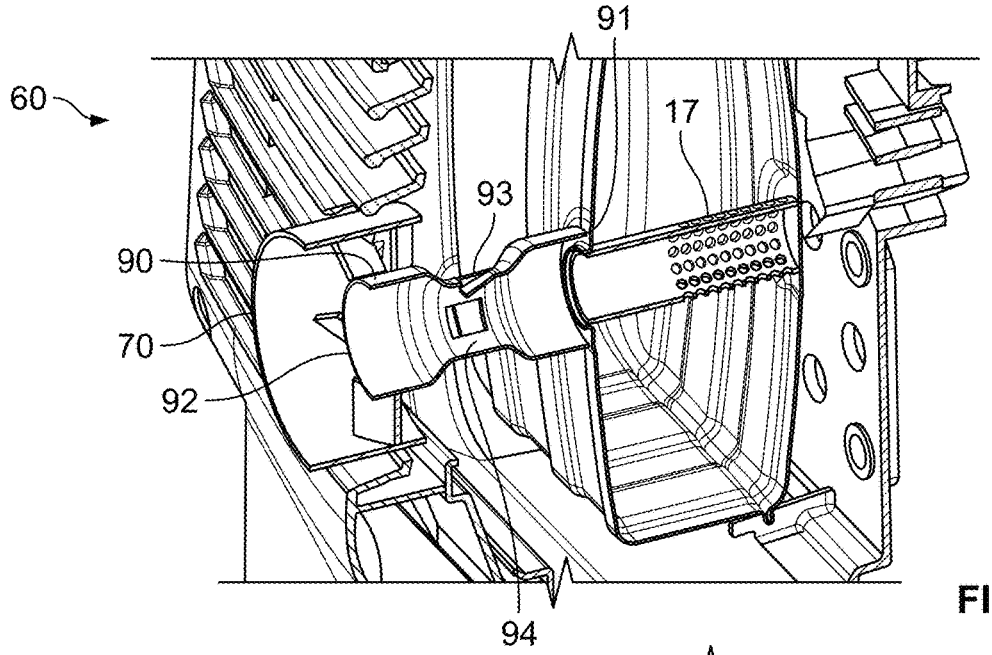
FIG. 17 illustrates a partial cutaway perspective view of an alternative configuration of a mixing chamber including a muffler outlet having a venturi section and suction ports for pulling cooling air into the exhaust gas stream and further including a swirl mixer.
Figure 18:
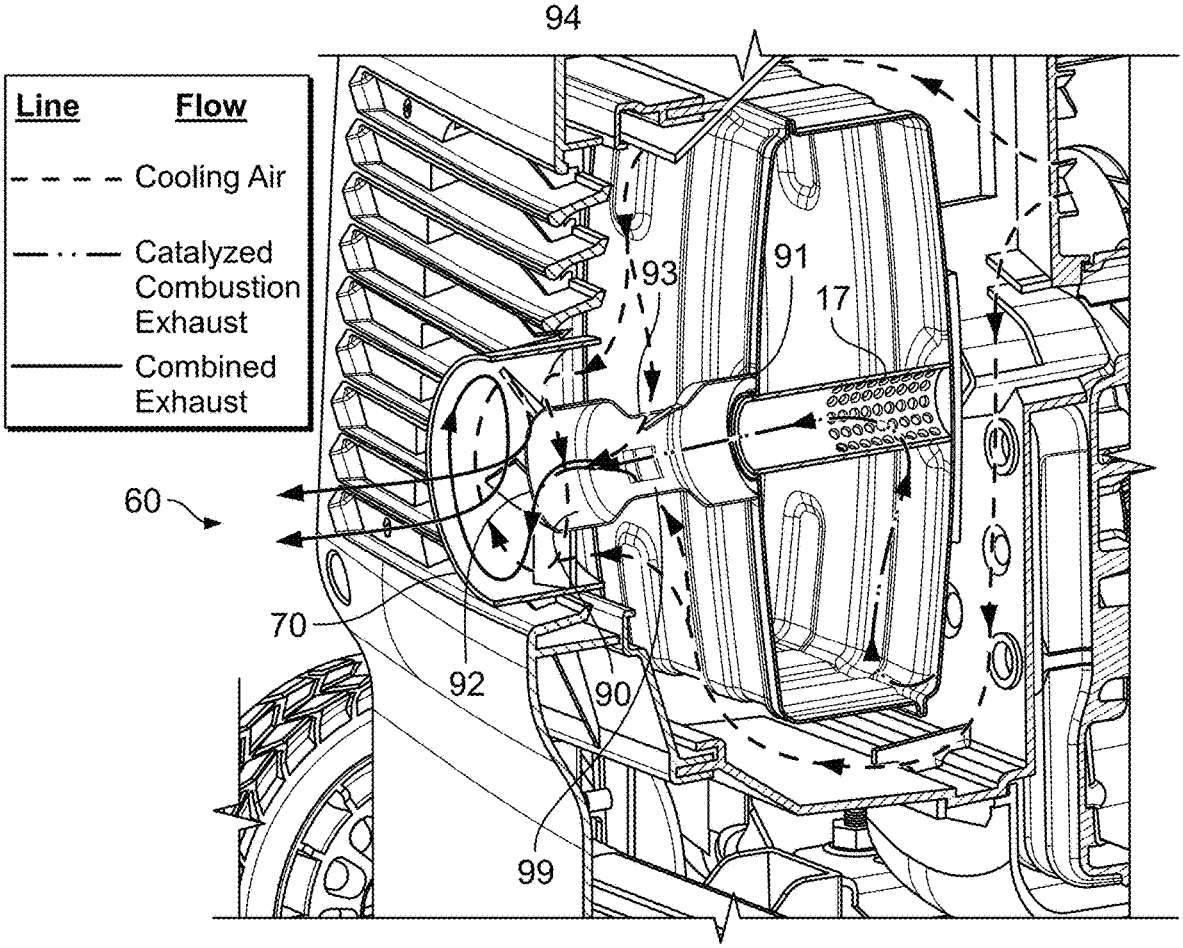
FIG. 18 is a flow diagram of the configuration shown in FIG. 17 showing the path of engine cooling air, catalyzed combustion exhaust gases, and the mixture of the combined exhaust gases.

FIG. 16, for example, shows the venturi principle in operation as applied to the exhaust cooling system 1 for small power equipment or power tool powered by the internal combustion engine 11 having the short length exhaust 24. Engine cooling air (dashed lines) is channeled into the muffler enclosure 12 and flows over and under the muffler 19. The catalyzed combustion exhaust (dot-dot dash lines) passing through the venturi section 90 creates a vacuum and sucks the engine cooling air into the suction ports 93 of the venturi section 90, after which it mixes with catalyzed combustion exhaust to reduce the peak temperature of the combined exhaust gases (solid lines). Optionally, as shown in FIGS. 17 and 18, the mixing chamber 60 may be comprised of the venturi section 90 joined with the swirl mixer 70. The addition of the swirl mixer 70 and resulting vortex may assist in the mixing of the engine cooling air and the catalyzed combustion exhaust to more efficiently lower the peak temperature of the combined exhaust gas as described in more detail above.

Figure 19:
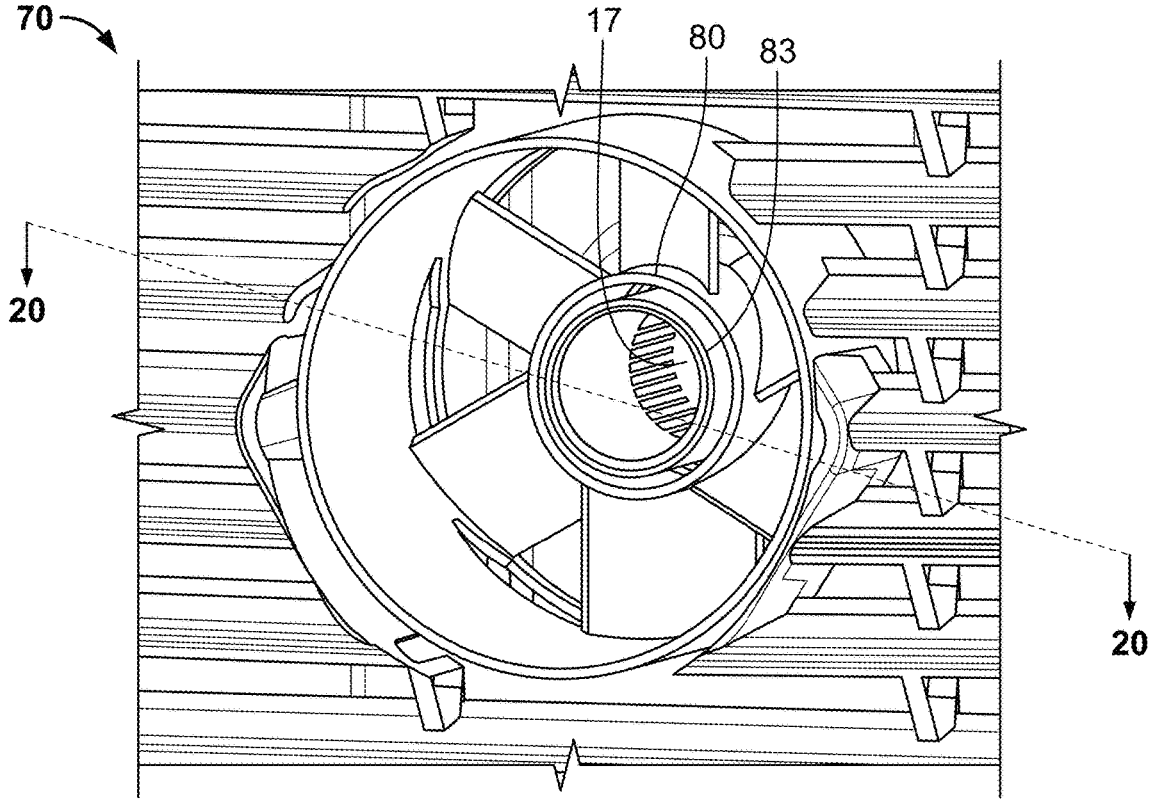
FIG. 19 illustrates a detailed perspective view of an alternative configuration of a mixing chamber and swirl mixer including a concentric air gap between a muffler outlet tube and a swirl vane assembly.
Figure 20:
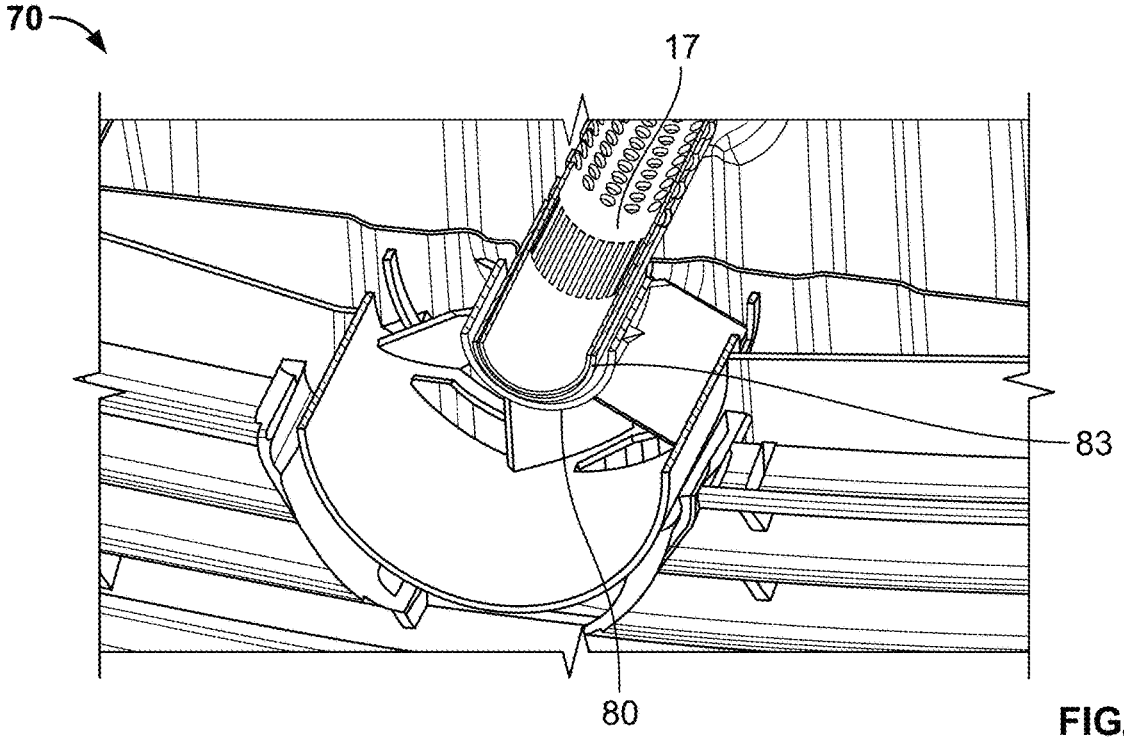
FIG. 20 illustrates a partial cutaway perspective view of the configuration shown in FIG. 19.

FIGS. 19 and 20 depict an alternative configuration of the swirl mixer 70. In this configuration, the swirl vane assembly 80 includes an inner sleeve 83 having an inner diameter that is wider than the outer diameter of the muffler outlet tube 17. As a result, there is a concentric air gap between the muffler outlet tube 17 and sleeve 83 allowing for some co-axial airflow of engine cooling air into the mixing chamber 60. This co-axial airflow may assist in facilitating the mixing of the catalyzed combustion exhaust gases with the engine cooling air. Additionally, such a configuration may be advantageous to insulate the swirl vane assembly 80 from absorbing heat from the muffler outlet tube 17. It may be advantageous to prevent conductive heat soak of the swirl vane assembly 80 to ensure that the temperature of the engine cooling air is as low as possible prior to entering the mixing chamber 60. It is understood that the present disclosure is not limited to the exact size gap depicted and that the gap can be wider or narrower depending on application.

Figure 21:
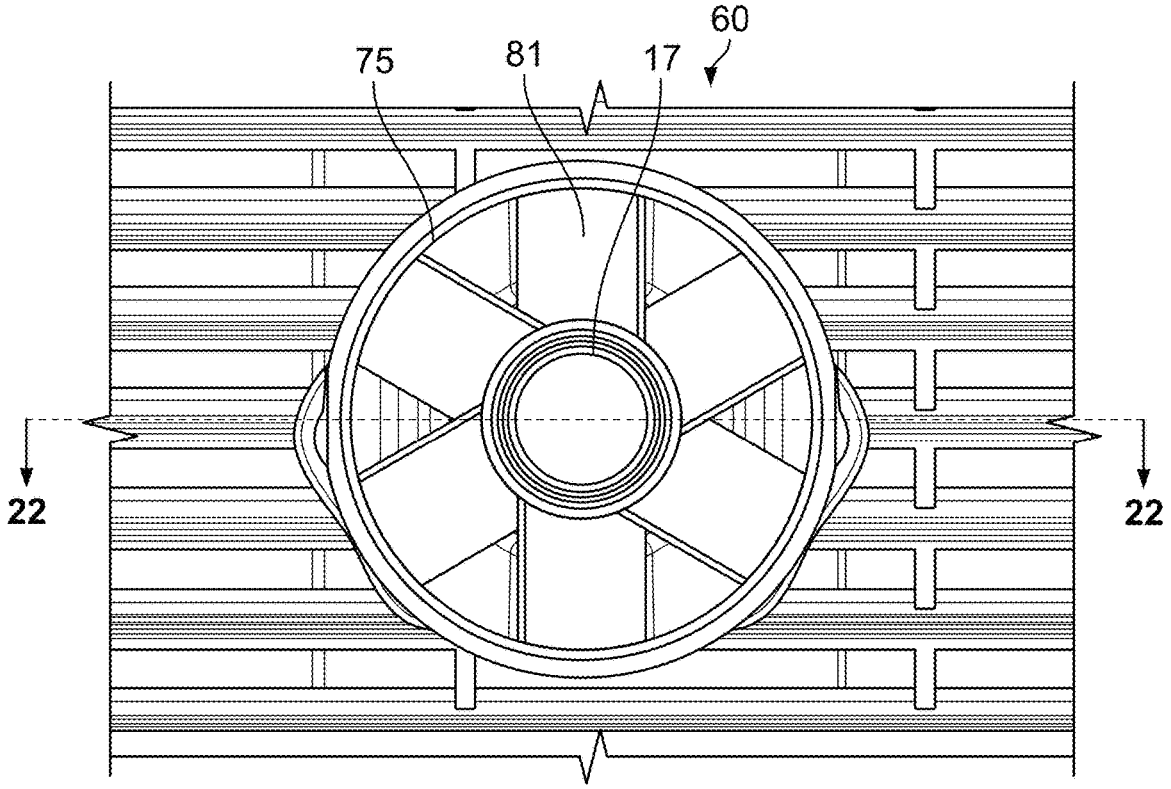
FIG. 21 illustrates a front elevation view of an alternative configuration of a mixing chamber and swirl mixer including an air gap between a muffler outlet tube and a plurality of swirl vanes of the swirl vane assembly attached directly to the mixing chamber.
Figure 22:
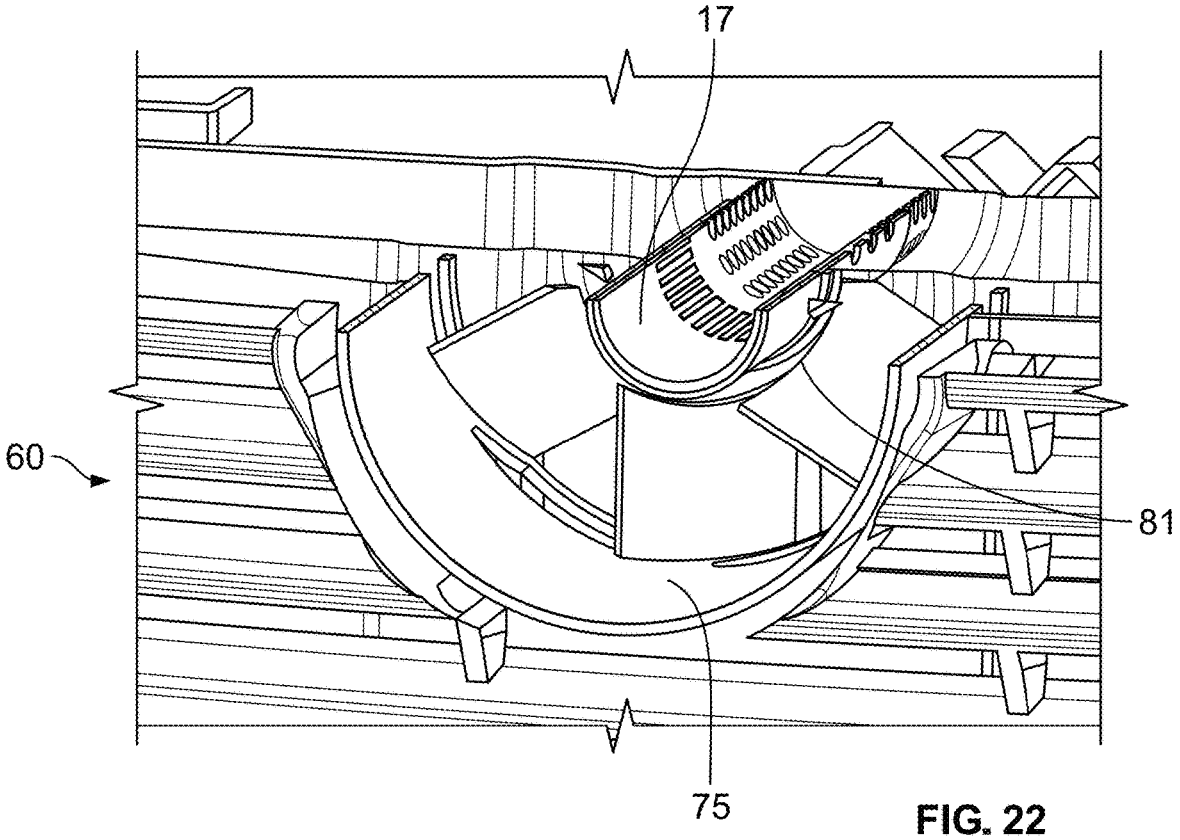
FIG. 22 illustrates a partial cutaway perspective view of the configuration shown in FIG. 21.

FIGS. 21 and 22 depict another alternative configuration of the swirl mixer 70. In this configuration, the swirl vanes 81 are affixed directly to the wall 75 of the mixing chamber 60. As illustrated the swirl vanes 81 do not extend all the way to the muffler outlet tube 17 allowing for some concentric air flow and reducing heat soak of the swirl vanes 81. It is understood that the swirl vanes 81 may be positioned further or closer to the muffler outlet tube 17 depending on application.

Figure 23:
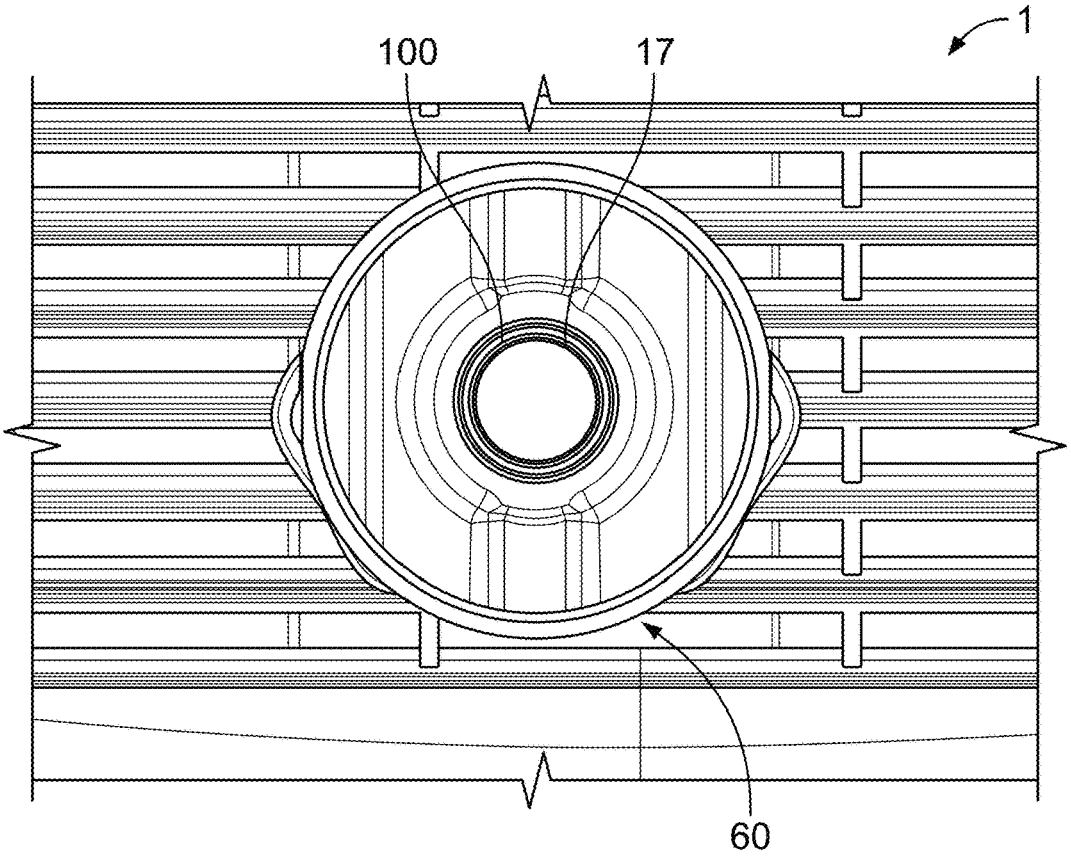
FIG. 23 illustrates a front elevation view of an alternative configuration of a concentric flow mixing chamber omitting a swirl vane assembly.
Figure 24:
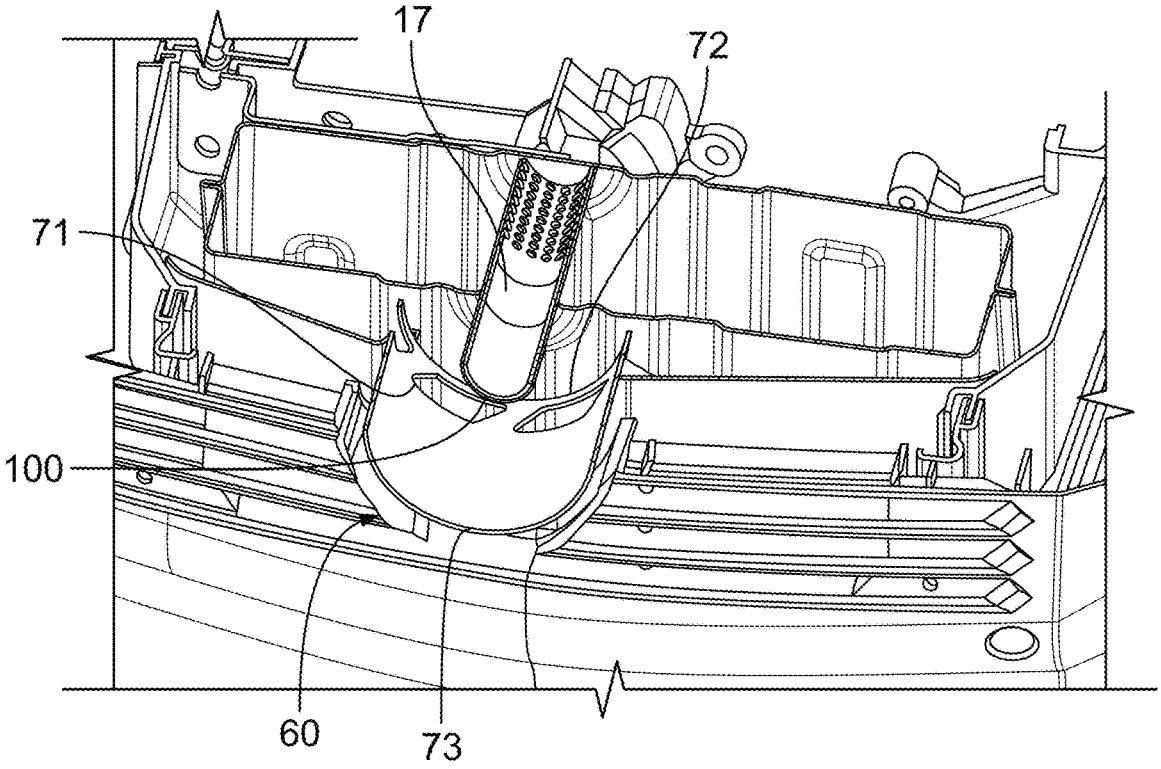
FIG. 24 illustrates a partial cutaway perspective view of the configuration shown in FIG. 23.

FIGS. 23 and 24 depict another alternative configuration of the exhaust gas cooling system 1 utilizing a radial feed path 100 of the engine cooling air. As shown, the system includes the mixing chamber 60 including radial air inlet ports 71 positioned proximate the intake end 72 of the mixing chamber 60. The muffler outlet tube 17 is positioned concentrically within the mixing chamber 60. As engine cooling air passes into the mixing chamber 60 via the radial air inlet ports 71 it is induced into a radial path and mixes with the catalyzed combustion exhaust gases prior to exiting at the exhaust end 73 of the mixing chamber and being released into the atmosphere.

Figure 25:
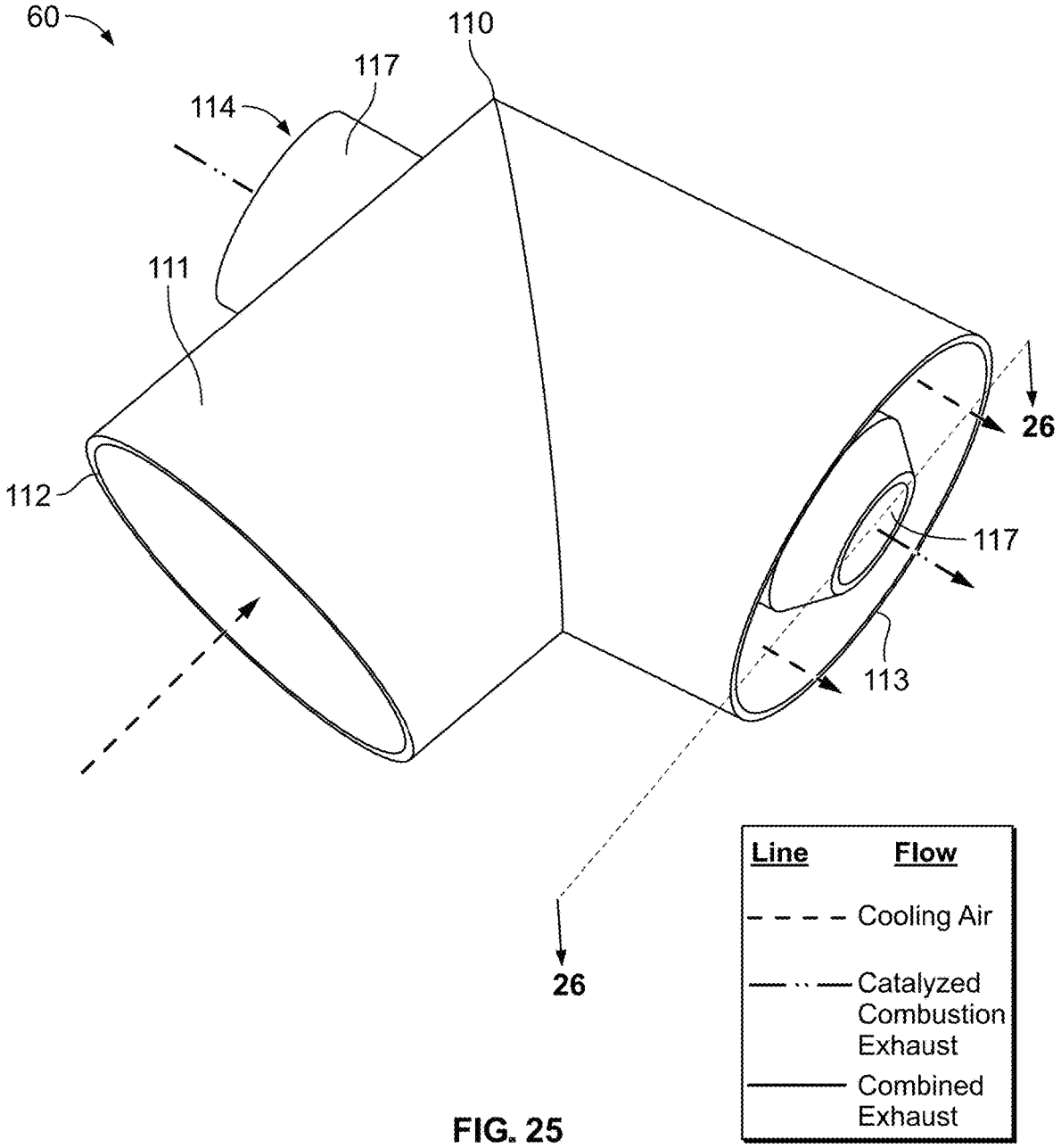
FIG. 25 illustrates a perspective view of an example coaxial mixer.
Figure 26:
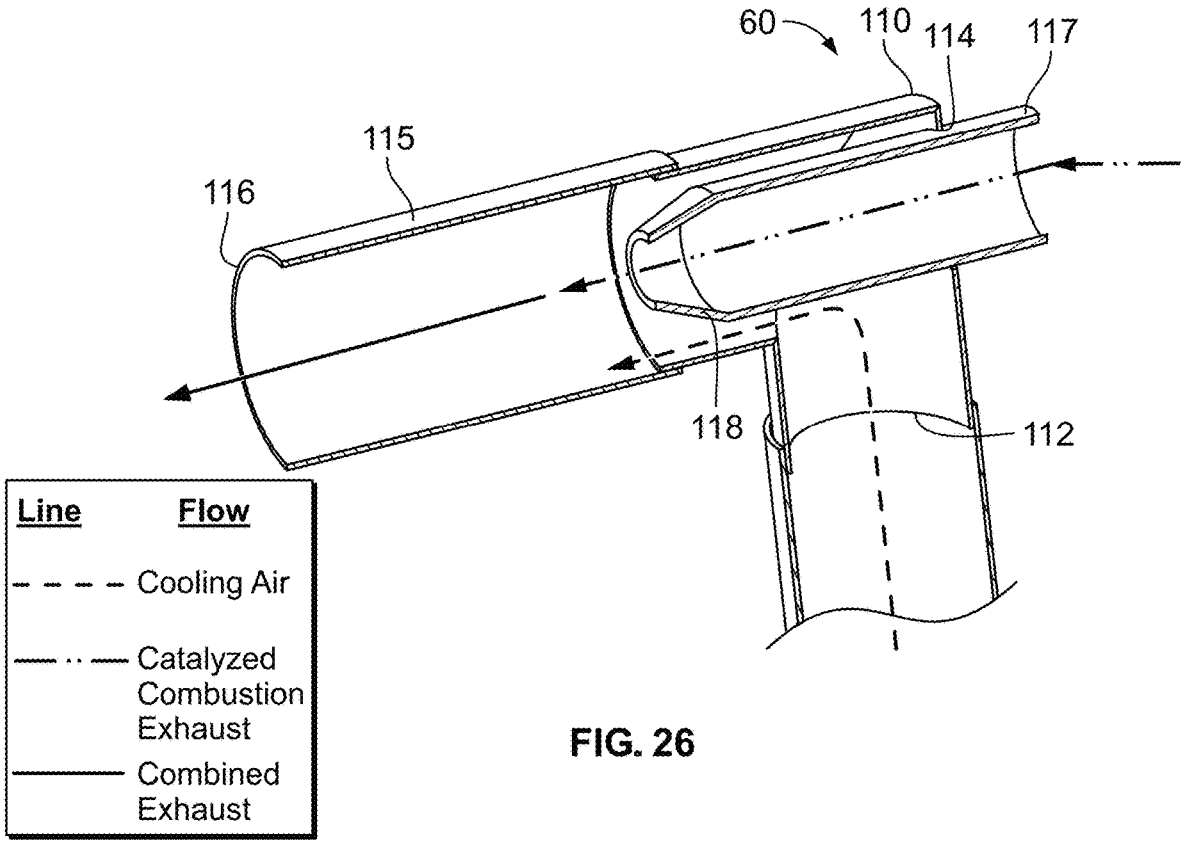
FIG. 26 illustrates a perspective view of an alternative configuration of an exhaust cooling system for use with an internal combustion engines powering small power equipment and power tools including a coaxial mixer and mixing chamber.
Figure 27:
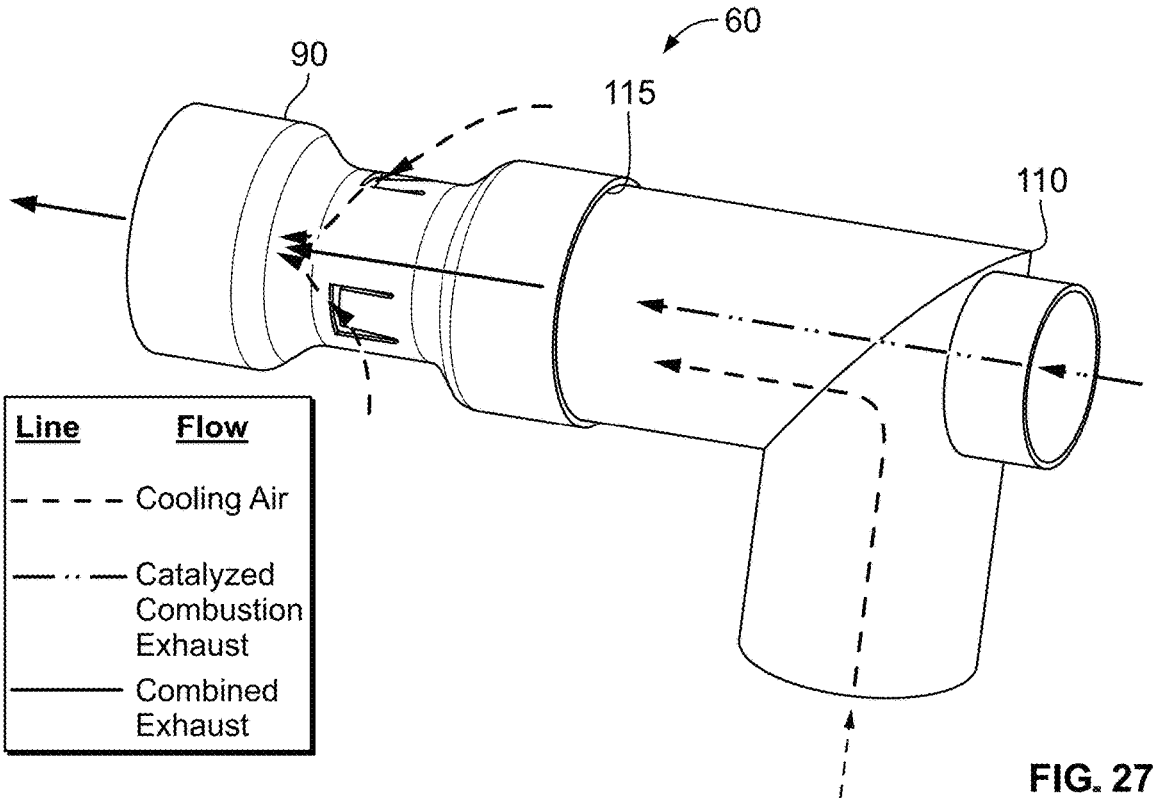
FIG. 27 illustrates a perspective view of an alternative configuration of an exhaust cooling system for use with internal combustion engines powering small power equipment and power tools including a coaxial mixer and venturi section.

FIGS. 25-27 depict another alternative configuration of the exhaust cooling system 1 that includes the mixing chamber 60 comprising a coaxial mixer 110. As illustrated in FIG. 25, the coaxial mixer 110 comprises an L-shaped tube 111, which includes a cooling air inlet 112, an exhaust end 113, and an opening 114 for the muffler outlet tube 17. The muffler outlet tube 17 is inserted into the opening 114 and positioned at least partially within the coaxial mixer 110, such that the flow of the cooling air (dashed lines) and the catalyzed combustion exhaust (dot-dot dash lines) is substantially coaxial at the exhaust end 113. The muffler outlet tube 17 may include a reduced diameter portion 118 as illustrated or have a consistent diameter throughout. It is understood that the present disclosure is not limited to the illustrated embodiment and can include any shape of coaxial mixer 110 that coaxially combines a flow of cooling air with a flow of catalyzed combustion exhaust. It is further understood that the muffler outlet tube 17 is not necessarily required to be positioned concentrically within the opening 114 of the coaxial mixer 110 as shown in the illustrated embodiment. Further, the cooling air can include, but is not limited to, ambient air, ducted cooling air, forced cooling air, passive induction of cooling air, and/or engine cooling air. It is also understood that the illustrated embodiment could be reversed (not shown). For example, the catalyzed combustion exhaust could be directed through the outer tube 111 and the cooling air could be directed through the inner tube 117. Finally, it is understood that the present disclosure contemplates alternative configurations of inlet shapes included for example multiple radial inlets or other coaxial shapes.

FIGS. 26 and 27 depict exemplary ways that the coaxial mixer 110 of FIG. 25 could be integrated into the exhaust cooling system 1. For example, as illustrated in FIG. 26, the catalyzed combustion exhaust (dot-dot dash lines) is directed into the coaxial mixer 110 via the muffler outlet tube 17 (the inner tube 117) and the cooling air (dashed lines) is directed into the coaxial mixer 110 via the cooling air inlet 112 (the outer tube 111). The catalyzed combustion exhaust is coaxially mixed with the cooling air in an extension tube 115 and the combined mixture of the gases (solid line) exit the coaxial mixer 110 at an exhaust outlet 116.

The present disclosure contemplates that the coaxial mixer 110 configuration of FIG. 25 could be combined with any of the other configurations of a mixer described in the present disclosure. For example, as shown in FIG. 27, the venturi section 90 could be integrated into the mixing chamber 60. In such a configuration, the venturi section 90 sucks in and mixes additional cooling air with the mixture of catalyzed combustion exhaust and cooling air to further reduce the peak temperature of the mixed gases at the exhaust outlet 116.

Figure 28:
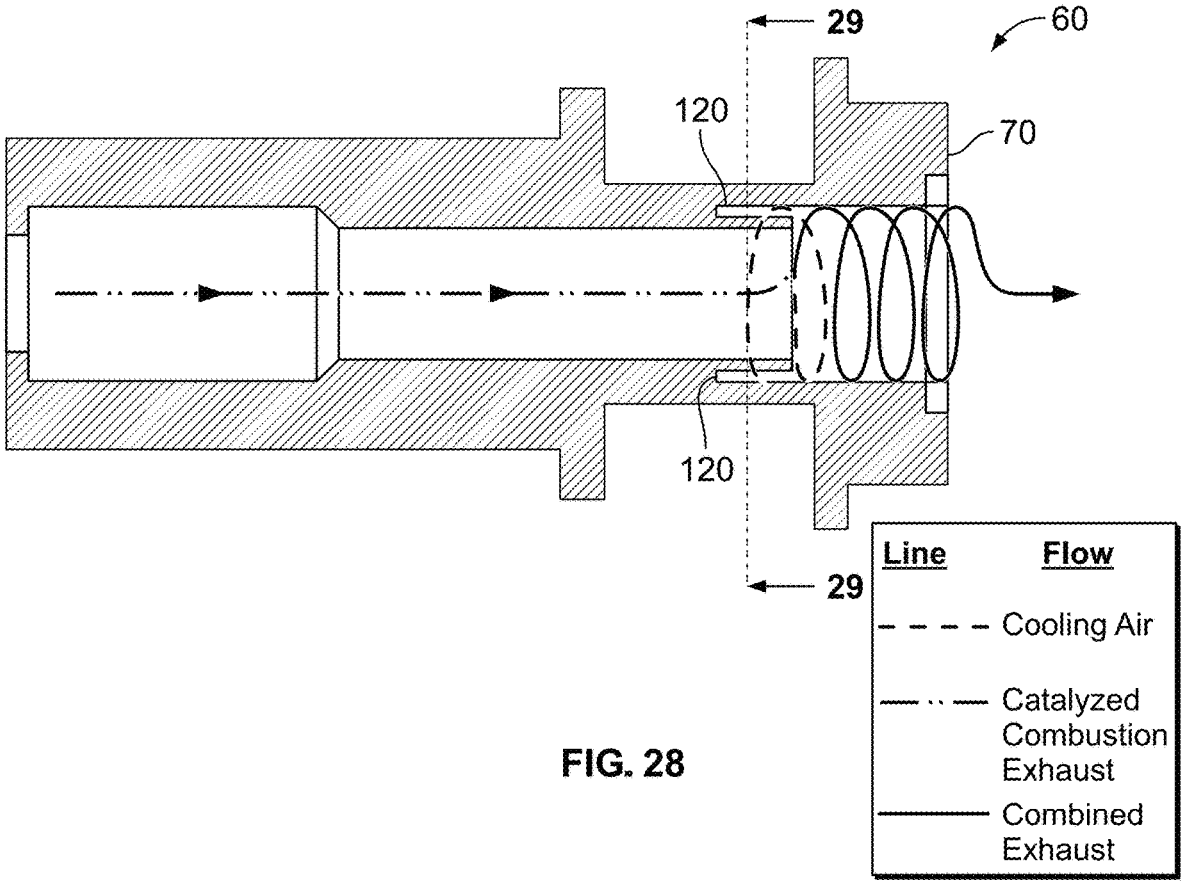
FIG. 28 is detailed cutaway view of an alternative mixing chamber including tangential intake ducts.
Figure 29:
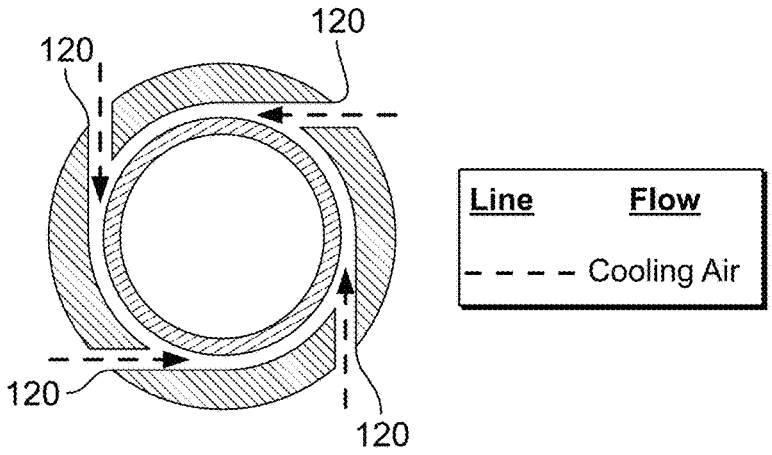
FIG. 29 is a cross sectional view taken along line 29-29 in FIG. 28.

FIGS. 28 and 29 show an alternative mixing chamber 60 that includes the swirl mixer 70 including tangential intake ducts 120. FIG. 29 is a cross-section of FIG. 28 taken along line 29-29. Tangential intake ducts 120 may be utilized to force the flow of gas into a vortex without the use of swirl vanes 81. As illustrated, the engine cooling air is ported into the mixing chamber 60 via the tangential intake ducts 120 and is forced into a swirl. The catalyzed combustion exhaust gases are mixed in the swirl resulting in a vortex of combined exhaust gases. As described above, the mixing of the two gases in a vortex effectively reduces the peak temperature of the combined gases.

Figure 30:
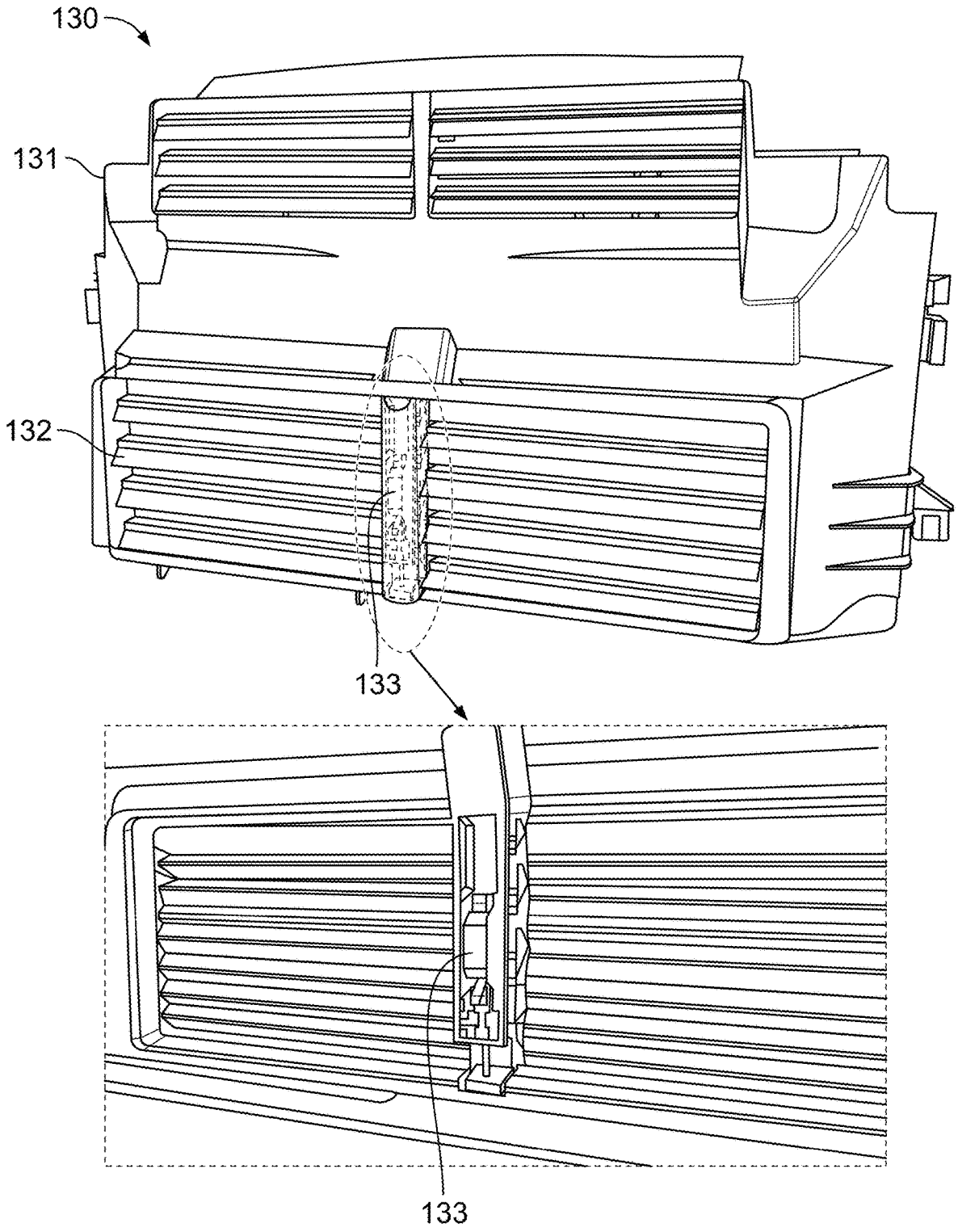
FIG. 30 illustrates exemplary dampers for use with an exhaust cooling system for use with internal combustion engines powering small power equipment and power tools, which may be used to adjust air volume being channeled into and from the cooling assembly.

FIG. 30 shows exemplary dampers 130 for use in the exhaust cooling system 1, which may be used to adjust air volume being channeled into and from the cooling assembly, according to one aspect of the present disclosure. Specifically, the dampers include a grille 131, a shutter 132, and a motor 133 or actuator to actuate the shutter 132. Such damper 130 may be utilized in the equipment cover or another part of the housing to control air flow to and from the exhaust cooling system 1. For example, in one configuration, the damper 130 may close while the engine 11 is operating to direct cooling air flow through the cooling assembly 40, and open when the engine is off to aid passive cooling from heat soak. The shutter 132 could also be actuated using a mechanical connection, such as a control cable attached to the choke/run/stop knob. Alternatively, the shutter 132 could be actuated by a vacuum actuator, electrically, or pneumatically, or manually.

Figure 31:
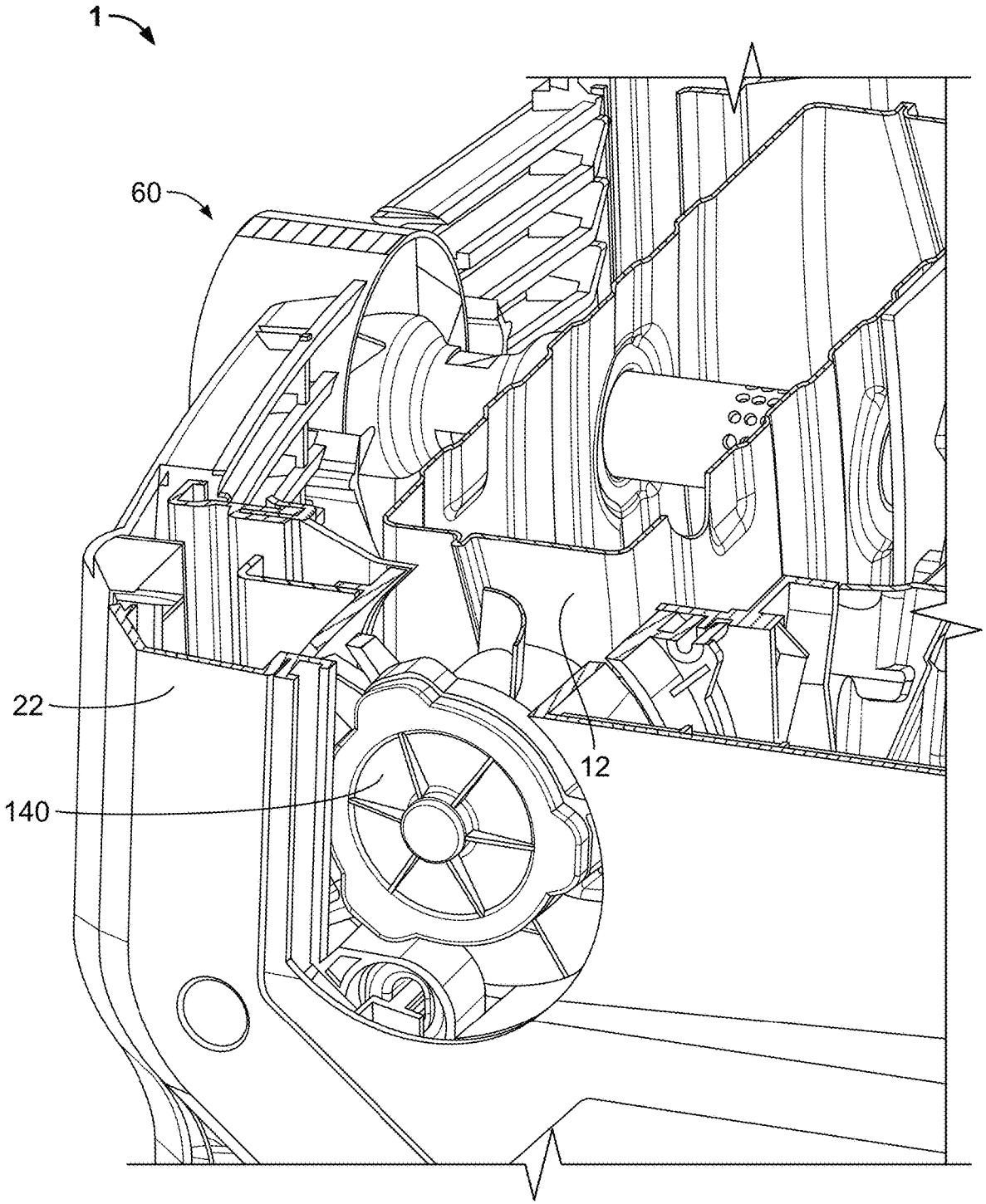
FIG. 31 illustrates an alternative configuration of an exhaust cooling system for use with internal combustion engines powering small power equipment and power tools, including an auxiliary electric fan for controlling the flow of cooling air being directed into the system.

FIG. 31 shows an alternative configuration of the exhaust cooling system 1, including an auxiliary electric fan 140 for controlling the flow of cooling air being directed into the exhaust cooling system 1. The auxiliary fan 140 can be disposed anywhere in the equipment housing 22, or on a duct supplying cooling air into the exhaust cooling system 1. For example, as illustrated, the auxiliary fan 140 is disposed adjacent the heat shielding and muffler enclosure 12. When the auxiliary fan 140 is powered, it provides additional cooling air into the system, which may assist in the adiabatic mixing of the catalyzed combustion exhaust gas and cooling air. The illustrated embodiment for example, utilizes both engine cooling air and forced cooling air from the auxiliary fan 140. Other configurations are also possible. For example, the engine cooling system 1 could be supplied solely with cooling air forced into the system by the auxiliary fan 140, while the engine cooling air exits the equipment elsewhere. One additional benefit provided by the use of an auxiliary fan 140 is the ability to have the fan 104 run after the engine 11 has shut down for heat soak protection.

Figure 32:
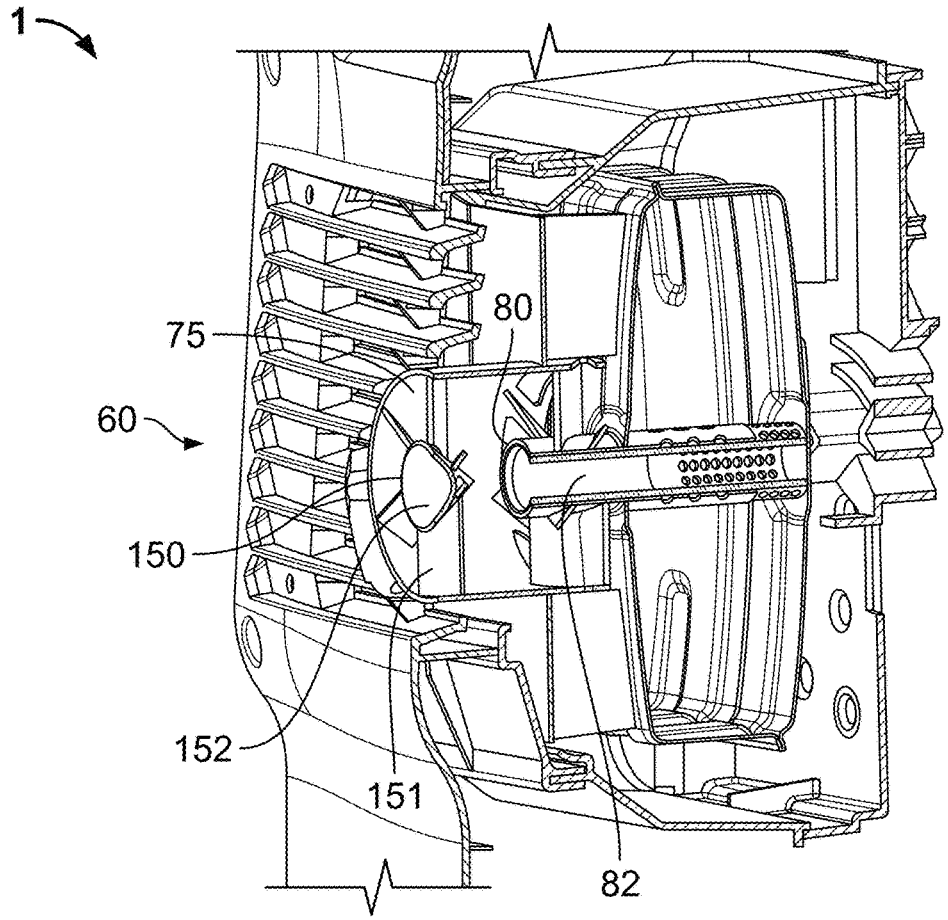
FIG. 32 illustrates a perspective cutaway view of an alternative configuration including a diffuser.
Figure 33:
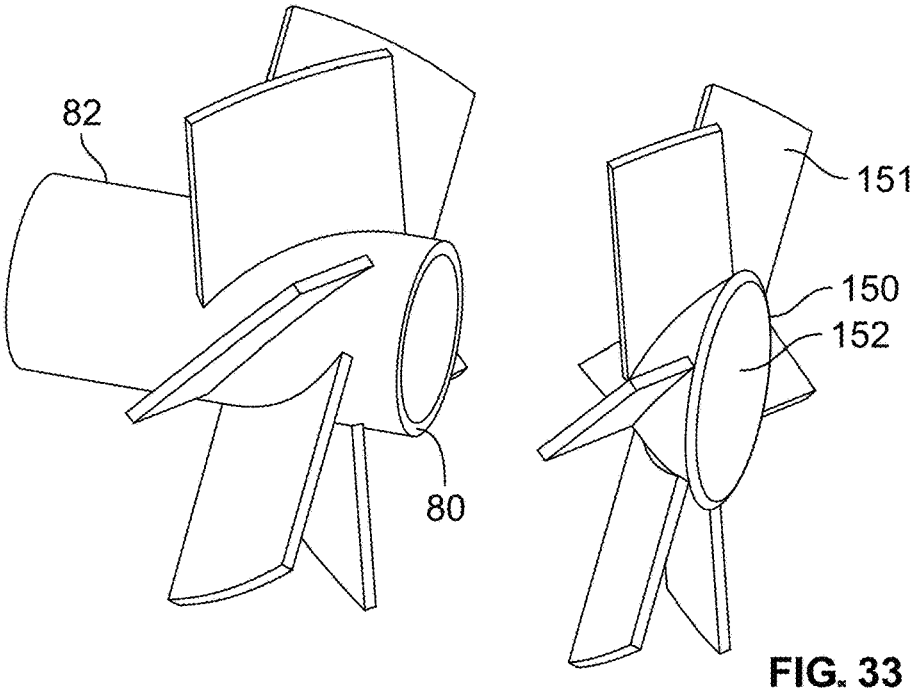
FIG. 33 illustrates a perspective detailed view of a swirl vane assembly and a diffuser.

FIGS. 32 and 33 show an alternative configuration of the exhaust cooling system 1 that includes the mixing chamber 60 further comprising a diffuser 150. As illustrated the exhaust cooling system 1 may include the diffuser 150 and optionally a plurality of additional swirl vanes 151 attached to a body 152. In the illustrated embodiment, the diffuser 150 is positioned within the wall 75 of the mixing chamber 60 and coaxial with the cylindrical sleeve 82 of the swirl vane assembly 80. As the swirl vane assembly 80 induces a resulting vortex of combined exhaust gas, the combined exhaust gas diffuses over the body 152 of the diffuser 150 and through the swirl vanes 151 due to the shape of the body 152 that directs the combined exhaust gas towards the swirl vanes 151. As such, the diffuser 150 may assist in further reducing the velocity of the combined exhaust gas to assist in the continued adiabatic mixing and dissipation of the combined exhaust gases once they are released into the atmosphere. The use of a diffuser 150 may be advantageous to prevent a concentrated stream of combined exhaust gas flowing a distance once it has exited the equipment. Rather, it is desirable for the combined exhaust gas to dissipate as quickly as possible to avoid adjacent objects from being heated, burned, or caught on fire. The present disclosure contemplates alternative arrangements of swirl vanes 151 on the diffuser 150. For example, both clockwise and counter-clockwise swirl vanes 151 are contemplated. The present disclosure also contemplates alternative shapes for the body 152 of the diffuser 150, such as a cone, pyramid, or hemisphere.

Figure 34:
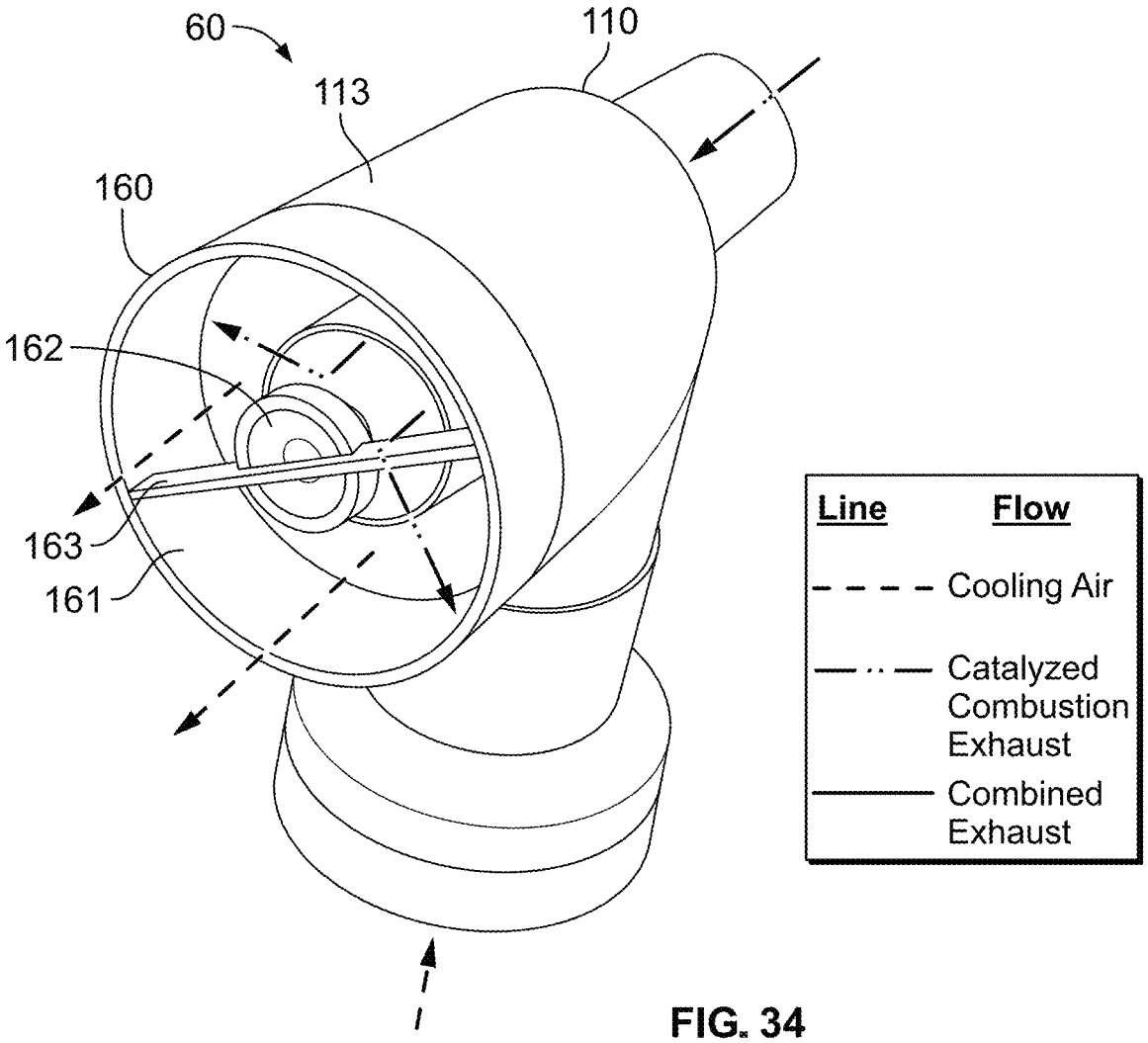
FIG. 34 illustrates a perspective view of an example cone diffuser attached to a coaxial mixer.
Figure 35:
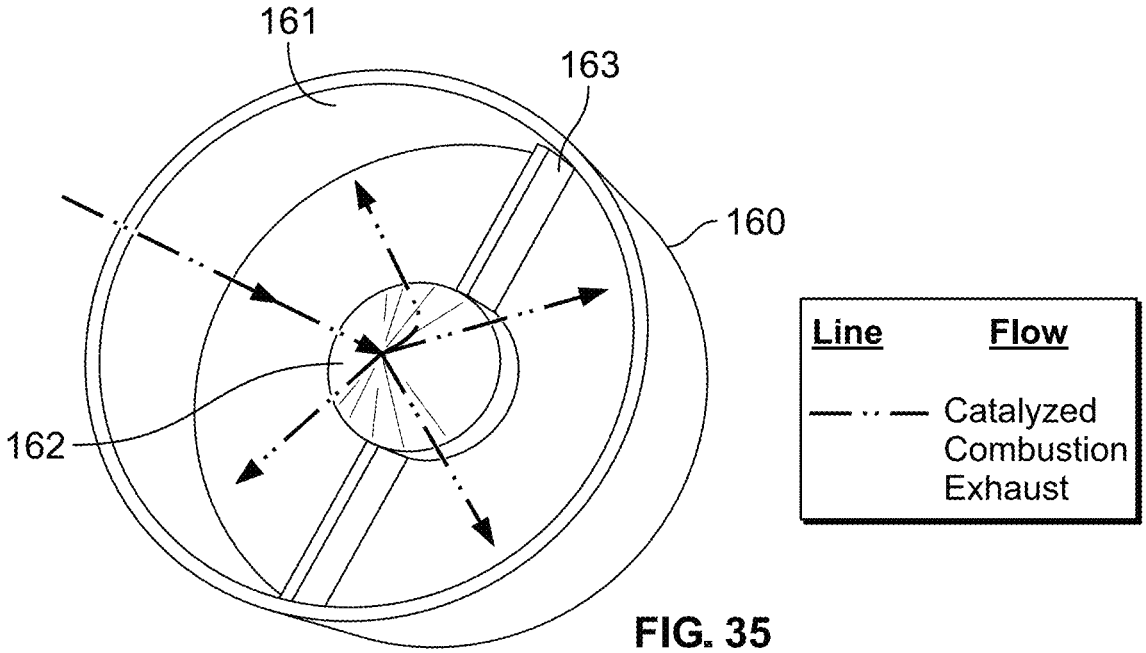
FIG. 35 illustrates a perspective view of an example cone diffuser.

FIGS. 34 and 35 show one example of a diffuser configuration, utilizing a cone diffuser 160 mounted at the exhaust end 113 of the coaxial mixer 110. The cone diffuser 160 includes a conical body 162 affixed to a ring 161 by a bar 163. The use of the cone diffuser 160 in the coaxial mixer 110 may facilitate improved mixing and/or prevent a direct path of the catalyzed combustion exhaust stream from the muffler outlet tube 17 from exiting the system. As illustrated, when the flow of the catalyzed combustion exhaust (dot-dot dash lines) impinges on the cone diffuser 160, it is diffused over the conical body 162 and forced outward towards the ring 161 and into the flow of the cooling air (dashed lines). Such diffusing may assist in the mixing of the two gases and contribute to reducing the peak temperature thereof. The configuration of FIGS. 34 and 35 may optionally be combined with a downstream extension tube 115 (see FIG. 26) to further facilitate the mixing of the gases prior to being released to the atmosphere.

Figure 36:
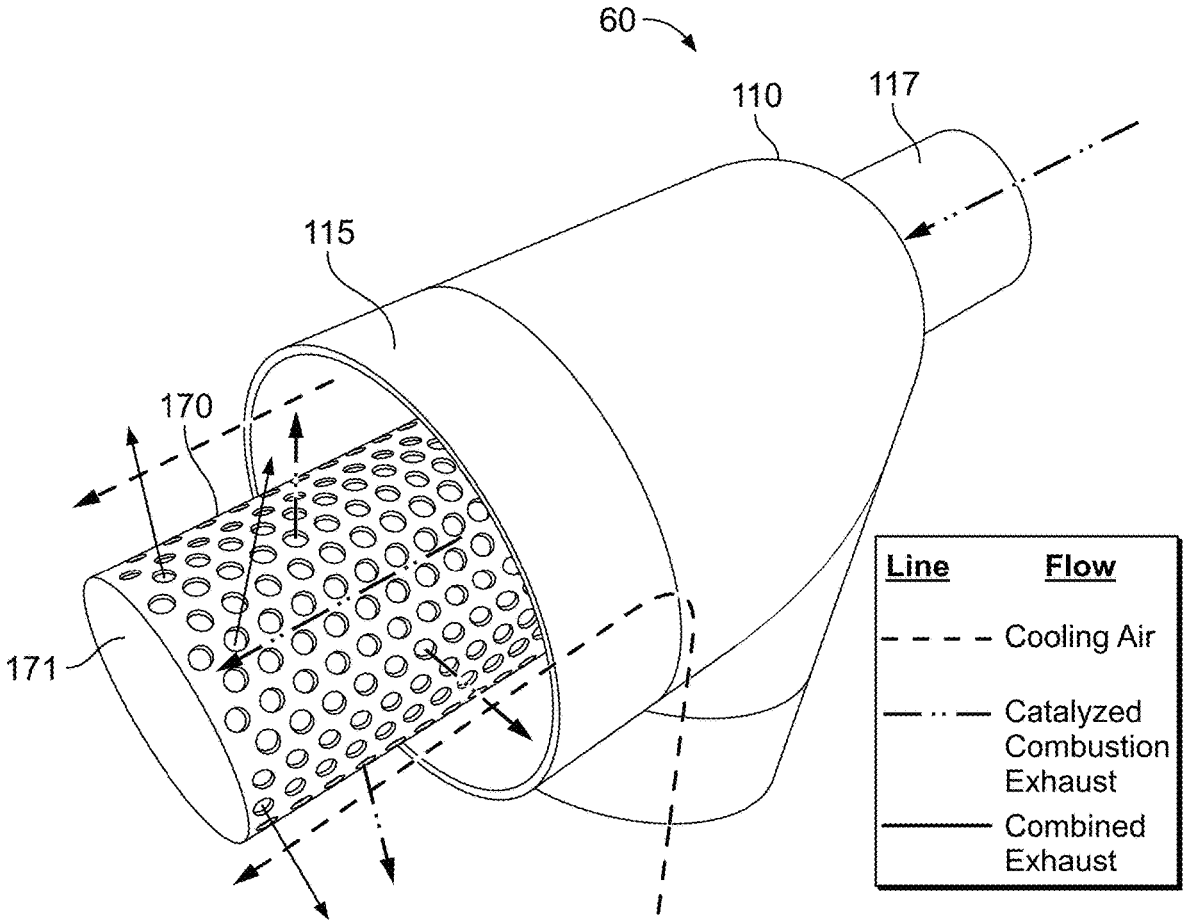
FIG. 36 illustrates a perspective view of an example perforated tube diffuser attached to a coaxial mixer.
Figure 37:
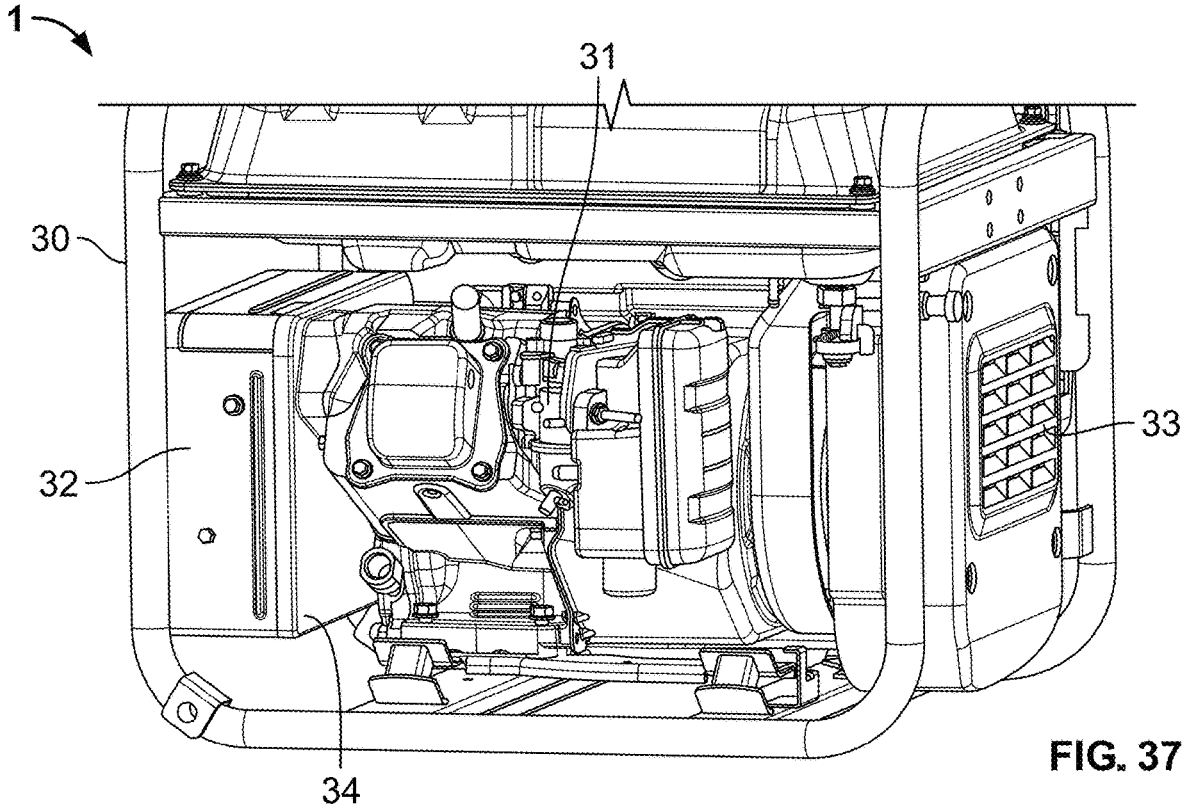
FIG. 37 illustrates a partial perspective view of an open frame generator including an exhaust cooling system, which includes an air guide to direct engine cooling air into an enclosed muffler assembly for cooling catalyzed engine combustion exhaust gases.
Figure 38:
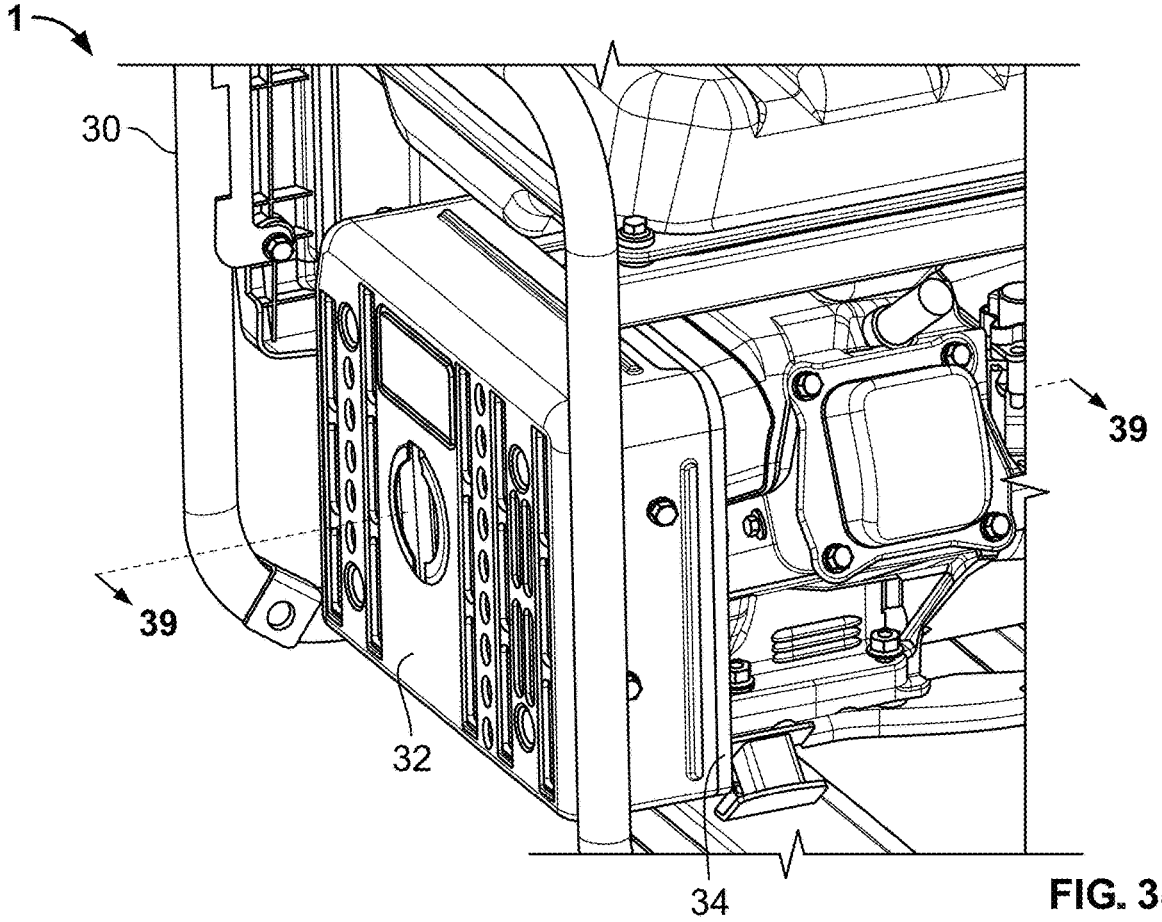
FIG. 38 illustrates another partial perspective view of the configuration shown in FIG. 37.

FIG. 36 shows another example of a diffuser configuration, utilizing a perforated tube diffuser 170 mounted on the muffler outlet tube 17 (the inner tube 117) of the coaxial mixer 110. In some embodiments, the perforated tube diffuser 170 may be positioned within the extension tube 115 (see e.g., FIG. 26). Likewise, the use of a perforated tube diffuser 170 in the coaxial mixer 110 may facilitate improved mixing and/or prevent a direct path of the catalyzed combustion exhaust stream from the muffler outlet tube 17 from exiting the system. As illustrated, when the flow of the catalyzed combustion exhaust (dot-dot dash lines) impinges on an end-wall section 171 of perforated tube diffuser 170, the flow is forced radially outward into the flow of the cooling air (dashed lines). In some embodiments, the two flows, the catalyzed combustion exhaust and cooling air, mix in extension tube 115 prior to being released into the atmosphere. The illustrated perforated tube diffuser 170 includes flat end-wall 171, but could consist of alternate shapes such as a cone.

It is understood that the diffuser configurations depicted in FIGS. 32-36 should not be limited to the illustrated embodiments. The present disclosure contemplates any shape and size of diffuser operable to diffuse a flow of catalyzed combustion exhaust, thereby forcing it directly into a flow of cooling air, which could include ambient air, ducted cooling air, forced cooling air, passive induction of cooling air, and/or engine cooling air, or any combination thereof. It is further understood that the illustrated configuration could be reversed (not shown). For example, the cooling air could be diffused into a stream of catalyzed combustion exhaust.

FIGS. 37-43 show alternative configurations of an exhaust cooling system 1 integrated into an open frame piece of equipment (e.g., an open frame generator 30). All of the above-described systems may be applied to an open frame piece of equipment. The primary difference between an open frame equipment and a closed frame equipment is the ducting of air into the engine and exhaust cooling system. As illustrated, air is pulled into the air intake 33, passes through the engine 31 and is ported into a muffler enclosure 32 via an air guide 34. Once the cooling air, either engine cooling air or direct cooling air having been ducted into the muffler enclosure 32, the system functions identically as described above. The exhaust cooling system 1 may include for example the mixing chamber 60, specifically, the swirl mixer 70, venturi section 90, or a combination thereof (not shown in FIGS. 37 and 38) to reduce the peak temperature of the catalyzed combustion exhaust gas.

Figure 39:
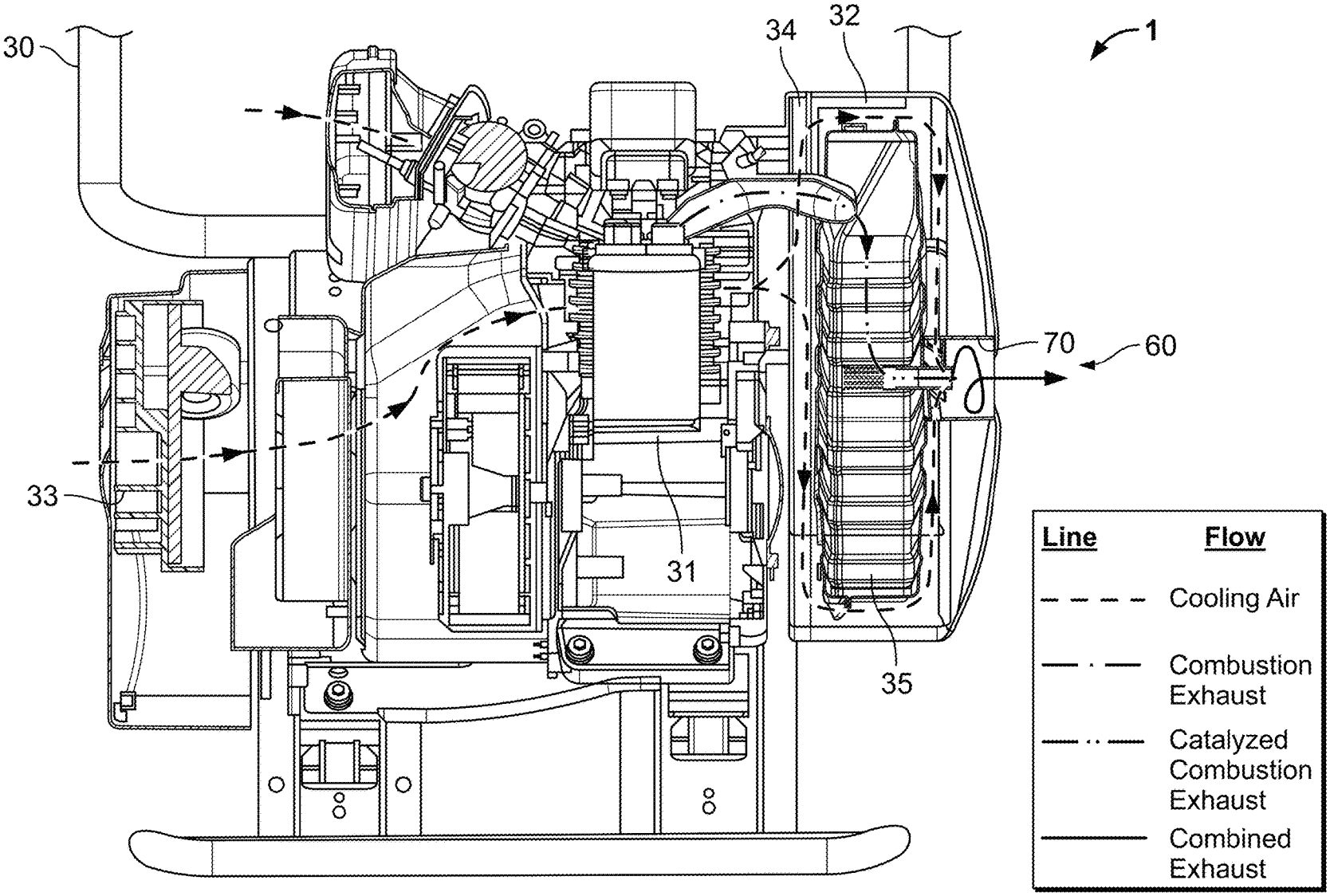
FIG. 39 is a cross sectional view taken along line 39-39 in FIG. 38 of an exemplary open frame generator including an exhaust cooling system utilizing a mixing chamber and swirl mixer, and depicting a flow diagram showing the flow of the engine cooling air, catalyzed combustion exhaust gases, and the mixture of the combined exhaust gases.
Figure 40:
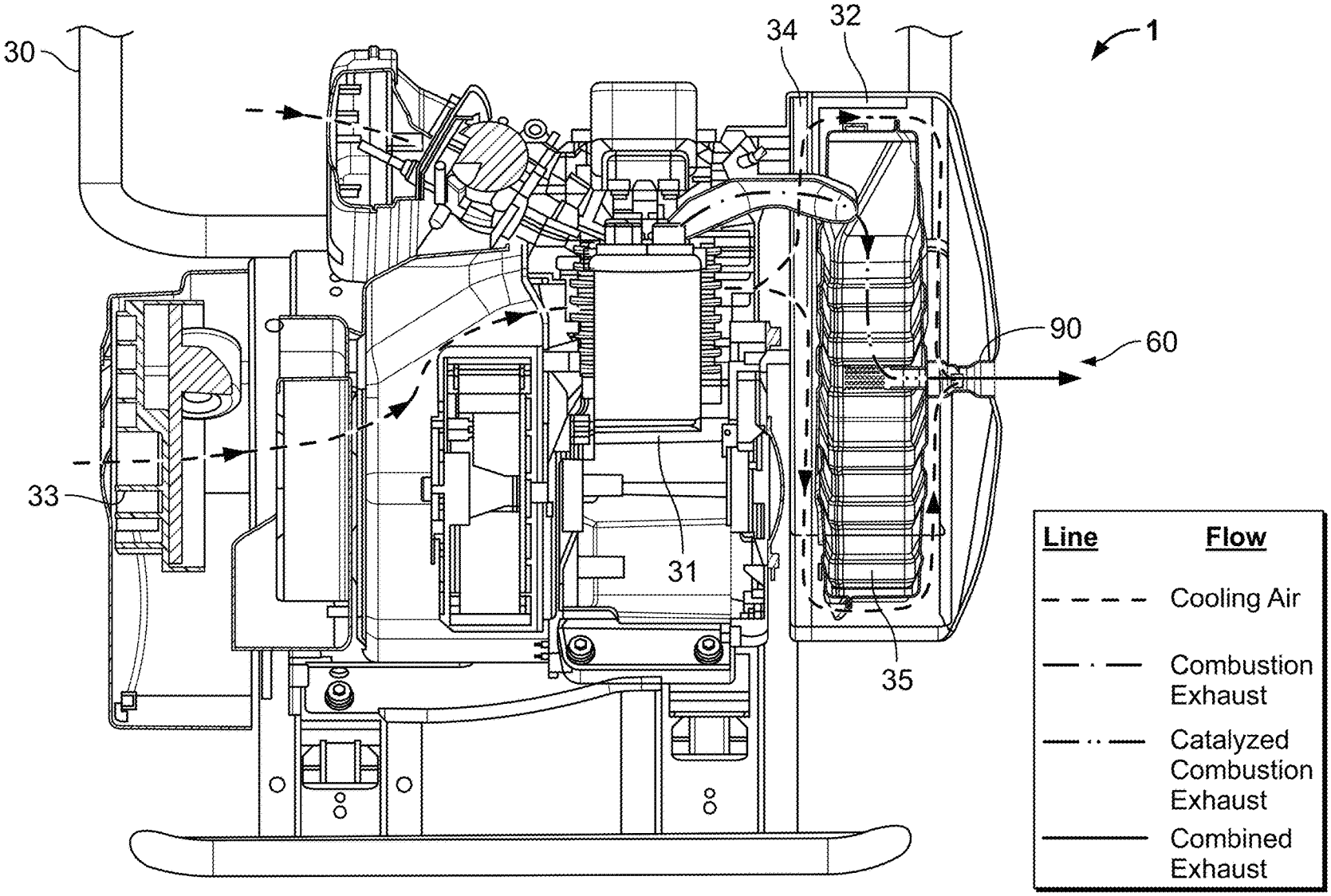
FIG. 40 illustrates an exemplary open frame generator including an exhaust cooling system utilizing a mixing chamber and a venturi section, and depicts a flow diagram showing the flow of the engine cooling air, catalyzed combustion exhaust gases, and the mixture of the combined exhaust gases.

FIGS. 39 and 40, show an exemplary flow diagram for an open frame generator, including flow paths of the ambient air/cooling air (dashed lines), combustion exhaust gas (dot dash line), catalyzed combustion exhaust gases (dot-dot dash lines), and the mixture of the combined exhaust gases (solid lines). Specifically, FIG. 39 shows a flow diagram for an exhaust cooling system 1 for an open frame generator 30 including the swirl mixer 70. FIG. 40 shows an flow diagram for the exhaust cooling system 1 for an open frame generator 30 including the venturi section 90. As illustrated, ambient air (dashed lines) is pulled into the engine 31 through the air intake 33 and a portion of the engine cooling air (dashed lines) is ducted into the muffler enclosure 32 by the air guide 34. Once inside the muffler enclosure 32, the engine cooling air flows around the muffler 35 and is mixed with catalyzed combustion exhaust (solid lines) via either the swirl mixer 70 or venturi section 90.

Figure 41:
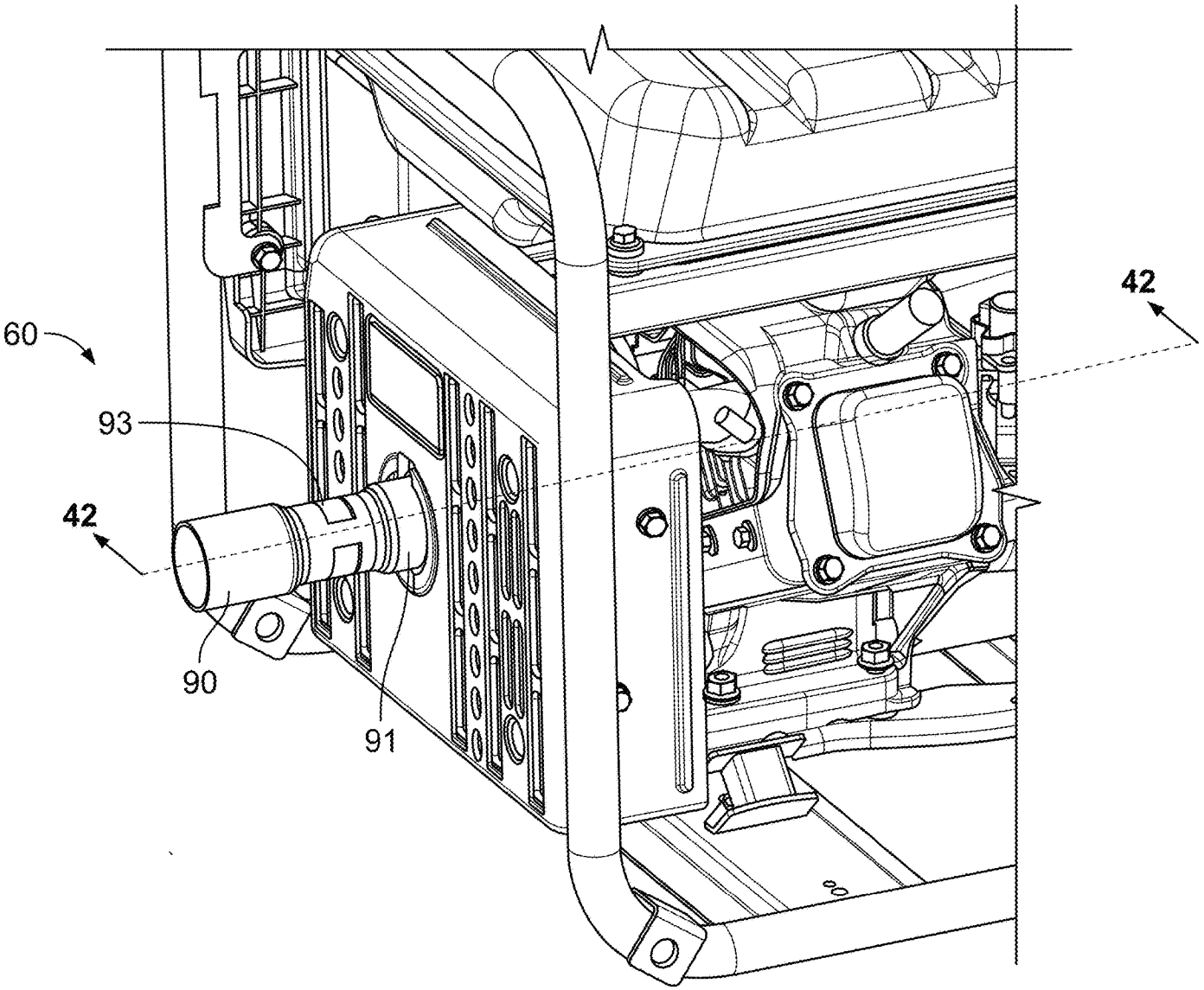
FIG. 41 illustrates a perspective view of an alternative configuration of an exhaust cooling system for use with internal combustion engines powering small power equipment and power tools including a venturi section attached at a muffler outlet for pulling in ambient air to mix with the catalyzed combustion exhaust gases.
Figure 42:
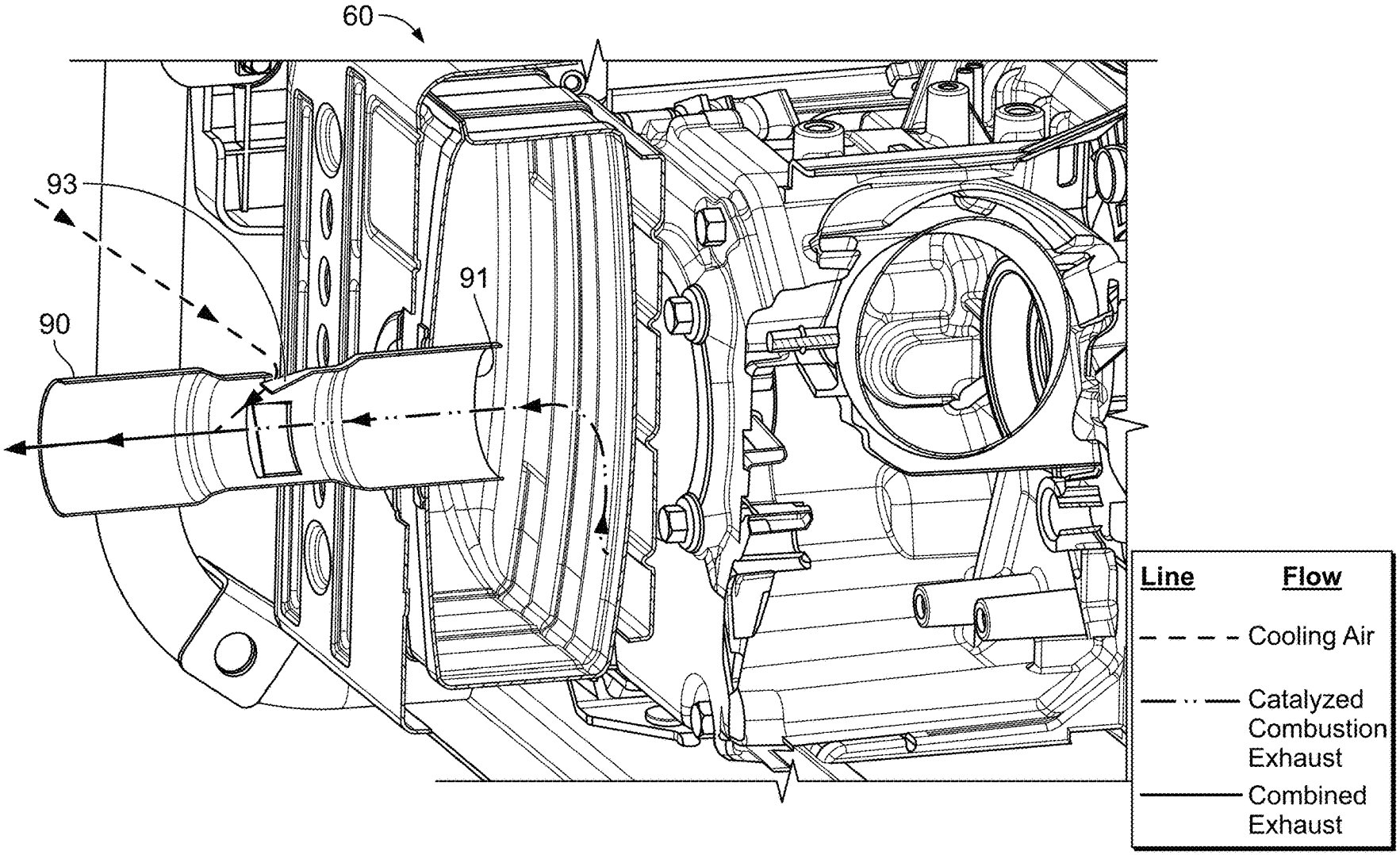
FIG. 42 illustrates another perspective view of an alternative configuration of an exhaust cooling system for use with internal combustion engines powering small power equipment and power tools including a venturi section attached at a muffler outlet, and depicts a flow diagram showing the flow of the cooling air, catalyzed combustion exhaust gases, and the mixture of the combined exhaust gases.

FIGS. 41 and 42 show an alternative configuration of the exhaust cooling system 1 for use with internal combustion engines powering small power equipment and power tools including the venturi section 90 configured to pull in and mix ambient air instead of engine cooling air with the catalyzed combustion exhaust gas. Because the venturi section 90 is exposed to ambient air (dashed lines in FIG. 42), as the catalyzed combustion exhaust gas (dot-dot dash lines) passes through the venturi section 90, a vacuum is created, which sucks the ambient air into the suction ports 93 of the venturi section 90, after which the ambient air mixes with the catalyzed combustion exhaust gas to reduce the peak temperature of the combined exhaust gas (solid lines). A benefit to this particular configuration is that ambient air typically has a lower temperature than the engine cooling air.

The configurations shown in FIGS. 41 and 42 may also be combined with any of the other configurations discussed in this application. For example, as discussed in more detail above, the venturi section 90 may be configured (e.g., via the use of an enclosure, an air guide panel and/or air ducts (not shown)) to pull in both engine cooling air and ambient air. Alternatively, ambient cooling air configurations may utilize forced flow of ambient (cooling) air. For example, a portion of engine cooling fan flow could be bypassed prior to engine cooling (not shown) and ducted to the venturi inlet 91, or an auxiliary fan or blower could be used to force air to the venturi inlet 91.

Figure 43:
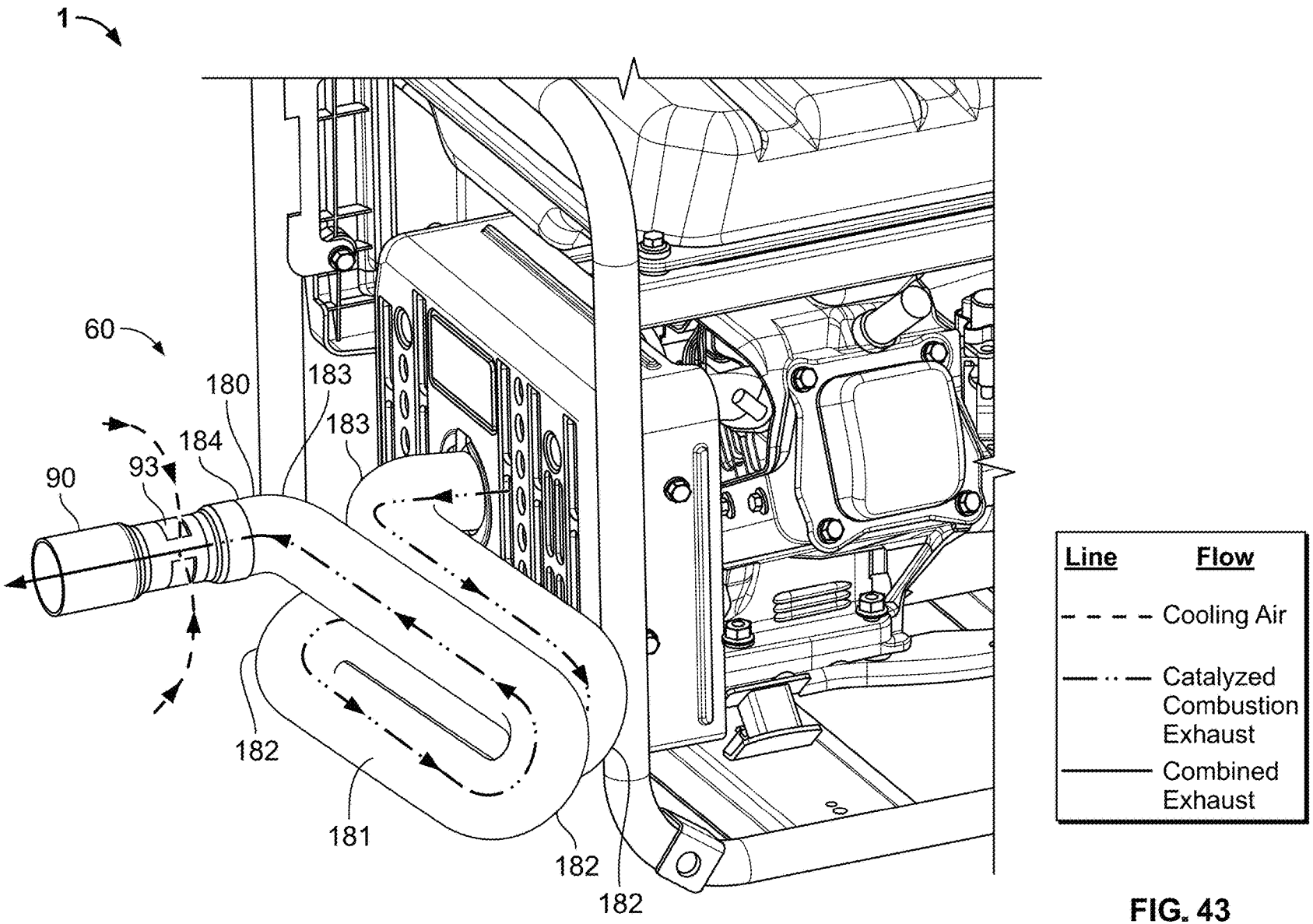
FIG. 43 illustrates a perspective view of an alternative configuration of an exhaust cooling system for use with internal combustion engines powering small power equipment and power tools including a tightly packaged exhaust extension and a venturi section, and depicts a flow diagram showing the flow of cooling air, the catalyzed combustion exhaust gases through the tightly packaged exhaust extension, and the mixture of the combined exhaust gases.

FIG. 43 shows an alternative configuration of the exhaust cooling systems 1 that includes the mixing chamber 60 further comprising a tightly packaged exhaust extension 180. Specifically, as shown FIG. 43, the system includes an exhaust tube extension 181 which is bent into a series of U-bends 182 into a tightly packaged configuration. The illustrated configuration includes three U-bends 182 and two elbows 183 to significantly increase the overall exhaust length. The increase in exhaust length, while at the same time maintaining a tight packaging, allows for use in power equipment and power tools. It is understood that the illustrated configuration of the tightly packaged exhaust extension 180 is exemplary and that other lengths, shapes, and configurations are possible. The present disclosure contemplates any length, shape, and configuration of a tightly packaged exhaust extension 180 routed in a way to maximize flow length and minimize package space, for use with small power equipment and power tools.

As is shown for example in FIG. 43, the increase in exhaust length allows for heat to dissipate as the catalyzed combustion exhaust gas (dot-dot dash lines) travels through the tightly packaged exhaust extension 180 and thus may contribute to drastically reducing the peak temperature of the catalyzed combustion exhaust gas prior to being released to the atmosphere. For example, FIG. 43 shows that the catalyzed combustion exhaust gas cooling as it passes through the tubing 181 of the tightly packaged exhaust extension 180. Such a configuration alone may contribute to reducing the peak temperature of the catalyzed combustion exhaust gas from over 1200° F. to approximately 450° F.

As shown in FIG. 43, the tightly packaged exhaust extension 180 may be combined with any of the other alternative configurations discussed in this disclosure. For example, the venturi section 90 may be attached to an end 184 of the tightly packaged exhaust extension 180. As illustrated, heat from the catalyzed combustion exhaust gas (dot-dot dash lines) dissipates as the catalyzed combustion exhaust gas passes through the tightly packaged exhaust extension 180. As the catalyzed combustion exhaust gas passes through the venturi section 90, a vacuum is created, which sucks the ambient air (dashed lines) into the suction ports 93 of the venturi section 90 and mixes with the catalyzed combustion exhaust gas to even further reduce the peak temperature of the combined exhaust gas (solid lines).

The tightly packaged exhaust extension 180 could also be implemented in a configuration where engine cooling air passes over the tubing to help further dissipate heat (not shown). For example, some or all of engine cooling air could be ducted to flow over the tightly packaged exhaust extension (not shown). Likewise, a forced flow of ambient (cooling) air may be used to further dissipate heat from the tightly packaged exhaust extension 180. For example, a portion of engine cooling fan flow could be bypassed prior to engine cooling (not shown) and ducted to the tightly packaged exhaust extension 180, or an auxiliary fan or blower could be used to force air to the tightly packaged exhaust extension 180.

Finally, while not shown in FIG. 43, one or more heat shields or enclosures may be used to provide a barrier between the tightly packaged exhaust extension 180 and the environment to reduce the risk of contact burns by an operator.

Figure 44:
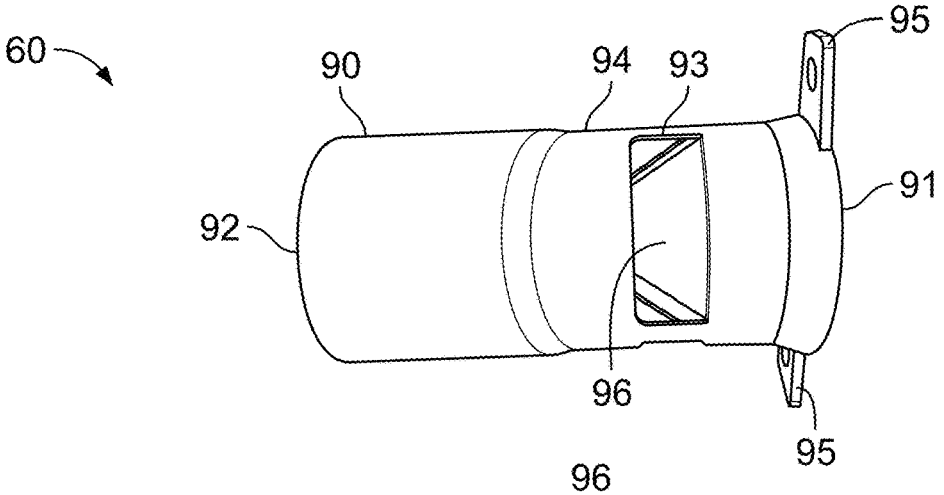
FIG. 44 illustrates a perspective view of an alternative configuration of a venturi section.
Figure 45:
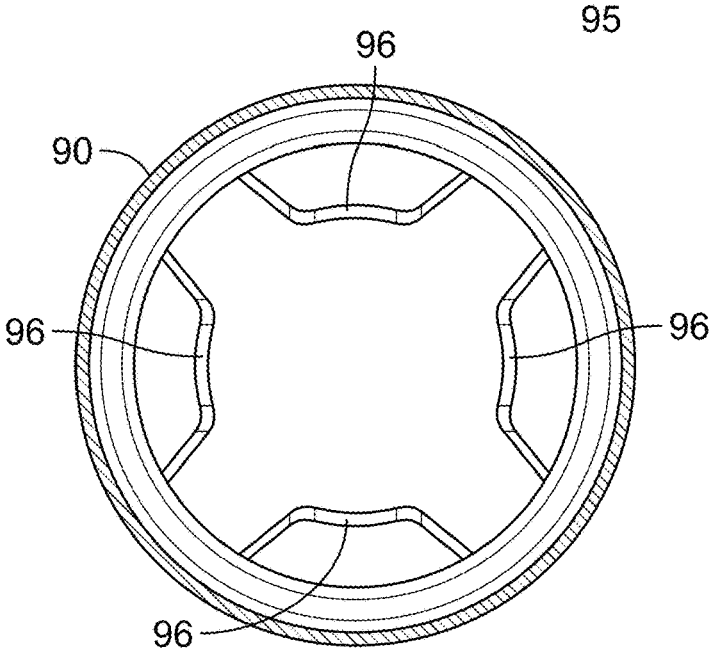
FIG. 45 illustrates a front elevation view of the venturi section of FIG. 44.
Figure 46:
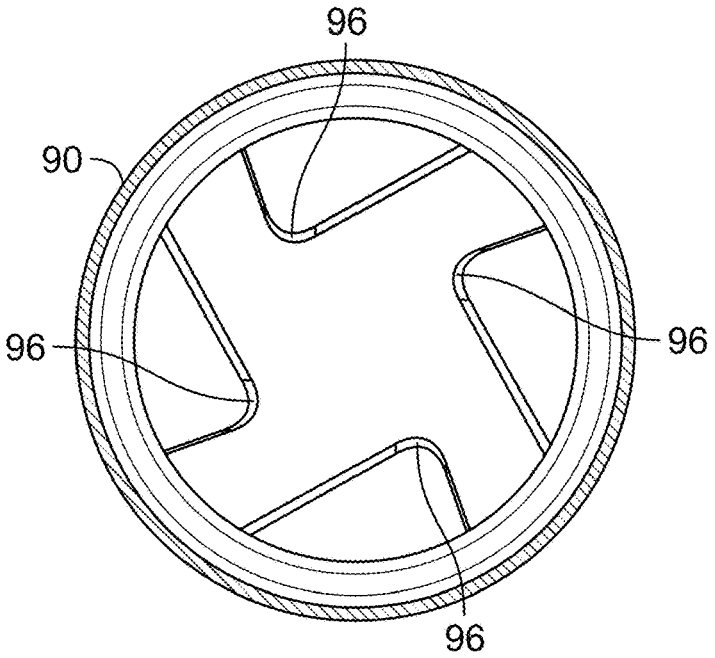
FIG. 46 illustrates a front elevation view of an alternative configuration of a venturi section.
Figure 47:
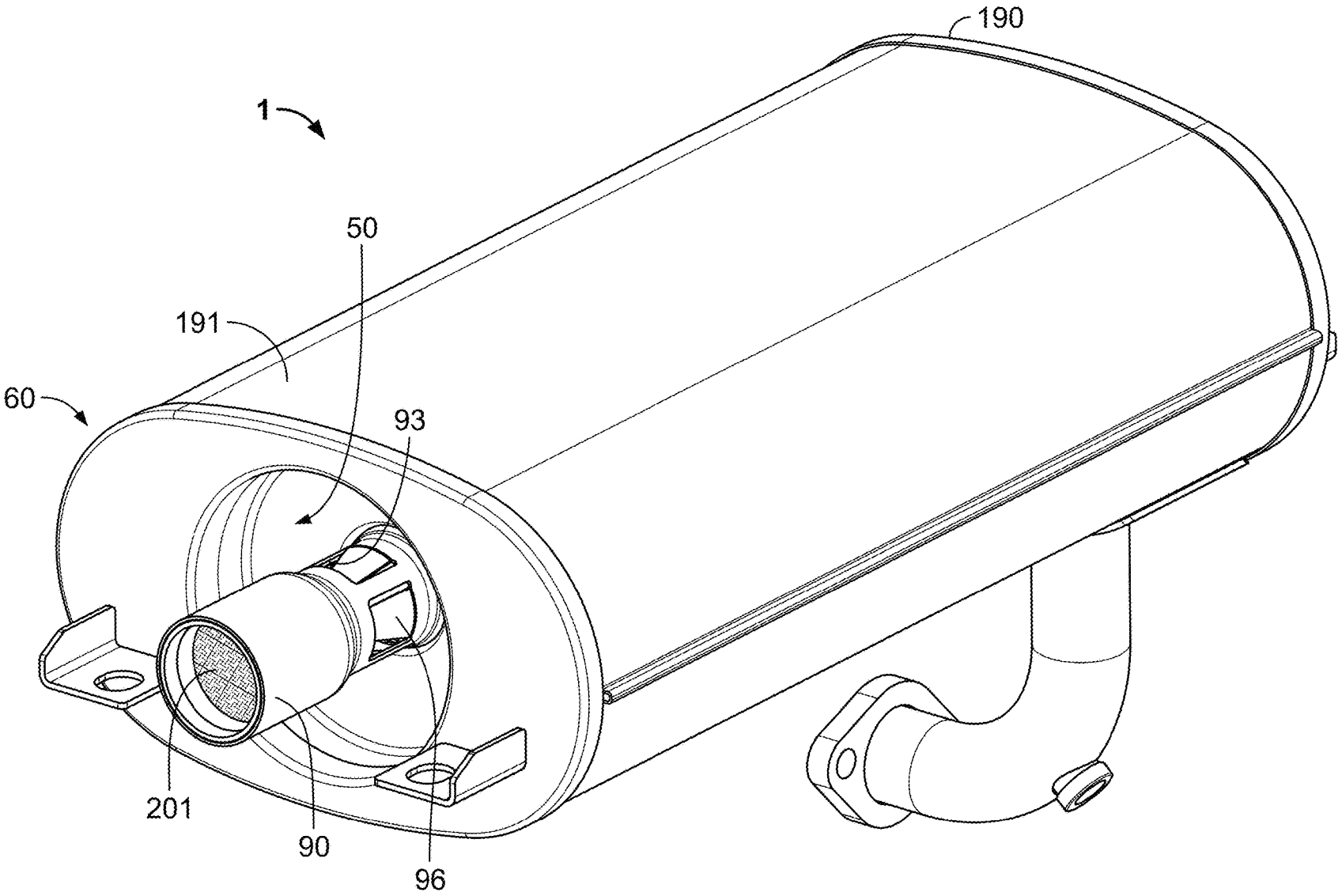
FIG. 47 illustrates a perspective view of an alternative configuration of an exhaust cooling system for use with internal combustion engines powering small power equipment and power tools being integrated into the muffler of the exhaust system and showing a partially recessed venturi section.

FIGS. 44-46 show an alternative configuration of the venturi section 90, which can be incorporated into any of the systems described herein. These alternative venturi sections function similarly to the disclosure related to FIGS. 15-18 above. As illustrated, the venturi section 90 includes the venturi inlet 91, the venturi outlet 92, and one or more suction ports 93 positioned in the reduced diameter section 94. The venturi section 90 may also include one or more mounting bracket(s) 95, operable to mount the venturi section 90 to, for example, the mixing chamber 60 or muffler outlet tube 17. FIGS. 45 and 46 show a plurality of fins 96 disposed on the venturi section 90. The fins 96 may be formed by cutting a c-shaped or arc-shaped suction port 93 and pushing the cut portion inward. The fins 96 may assist in the adiabatic mixing of the catalyzed combustion exhaust with cooling air (whether engine cooling air, ambient air, or forced cooling air) by inducing the combined exhaust gas into co-axial streams or a vortex.

FIGS. 47-50 show an alternative configuration of the exhaust cooling system 1 being integrated into a muffler housing 191 of an exhaust system 190. Specifically, the air guide 50 and mixing chamber 60 including the venturi section 90 are integrated and recessed into the muffler housing 191 of the exhaust system 190. This is to ensure that the entire system is tightly packaged and prevents the mixing chamber 60 from significantly protruding from the muffler housing 191. Further, because the suction ports 93 are positioned inward from the muffler housing 191, the air guide 50 must be recessed into the muffler housing to ensure cooling air reaches the cooling inlet (suction ports 93). The exhaust system 190 may also optionally include a spark arrestor screen 201 for catching any sparks or other particulates flowing through the exhaust system 190.

Figure 48:
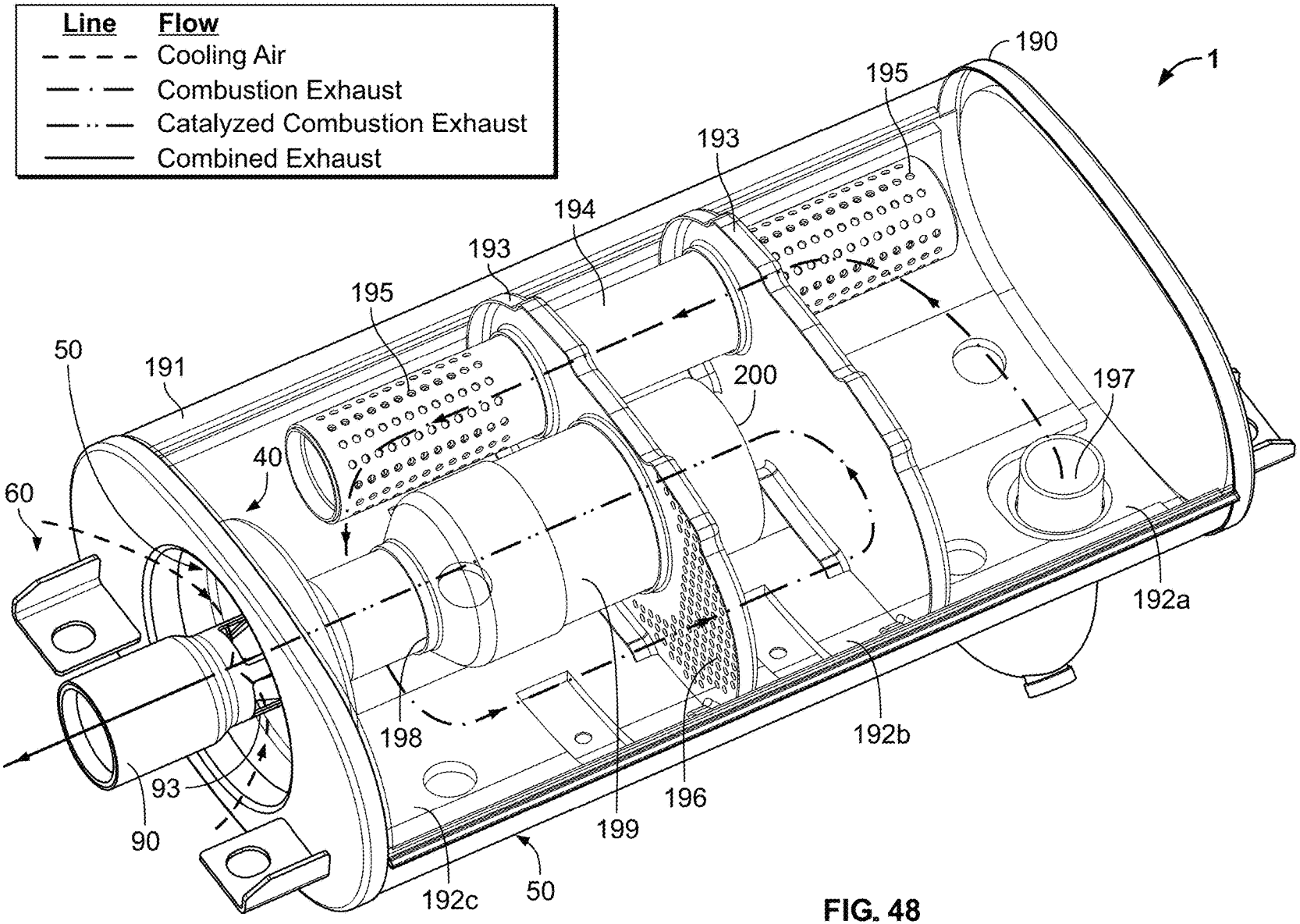
FIG. 48 illustrates a partial cutaway view of the system of FIG. 47, showing the internal chambers of the exhaust system, catalytic converter, and exhaust cooling system, and depicting a flow diagram showing the flow of the engine cooling air, catalyzed combustion exhaust gases, and the mixture of the combined exhaust gases.

FIG. 48 illustrates a cutaway view of the exhaust system 190 and depicts a flow diagram showing the flow of the cooling air, combustion exhaust gases, and the mixture of the combined exhaust gases. The exhaust system 190 includes a plurality of chambers 192 which are separated by dividing walls 193, to force the flow of the engine exhaust along a guided path, lengthening the overall flow path. As illustrated a crossover tube 194, including perforated tube ends 195 connects the first chamber 192*a* and third chamber 192*c*. Further, a perforated section 196 in the dividing wall connects the second chamber 192*b* and third chambers 192*c*. The catalyst (catalytic converter) 199 is also positioned within the muffler housing 191 and includes an inlet 200 in the second chamber 192*b*. The muffler outlet 198 connects directly to the cooling assembly 40.

Figure 49:
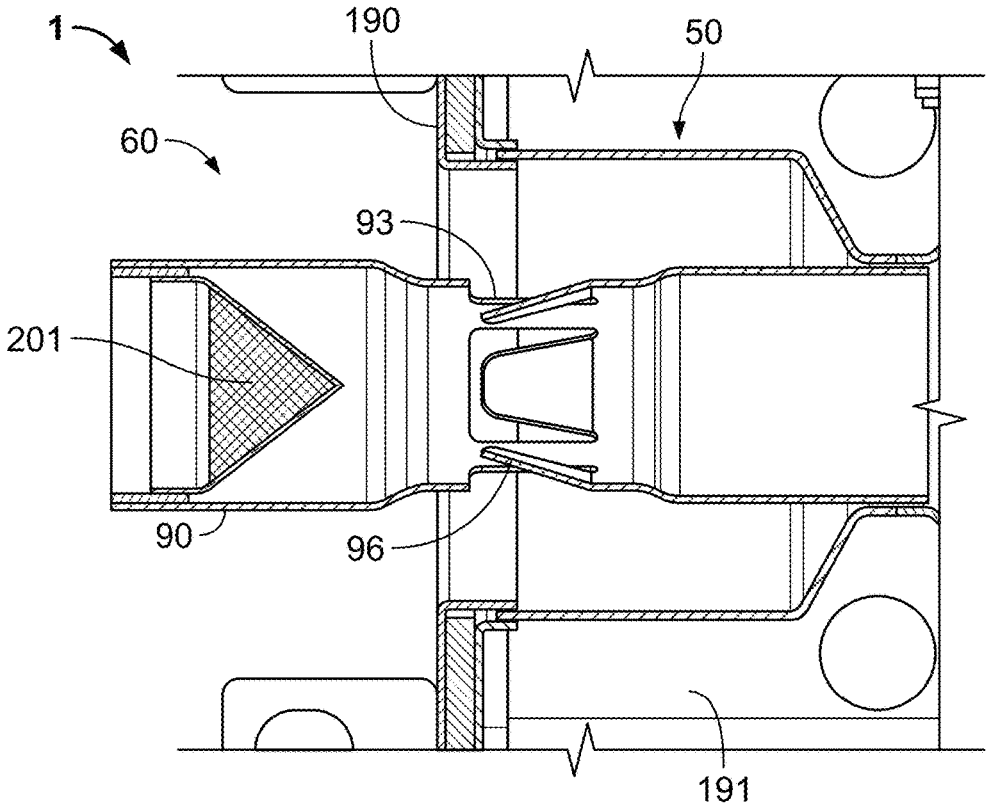
FIG. 49 illustrates a partial cutaway side view of an alternative configuration of the system of FIG. 47, depicting a different geometry of the cooling air inlet.
Figure 50:
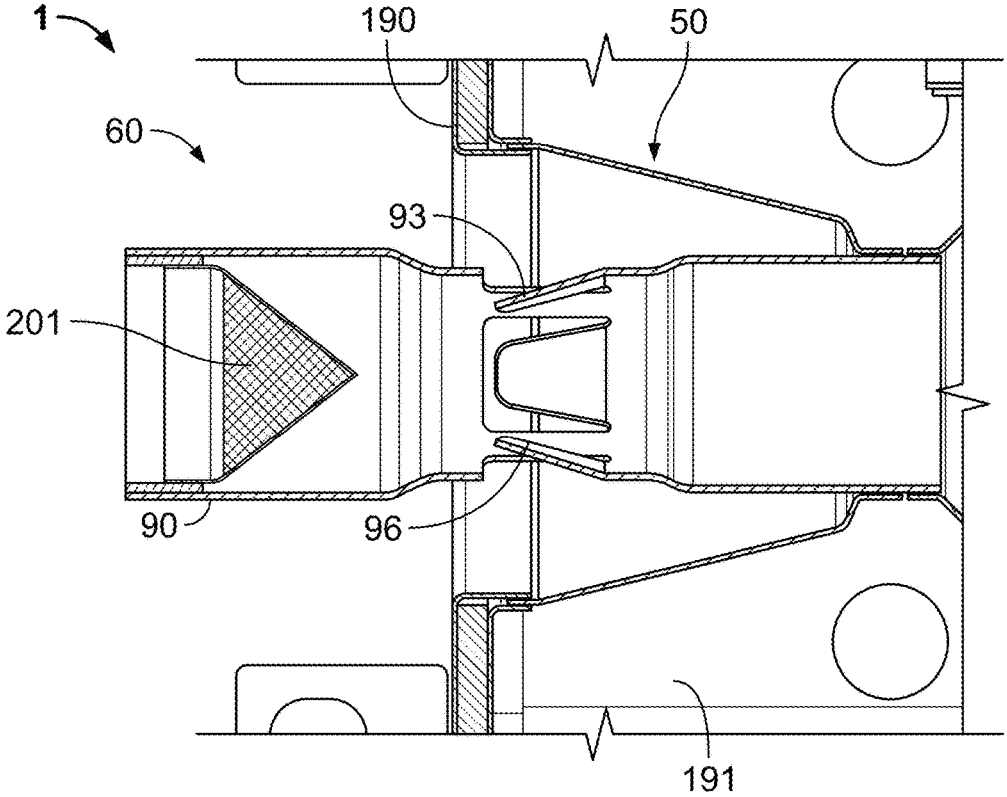
FIG. 50 illustrates a partially cutaway side view of another alternative configuration of the system of FIG. 47, depicting a different geometry of the cooling air inlet.

As is shown for example in FIG. 48, combustion exhaust gas (dot-dot dash lines) enters a first chamber 192*a* through the muffler inlet 197. The combustion exhaust gas then enters a crossover tube 194 at a perforated tube end 195 in the first chamber 192*a* and flows through the opposing perforated tube end 195 into a third chamber 192*c*. At this point the combustion exhaust gas flows through a perforated section 196 of a dividing wall 193 separating a second chamber 192*b* and the third chamber 192*c*, and into the second chamber 192*b*. The combustion exhaust gas then enters a catalyst 199 via the inlet 200, undergoes a catalytic chemical reaction, and exits the muffler outlet 198 into a cooling assembly 40. Once in the cooling assembly 40, cooling air (dashed lined) is guided to the venturi section 90 and the air guide 50, sucked into suction ports 93 via, and mixed with the catalyzed combustion exhaust in the mixing chamber 60 to lower the peak temperature of the combined exhaust gas (solid line). The increased flow path length within the muffler housing 191 may contribute both to muffling the engine noise and allowing heat to dissipate as the combustion exhaust gas flows through the muffler housing 191. Finally, FIGS. 49 and 50 show alternative configurations of the mixing chamber 60 and the air guide 50.

Figure 51:
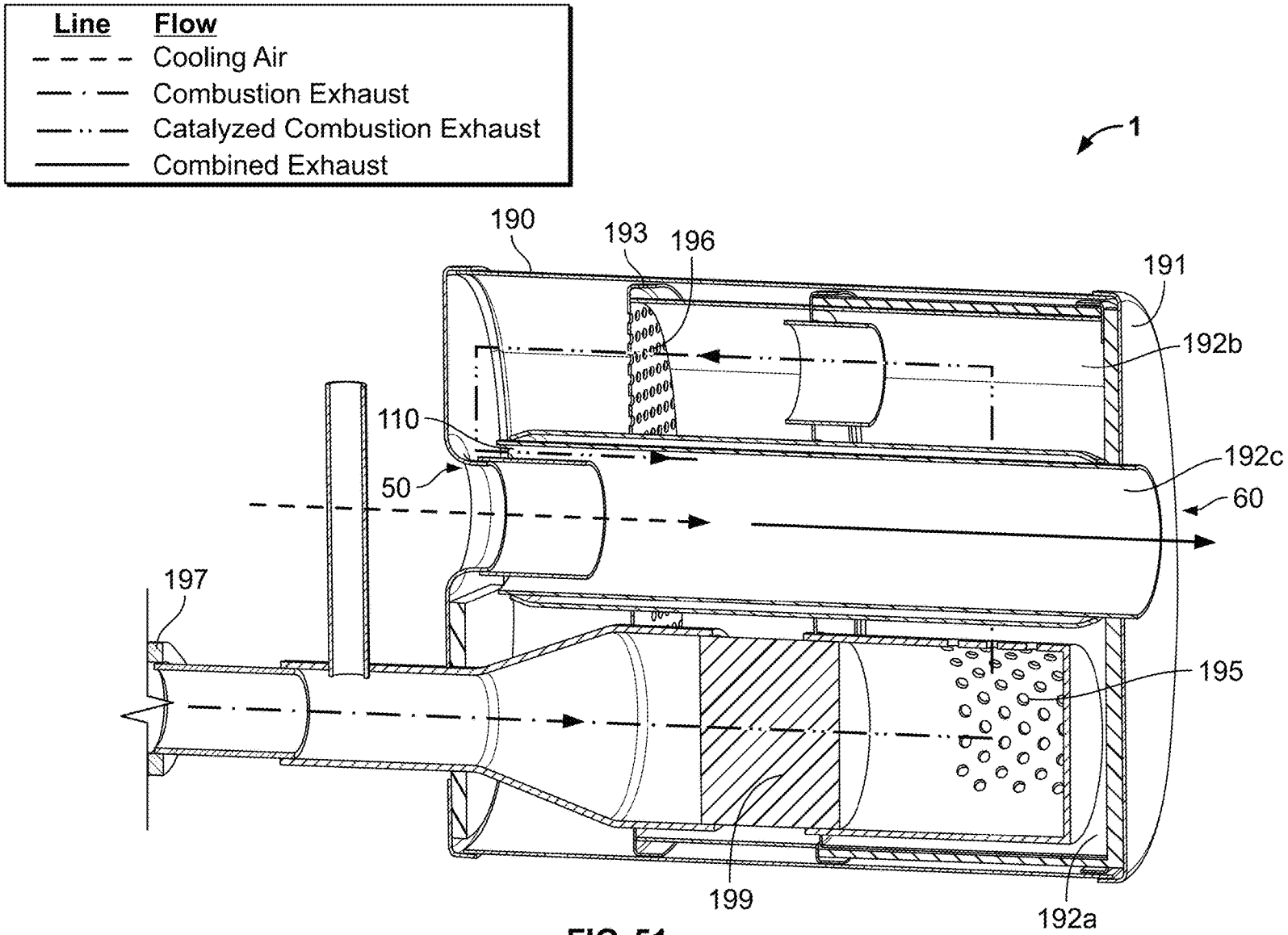
FIG. 51 illustrates a partial cutaway perspective view of an alternative configuration of an exhaust cooling system for use with internal combustion engines powering small power equipment and power tools, showing the mixing chamber being integrated into the muffler enclosure of the exhaust system, and depicting a flow diagram showing the flow of catalyzed combustion exhaust gases through the tightly packaged exhaust extension.

FIG. 51 illustrates a partial cutaway perspective view of an alternative configuration of the exhaust cooling system 1, showing the mixing chamber 60 being integrated into the muffler housing 191 of the exhaust system 190. The exhaust system includes the first chamber 192*a*, the second chamber 192*b*, and the third chamber 192*c* connected by the perforated section 196 in the dividing walls 193. The catalyst 199 is positioned in the first chamber 192*a*. As illustrated by the flow diagram, combustion exhaust gas (dot-dash line) enter the exhaust system 190 via the muffler inlet 197 and flow into the catalyst 199, undergoing a catalytic chemical reaction. The catalyzed combustion exhaust (dot-dot dash line) exits the catalyst 199 via the perforated tube end 195 into the second chamber 192*b*. The gas then passes through the perforated section 196 into the third chamber 192*c*, past the air guide 50 and into the mixing chamber 60. Once in the mixing chamber 60, the catalyzed combustion exhaust is coaxially mixed with the cooling air (dashed line).

Figure 52:
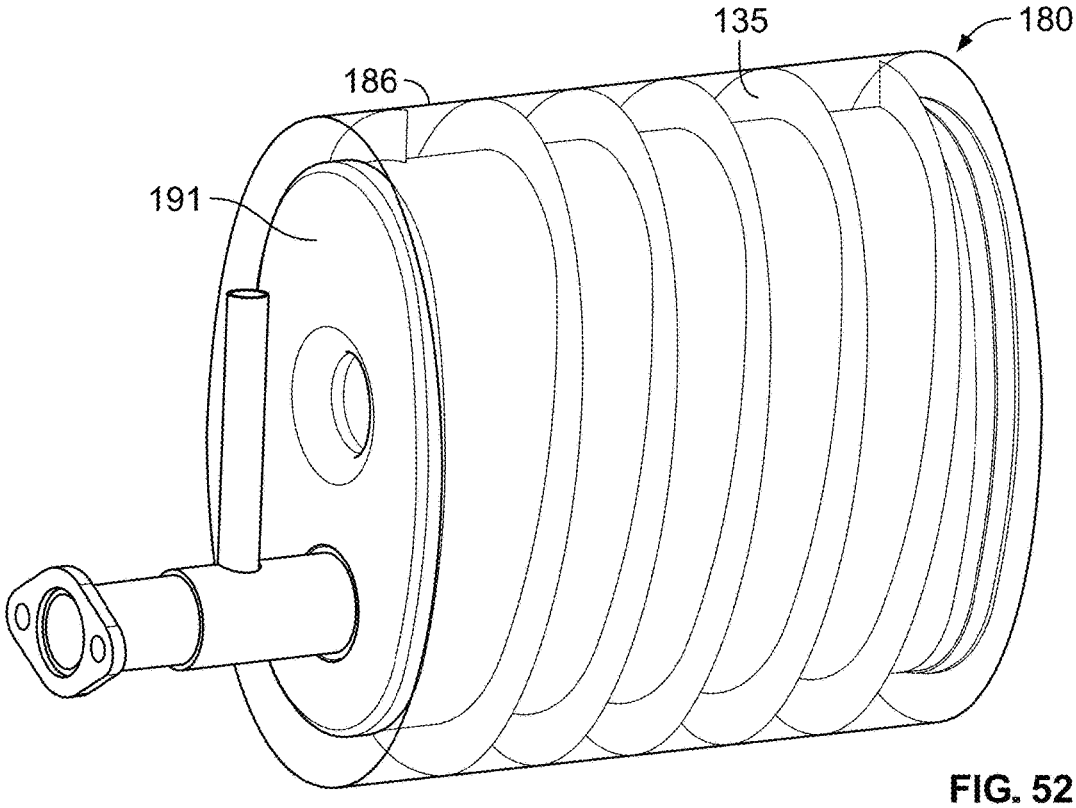
FIG. 52 illustrates a perspective view of an alternative configuration of an exhaust cooling system for use with internal combustion engines powering small power equipment and power tools including a tightly packaged exhaust extension surrounding the muffler enclosure surrounding the system of FIG. 51. The exterior wall of the system is shown as translucent to illustrate the internal path of the tightly packaged exhaust extension.
Figure 53:
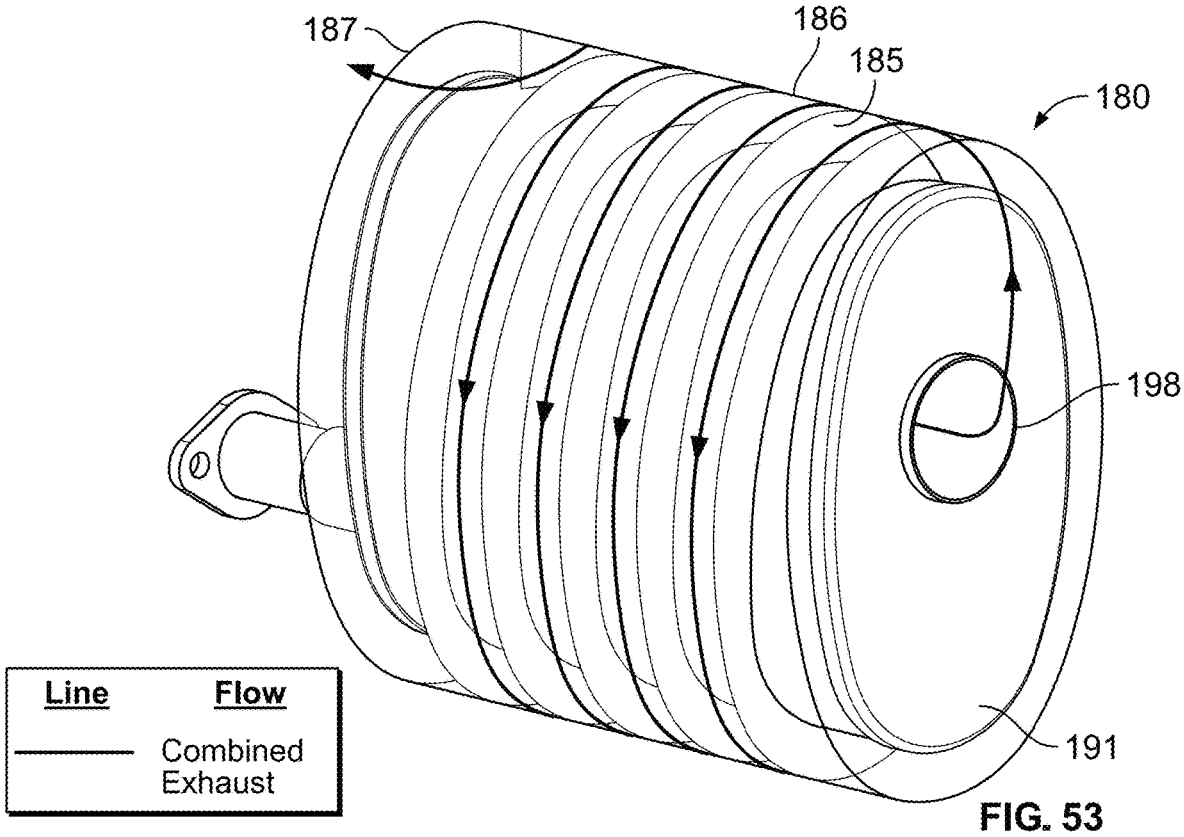
FIG. 53 illustrates another perspective view of the system of FIG. 52, and depicts a flow diagram showing the flow the catalyzed combustion exhaust gases through the tightly packaged exhaust extension. The exterior wall of the system is shown as translucent to illustrate the internal path of the tightly packaged exhaust extension.

FIGS. 52 and 53, show an optional tightly packaged exhaust extension 180 surrounding the muffler housing 191 of the embodiment of FIG. 51. It is understood that the tightly packaged exhaust extension 180 of FIGS. 52 and 53 could also be applied to other muffler housings). The tightly packaged exhaust extension 180 includes a spiral wall 185 enclosed by an outer wall 186 (shown as translucent for clarity of illustration). In such an embodiment, the muffler housing 191 may comprise a dual wall structure separated by an air gap (not shown) to assist in insulating the tightly packaged exhaust extension 180. As shown by the flow diagram in FIG. 53, the combined exhaust gas (solid line), or alternatively the catalyzed combustion exhaust (not shown), flows out of the muffler outlet 198, is trapped by the outer wall 196, and is forced to following the path of the spiral wall 185 until it flows out of an extension exit 187 into the atmosphere. As is discussed above with reference to FIG. 43, the increase in exhaust length allows for heat to dissipate as the combined exhaust gas (solid line) travels through the tightly packaged exhaust extension 180 and thus may contribute to drastically reducing the peak temperature of the catalyzed combustion exhaust gas prior to being released to the atmosphere. Given the high temperature of the catalyzed combustion exhaust, a higher temperature material such as austenitic stainless steel may be used to form tightly packaged exhaust extension 180.

Figure 54:
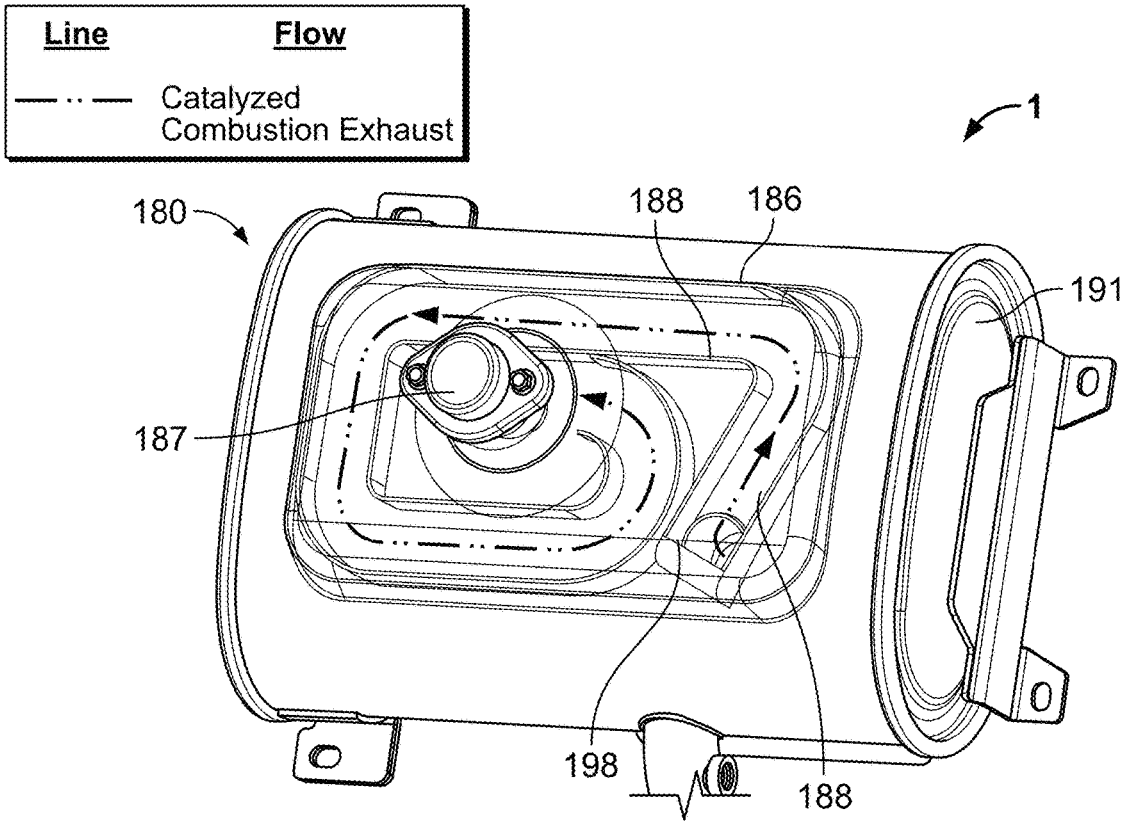
FIG. 54 illustrates a perspective view of an alternative configuration of an exhaust cooling system for use with internal combustion engines powering small power equipment and power tools including a tightly packaged exhaust extension surrounding the muffler enclosure, and depicting a flow diagram showing the flow of catalyzed combustion exhaust gases through the tightly packaged exhaust extension. The exterior wall of the system is shown as translucent to illustrate the internal path of the tightly packaged exhaust extension.

FIG. 54 shows another alternative configuration of an exhaust cooling system 1 including a tightly packaged exhaust extension 180 surrounding the muffler housing 191. As illustrated, the tightly packaged exhaust extension 180 includes an outer wall 186 (shown as translucent for clarity of illustration) and one or more flow walls positioned between the muffler housing 191 and the outer wall 186 to form a circuitous path. Catalyzed combustion exhaust gas (dot-dot dash line) exits the muffler outlet 198 into the tightly packaged exhaust extension 180 and is forced to flow along a desired flow path by the flow wall(s) 188 and outer wall 186 to an extension exit 187. Likewise here, in the increased exhaust length allows for heat to dissipate as the catalyzed combustion exhaust (dot-dash line) travels through the tightly packaged exhaust extension 180.

Figure 55:
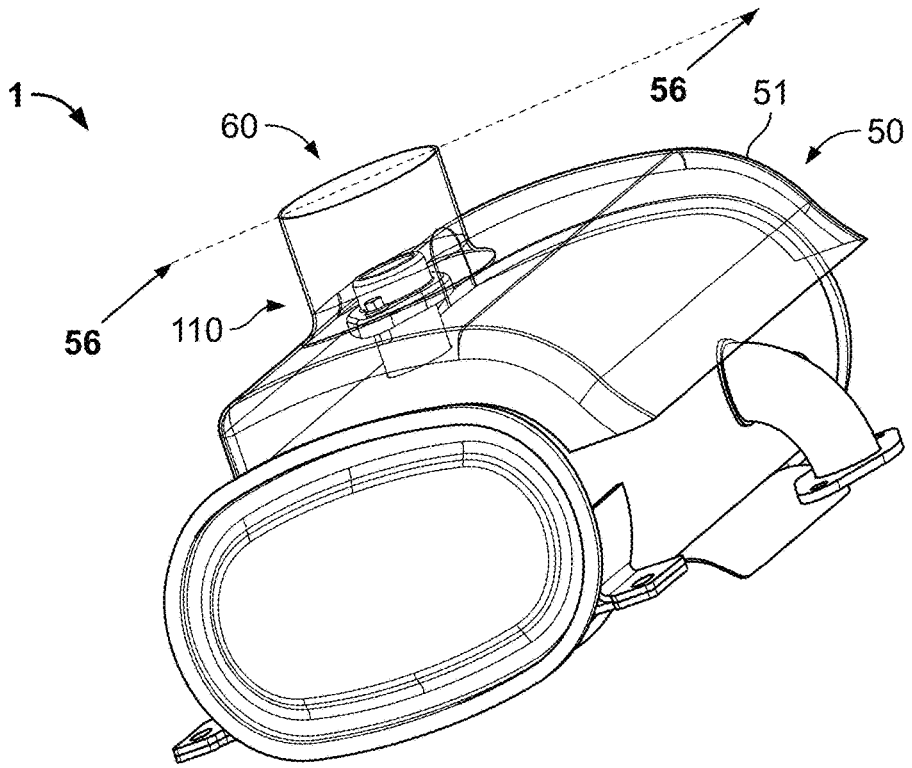
FIG. 55 illustrates perspective view an alternative configuration of an exhaust cooling system for use with internal combustion engines powering small power equipment and power tools, showing an alternative configuration of the air guide panel. The air guide panel is shown as translucent for clarity of illustration.
Figure 56:
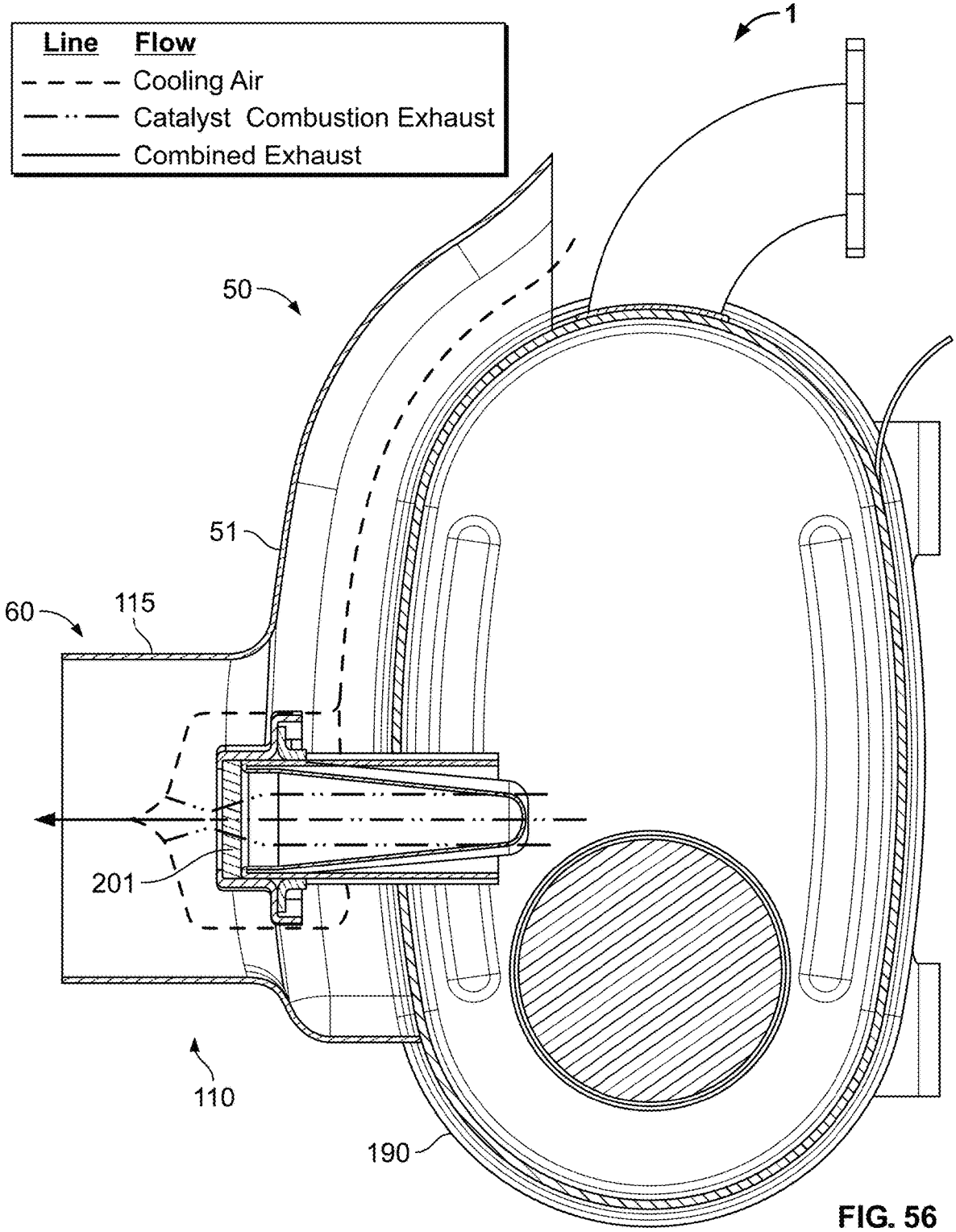
FIG. 56 is a cross section view taken along line 56-56 in FIG. 55, depicting a flow diagram showing the path of engine cooling air, catalyzed combustion exhaust gases, and the mixture of the combined exhaust gases.

FIGS. 55 and 56 show another alternative configuration of the exhaust cooling system 1 including an alternative air guide panel 50, comprising the air guide panel 51, and the mixing chamber 60 comprising the coaxial mixer 110. As illustrated in FIG. 56, engine cooling air (dashed line) is guided into the air guide panel 51 and to an extension tube 115 of the coaxial mixer 110. Catalyzed combustion exhaust (dot-dot dash line) flows out of the exhaust system 190 through a spark arrestor screen 201, and into the coaxial mixer 110 of the mixing chamber 60. The mixing of the catalyzed combustion exhaust (dot-dot dash line) with the engine cooling air (dashed line), or other cooling air (not shown), lowers the peak temperatures of the combined exhaust gases (solid lines).

Figure 57:
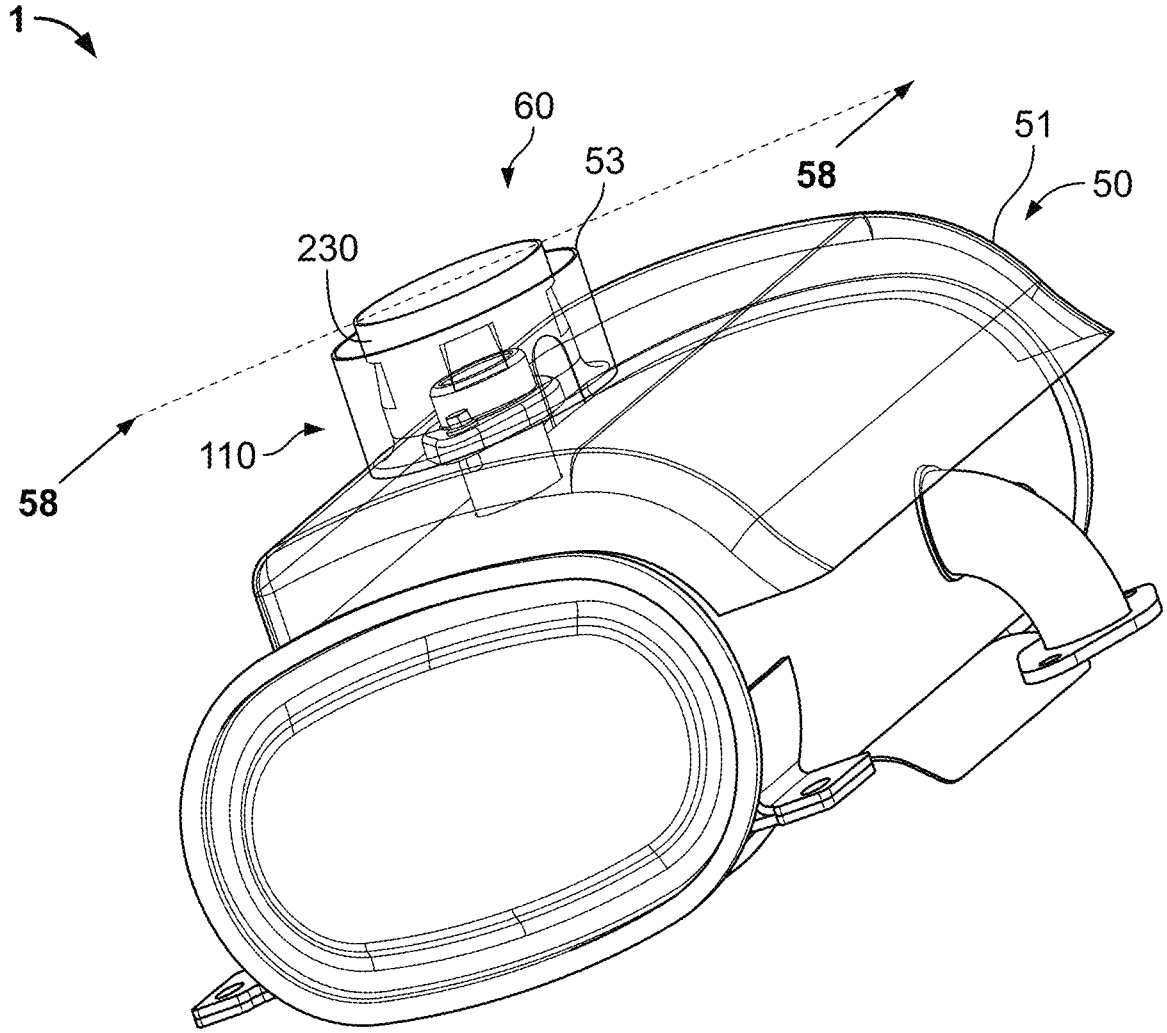
FIG. 57 illustrates perspective view an alternative configuration of an exhaust cooling system for use with internal combustion engines powering small power equipment and power tools, showing an alternative configuration of the air guide panel and including a venturi section. The air guide panel is shown as translucent for clarity of illustration.
Figure 58:
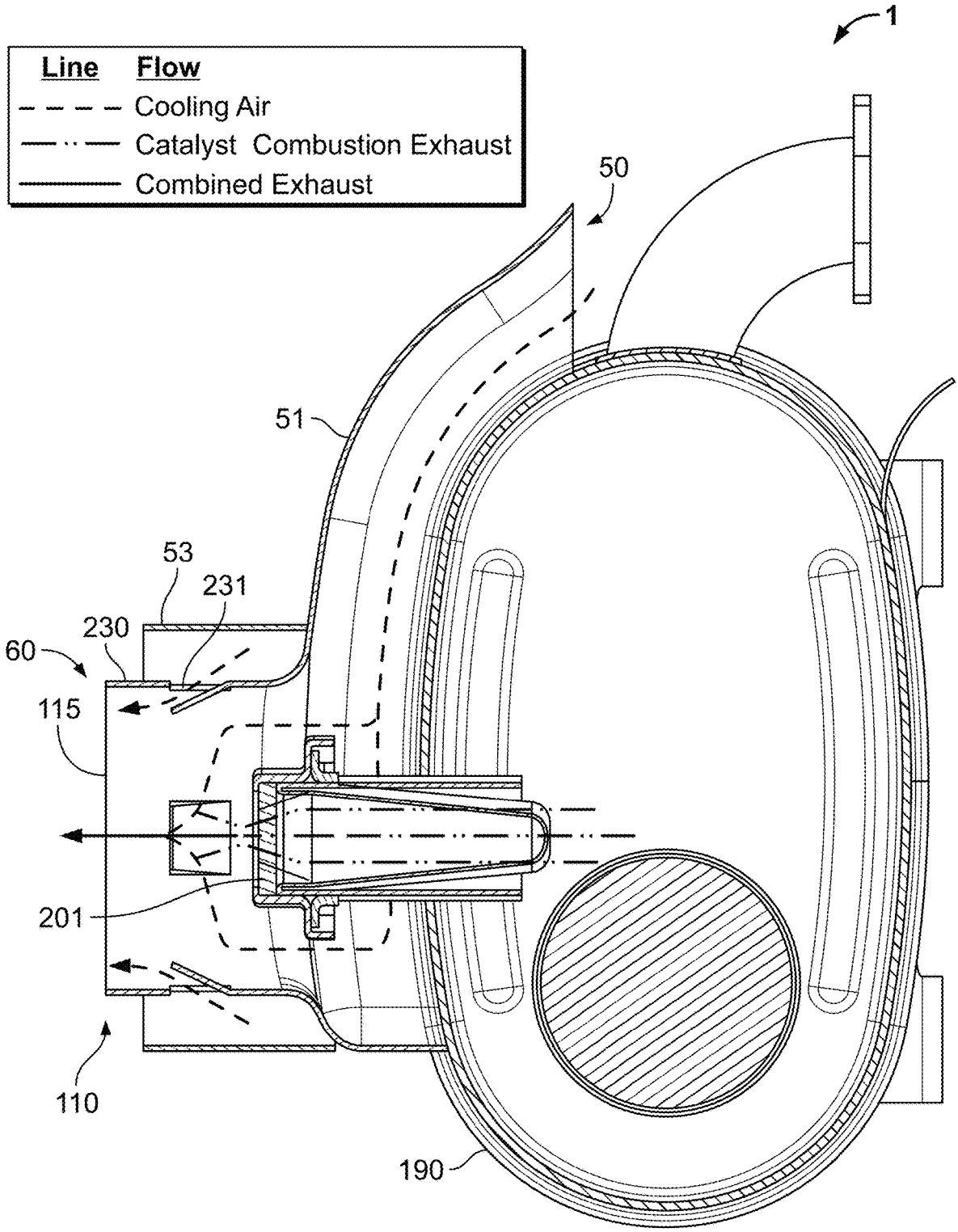
FIG. 58 is a cross section view taken along line 58-58 in FIG. 57, depicting a flow diagram showing the path of engine cooling air, catalyzed combustion exhaust gases, cooling air, and the mixture of the combined exhaust gases.

FIGS. 57 and 58 show a variation of the preceding system including a louvered section 230. As illustrated, the mixing chamber 60 includes both the louvered section 230 and the coaxial mixer 110. The air guide 50 includes both the air guide panel 51 and an additional air guide channel 53 for guiding cooling air to the louvered section 230. As illustrated in FIG. 58, engine cooling air (dashed line) is guided into the air guide panel 51 and to the extension tube 115 of the coaxial mixer 110. Catalyzed combustion exhaust (dot-dot dash line) flows out of the exhaust system 190 through the spark arrestor screen 201, and into the coaxial mixer 110 of the mixing chamber 60. Further, additional cooling air (dashed line) is sucked into the ports 231 of the louvered section 230 and enters the extension tube 115 of the mixing chamber 60. The mixing of the catalyzed combustion exhaust (dot-dot dash line), engine cooling air (dashed line) and cooling air (dashed line) lowers the peak temperatures of the combined exhaust gases (solid lines).

Figure 59:
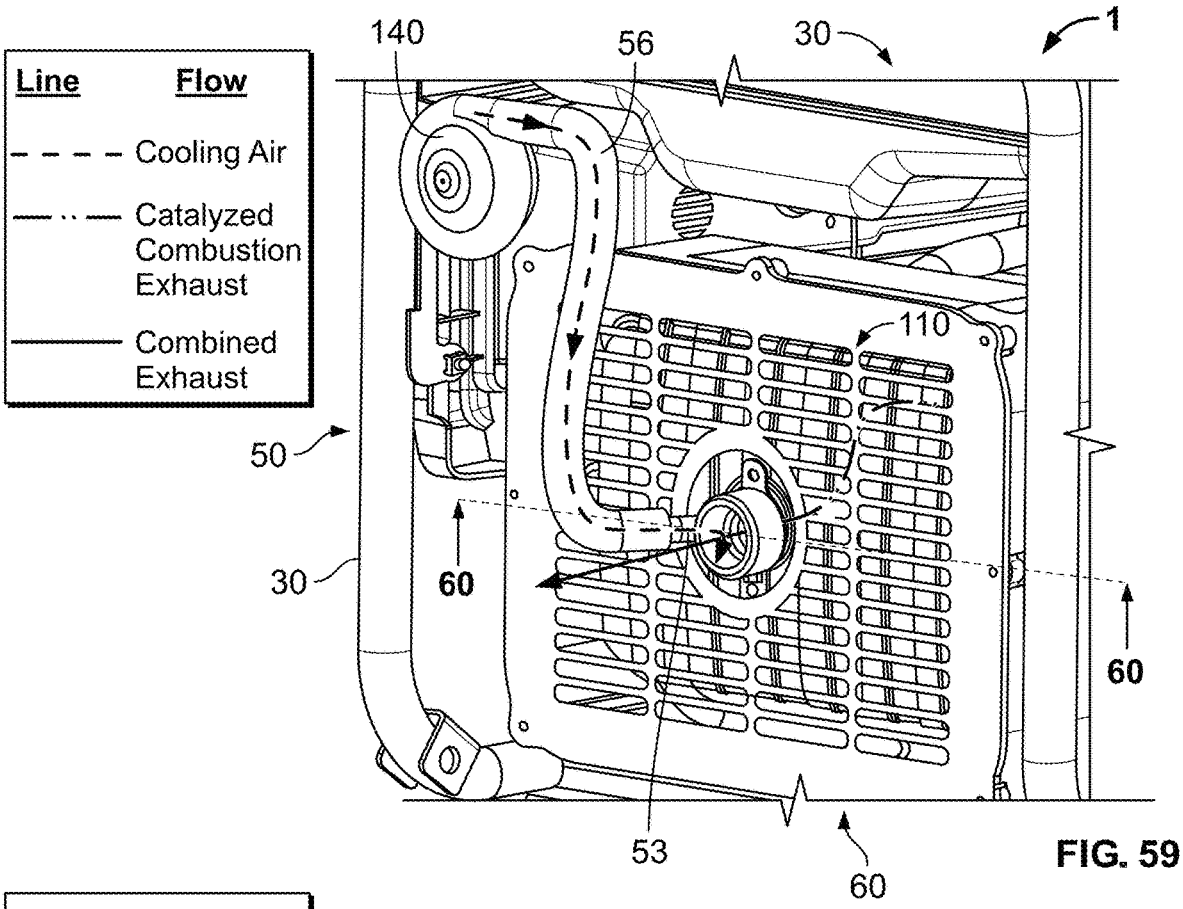
FIG. 59 is partial perspective view of an alternative configuration of exhaust cooling system for use with internal combustion engines powering small power equipment and power tools, showing an auxiliary fan and cooling air guide integrated into an exemplary open frame generator.
Figure 60:
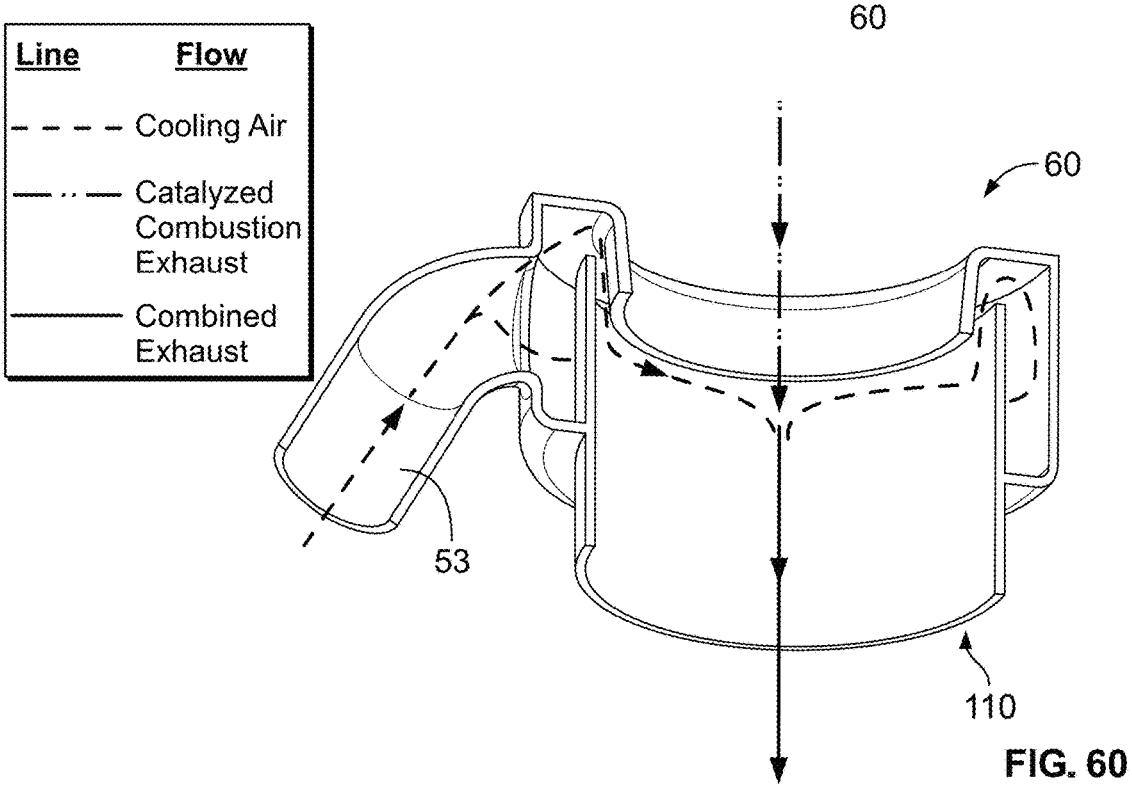
FIG. 60 is a partial cutaway perspective view of the mixing chamber of FIG. 59, depicting a flow diagram showing the flow of the catalyzed combustion exhaust gases mixing with the forced cooling air in the mixing chamber.

FIGS. 59 and 60 show another alternative configuration of exhaust cooling system 1, including the electric auxiliary fan 140 and cooling air guide 50 including a tube 56 being integrated into an exemplary open frame generator 30. Specifically, the tube 56 supplies the cooling air to a channel 53 into the coaxial mixer 110 of the mixing chamber 60. As illustrated in FIGS. 59 and 60, the electric auxiliary fan 140 pressurizes cooling air (dashed line), which flows through the tube 56 into the channel 53 and into the coaxial mixer 110 of the mixing chamber 60, where it combines with the catalyzed combustion exhaust (dot-dot dash line). The mixing of the catalyzed combustion exhaust (dot-dot dash line) with the forced cooling air (dashed line) lowers the peak temperatures of the combined exhaust gases (solid lines).

Figure 61:
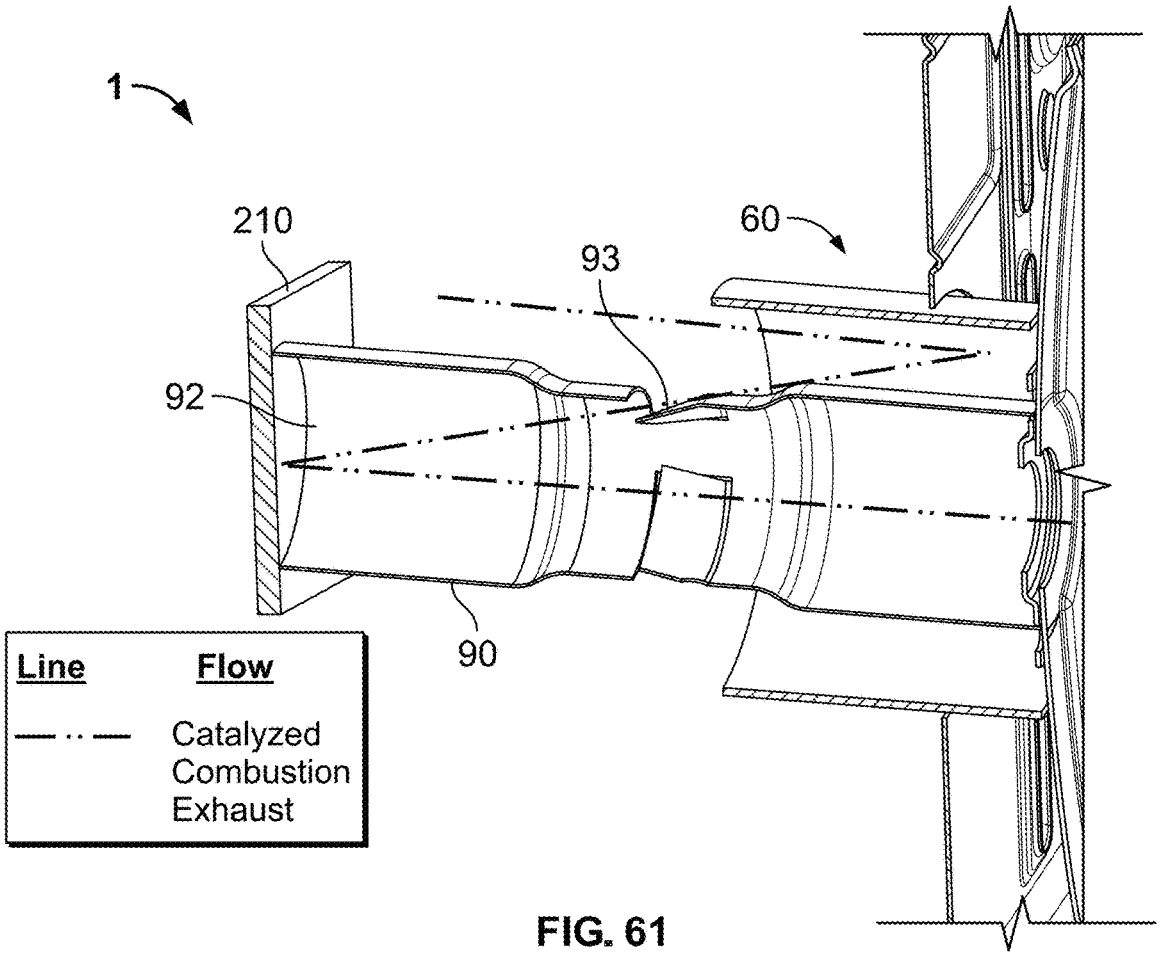
FIG. 61 is a partial cutaway perspective view of an alternative configuration of exhaust cooling system for use with internal combustion engines powering small power equipment and power tools, showing a failsafe device allowing exhaust gases to exit in the event the exhaust end of the mixing chamber is blocked.

FIG. 61 shows how one configuration of the exhaust cooling system 1, including the venturi section 90, can act as a failsafe device allowing exhaust gases to exit in the event the outlet 92 of the venturi section 90 is blocked by a blockage 210. As shown in FIG. 61, combined exhaust gas and/or catalyzed combustion exhaust gas may exit through suction ports 93 in the event of the blockage 210. Other embodiments such as the embodiments shown in FIGS. 47-50 and FIGS. 57-58 may also act as a failsafe device in the event the outlet of the venturi section 90 is blocked. For example, combined exhaust gases may exit through suction port 93 of the venturi section 90 of coaxial mixer 110 in the event of the blockage 210 (see e.g., FIG. 58). Such failsafe prevents backflow of combustion exhaust gas back into the generator housing in the event of the blockage 210. It is understood that the louvered section 230 shown in FIGS. 57 and 58 functions similarly as a failsafe. It is further understood that the failsafe principle of a blocked outlet flow path could also be applied to a forced air mixing solution (not shown), but would need other components such as a check flap (not shown) in the cooling air flow path, which could prevent combustion exhaust flow back into the cooling air source, and may result in the engine shutting down. Finally, the present disclosure contemplates that an overpressure vent (not shown) could be included elsewhere in the cooling system 1, similar to a cabin pressure relief valve on a car body.

Figure 62:
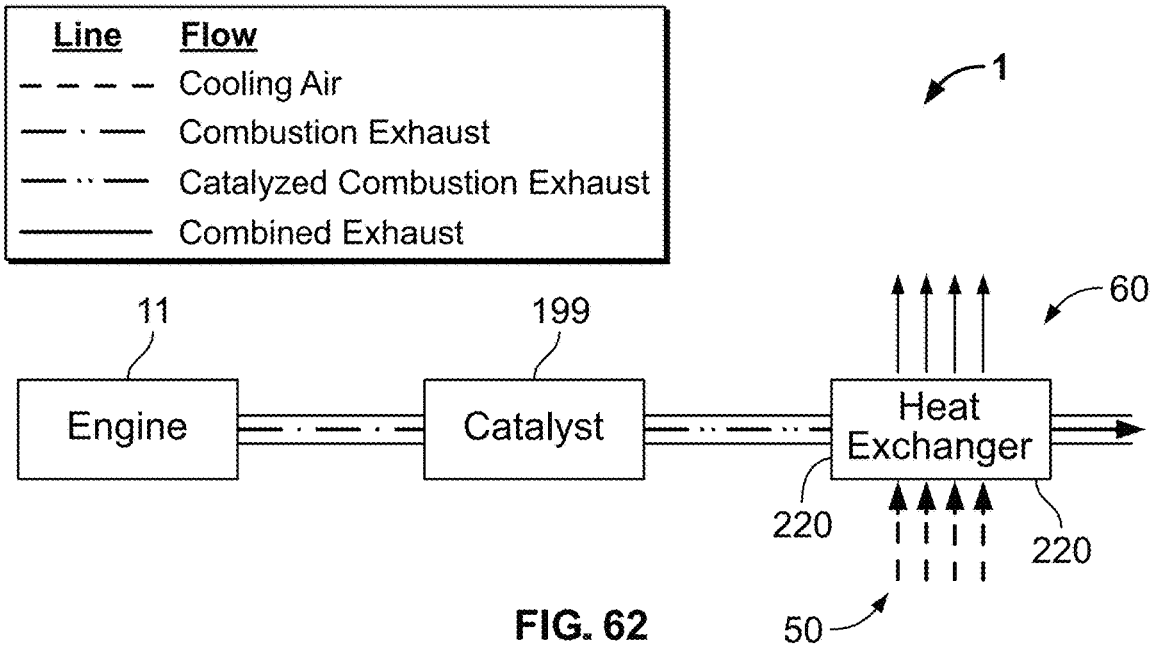
FIG. 62 is a block diagram of another configuration of the exhaust cooling system for use with internal combustion engines powering small power equipment and power tools, including an heat exchanger.
Figure 63:
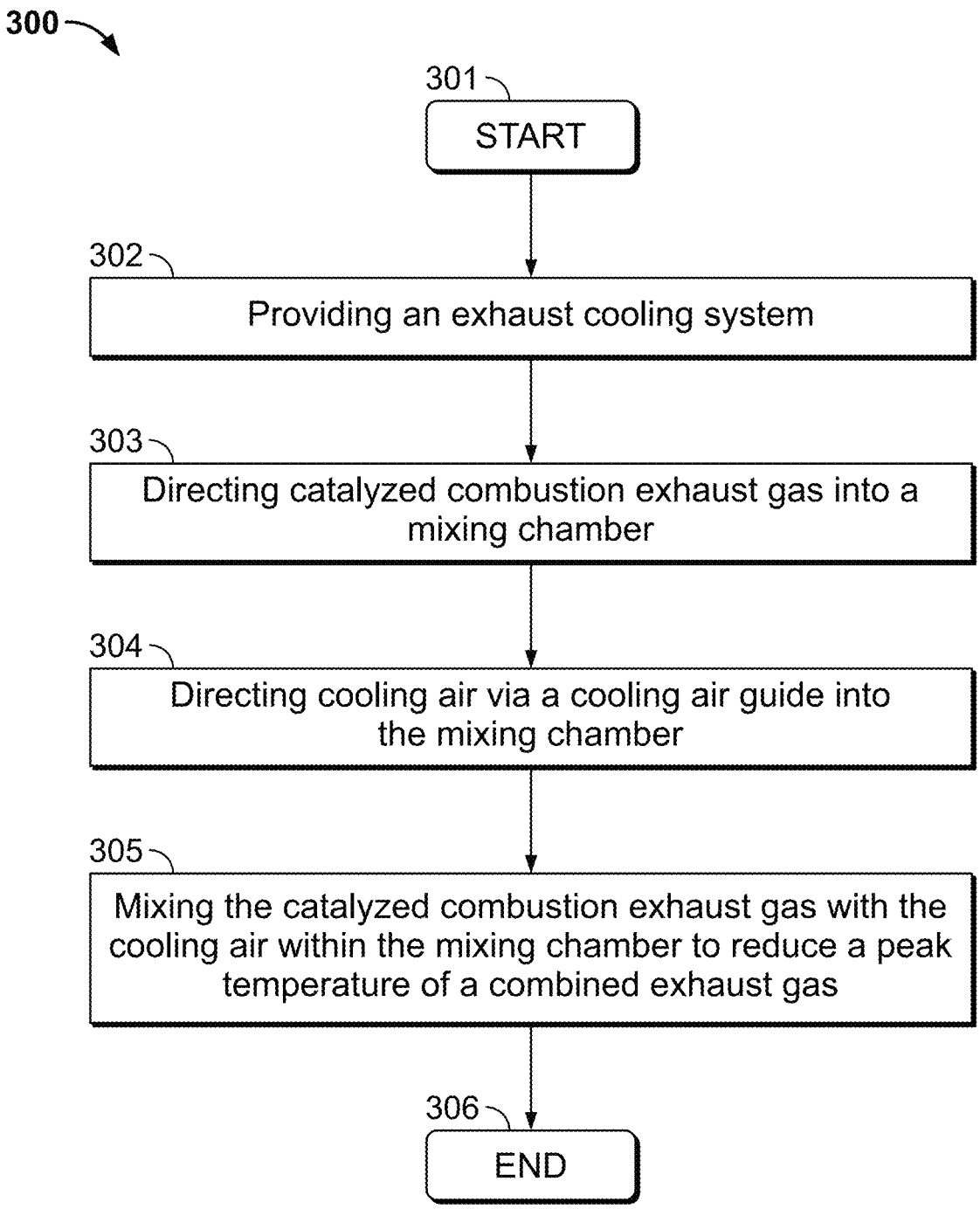
FIG. 63 is a flow chart illustrating example steps of a method for cooling catalyzed combustion exhaust in small power equipment including a short length exhaust.

FIG. 62 shows a block diagram of another configuration of the exhaust cooling system 1, including heat exchanger 220. Common exhaust system heat exchangers, such as EGR coolers, use a gas-to-water heat exchanger utilizing engine coolant, which is much more efficient at removing heat and air. Most internal combustion engine 11 powered small power equipment and power tools (including portable generators) are air cooled. Thus, there isn't an existing liquid cooling system to utilize for gas-to-water heat exchanger 220. Larger power equipment, for example stationary generators or large portable generators, may however, include a liquid cooling system (not shown). For these applications, a gas-to-liquid heat exchanger 220 could be incorporated to drastically reduce the peak temperature of the catalyzed combustion exhaust gas would potentially be useful.

As shown in FIG. 62, combustion exhaust gas (dot dash line) produced by the engine 11 enters the catalyst 199 and undergoes a catalytic chemical reaction. The catalyzed combustion exhaust gas (dot-dot dash line) then enters the heat exchanger 220 where the catalyzed combustion exhaust gas and cooling air (dashed lines) may be separated by walls (not shown) and/or an air guide 50. The outer walls of the heat exchanger 220 may also include fins (not shown) to maximize surface area, and would be most effective with a forced supply of cooling air flowing over the heat exchanger 220 (e.g., bypass cooling fan air, engine cooling air, dedicated electric blower, etc). The catalyzed combustion exhaust and/or cooling air may then flow through inner passages (not shown) of the heat exchanger 221 and may exit as combined exhaust (solid lines) with a reduced peak temperature. These inner passages may be finned and/or may include a circuitous path to maximize flow length and surface area. Given the high temperature of the catalyzed combustion exhaust, a higher temperature material such as austenitic stainless steel may be used to form the inner passages. The heat exchanger 220 could also be combined with any of the above described cooling systems 1 to further reduce the peak temperature of the catalyzed combustion exhaust.

The present disclosure also contemplates a method for cooling catalyzed combustion exhaust in small power equipment including a short length exhaust. The example method steps starts at step 301. At step 302, the method comprises providing an exhaust cooling system, the exhaust cooling system including the cooling air guide 50 and the mixing chamber 60. It is understood that any of the above described cooling systems 1 and/or cooling assemblies 40 may be incorporated in the method. At step 303, the method comprises directing the catalyzed combustion exhaust gas into the mixing chamber 60. At step 304, the method comprises directing cooling air via the cooling air guide 50 into the mixing chamber 60. At step 305, the method comprises mixing the catalyzed combustion exhaust gas with the cooling air within the mixing chamber 60 to reduce a peak temperature of a combined exhaust gas. The example method may stop at step 306. It is further understood that the described method may be applied to any an exhaust cooling system 1 for use with internal combustion engines powering small power equipment and power tools.

The present described disclosure is described in such full, clear, concise, and exact terms as to enable any person skilled in the art to which it pertains to practice the same. It is to be understood that the foregoing described preferred aspects of the disclosure and that modification may be made therein without departing from the spirit of scope of the disclosure as set forth in the appended claims. The scope of the disclosure is to be accorded the broadest interpretation to encompass all such modifications and equivalent structures and functions. Therefore, it is intended that the application not be limited to the particular aspects illustrated or described, but that the application will include all aspects falling within the scope of the general disclosure.

What is claimed:

1. An exhaust gas cooling system for cooling catalyzed combustion exhaust gas in small power equipment, the system comprising:

a cooling air guide; and a mixing chamber including an intake end, an exhaust end, at least one cooling inlet, and a swirl mixer, wherein:

a short length exhaust, including a catalytic converter and a muffler outlet tube, is operably connected to the intake end of the mixing chamber, and is operable to direct catalyzed combustion exhaust gas through the muffler outlet tube, into the intake end, and into the mixing chamber;

the cooling air guide includes an air guide panel and at least one radial rib, wherein the cooling air guide is operably connected to the at least one cooling inlet, and is operable to direct cooling air through the at least one cooling inlet into the mixing chamber;

the swirl mixer includes a swirl vane assembly positioned around a cylindrical sleeve, the cylindrical sleeve being operably connected to the muffler outlet tube, wherein the swirl vane assembly is operable to induce the cooling air and catalyzed combustion exhaust into a vortex within the mixing chamber; and the mixing chamber is operable to facilitate mixing the catalyzed combustion exhaust gas and cooling air to reduce a peak temperature of a combined exhaust gas.

2. The system of claim 1, wherein the air guide panel includes an aperture sized to accommodate the mixing chamber.

3. The system of claim 1, wherein the at least one cooling inlet comprises a plurality of cooling inlets and the at least one radial rib comprises a plurality of radial ribs.

4. The system of claim 1, wherein the mixing chamber further comprises a diffuser operable to diffuse the combined exhaust gas before the combined exhaust gas exits the exhaust end of the mixing chamber.

5. The system of claim 4, wherein the diffuser comprises a cone diffuser.

6. The system of claim 4, wherein the diffuser comprises a vane diffuser.

7. The system of claim 4, wherein the diffuser comprises a perforated tube diffuser.

8. The system of claim 1, wherein the mixing chamber further comprises a venturi section and the at least one cooling inlet comprises at least one venturi inlet, wherein the venturi section comprises a reduced diameter section and the at least one venturi inlet is disposed in the reduced diameter section; and the venturi section is operable to facilitate mixing of the catalyzed combustion exhaust gas with the cooling air.

9. The system of claim 8, wherein the mixing chamber further comprises a swirl mixer including a plurality of swirl vanes positioned around the venturi section, wherein the plurality of swirl vanes are operable to induce the cooling air and catalyzed combustion exhaust into the mixing chamber.

10. The system of claim 1, wherein the mixing chamber further comprises a coaxial mixer, wherein:

the at least one cooling inlet comprises an outer cooling air duct, an inner muffler outlet tube is positioned at least partially within the outer cooling air duct, and the coaxial mixer is operable to coaxially mix the catalyzed combustion exhaust gas with the cooling air to facilitate mixing of the catalyzed combustion exhaust gas with the cooling air.

11. The system of claim 1, wherein the mixing chamber further comprises a tangential swirl mixer and the at least one cooling inlet further comprises at least one tangential intake duct; wherein:

the tangential intake duct is operable to tangentially direct cooling air into the mixing chamber to induce the cooling air and catalyzed combustion exhaust into the mixing chamber to facilitate mixing of the catalyzed combustion exhaust with the cooling air.

12. A small power equipment, the small power equipment comprising:

an internal combustion engine, a short length exhaust including a catalytic converter operably connected to the internal combustion engine and a muffler outlet tube, the short length exhaust being operable to receive combustion exhaust gas from the internal combustion engine, an exhaust cooling system operably connected to the short length exhaust, the exhaust cooling system being operable to received catalyzed combustion exhaust gas from the short length exhaust;

wherein the exhaust cooling system comprises:

a cooling air guide; and a mixing chamber including an intake end, an exhaust end, at least one cooling inlet, and a swirl mixer, wherein:

the short length exhaust is operably connected to the intake end of the mixing chamber via the muffler outlet tube;

the cooling air guide includes an air guide panel and at least one radial rib, wherein the cooling air guide is operably connected to the at least one cooling inlet, and is operable to direct cooling air through the at least one cooling inlet into the mixing chamber;

the swirl mixer includes a swirl vane assembly positioned around a cylindrical sleeve, the cylindrical sleeve being operably connected to the muffler outlet tube, wherein the swirl vane assembly is operable to induce the cooling air and catalyzed combustion exhaust into a vortex within the mixing chamber; and the mixing chamber is operable to facilitate mixing of the catalyzed combustion exhaust gas and cooling air to reduce a peak temperature of a combined exhaust gas.

13. The small power equipment of claim 12, wherein the mixing chamber further comprises a venturi section and the at least one cooling inlet comprises at least one venturi inlet, wherein the venturi section comprises a reduced diameter section and the at least one venturi inlet is disposed in the reduced diameter section; and the venturi section is operable to facilitate mixing of the catalyzed combustion exhaust gas with the cooling air.

14. The small power equipment of claim 13, wherein the mixing chamber further comprises a swirl mixer including a plurality of swirl vanes positioned around the venturi section, wherein the plurality of swirl vanes are operable to induce the cooling air and catalyzed combustion exhaust into the mixing chamber.

15. The small power equipment of claim 12, wherein the mixing chamber further comprises a coaxial mixer, wherein:

the at least one cooling inlet comprises an outer cooling air duct, an inner muffler outlet tube is positioned at least partially within the outer cooling air duct, and the coaxial mixer is operable to coaxially mix the catalyzed combustion exhaust gas with the cooling air to facilitate mixing of the catalyzed combustion exhaust gas with the cooling air.

16. The small power equipment of claim 12, wherein the mixing chamber further comprises a tangential swirl mixer and the at least one cooling inlet further comprises at least one tangential intake duct; wherein:

the tangential intake duct is operable to tangentially direct cooling air into the mixing chamber to induce the cooling air and catalyzed combustion exhaust into the mixing chamber to facilitate mixing of the catalyzed combustion exhaust with the cooling air.

17. The small power equipment of claim 12, further comprising a powered fan operable to force a flow of cooling air into the cooling air guide.

* * * * *